US010050382B2

(12) United States Patent
Droesbeke et al.

(10) Patent No.: US 10,050,382 B2
(45) Date of Patent: Aug. 14, 2018

(54) CRIMP-TO-WIRE ELECTRICAL CONNECTOR ASSEMBLY

(71) Applicant: FCI USA LLC, Etters, PA (US)

(72) Inventors: Gert Julien Droesbeke, Chartres (FR); Aymeric Soudy, Besancon (FR)

(73) Assignee: FCI USA LLC, Etters, PA (US)

( * ) Notice: Subject to any disclaimer, the term of this patent is extended or adjusted under 35 U.S.C. 154(b) by 0 days.

(21) Appl. No.: 15/304,317

(22) PCT Filed: Apr. 14, 2015

(86) PCT No.: PCT/US2015/025666
§ 371 (c)(1),
(2) Date: Oct. 14, 2016

(87) PCT Pub. No.: WO2015/160747
PCT Pub. Date: Oct. 22, 2015

(65) Prior Publication Data
US 2017/0040741 A1 Feb. 9, 2017

Related U.S. Application Data

(60) Provisional application No. 62/027,435, filed on Jul. 22, 2014, provisional application No. 61/979,215, filed on Apr. 14, 2014.

(51) Int. Cl.
*H01R 13/627* (2006.01)
*H01R 13/631* (2006.01)
(Continued)

(52) U.S. Cl.
CPC ..... *H01R 13/631* (2013.01); *H01R 13/426* (2013.01); *H01R 13/506* (2013.01);
(Continued)

(58) Field of Classification Search
CPC .. H01R 13/6275; H01R 9/03; H01R 13/6272; H01R 13/641; H01R 13/7175; H01R 13/514
(Continued)

(56) References Cited

U.S. PATENT DOCUMENTS 5,775,930 A * 7/1998 Model ..... H01R 13/641 439/352
5,910,027 A * 6/1999 Wayt ..... H01R 13/6272 439/352
(Continued)

FOREIGN PATENT DOCUMENTS

WO WO 97/49146 12/1997

OTHER PUBLICATIONS

International Search Report and Written Opinion for International Application No. PCT/US2015/025666 dated Feb. 2, 2016.
(Continued)

*Primary Examiner* — Thanh Tam Le
(74) *Attorney, Agent, or Firm* — Wolf, Greenfield & Sacks, P.C.

(57) ABSTRACT

An electrical connector assembly comprises a first connector having an outer housing having an activatable latch flexibly attached thereto, the latch having a lock tab located thereon; an inner housing mounted in the outer housing, the inner housing having first and second prongs integrally formed with the inner housing and configured to continuously bias the latch; and a second connector comprising a cavity formed on a surface thereof. Continuously biasing the latch by the first and second prongs causes the engagement of the lock tab of the first connector with the cavity of the second connector to lock the first connector to the second connector.

21 Claims, 52 Drawing Sheets

(51) Int. Cl.
*H01R 13/506* (2006.01)
*H01R 13/426* (2006.01)
*H01R 13/641* (2006.01)

(52) U.S. Cl.
CPC ..... *H01R 13/6272* (2013.01); *H01R 13/6273* (2013.01); *H01R 13/641* (2013.01)

(58) Field of Classification Search
USPC ..... 439/345, 350–352, 489, 490, 701
See application file for complete search history.

(56) References Cited

U.S. PATENT DOCUMENTS 6,435,895 B1 * 8/2002 Fink ..... H01R 13/6272 439/352
6,773,309 B1 * 8/2004 Shuey ..... H01R 13/4365 439/701
7,326,074 B1 * 2/2008 Lim ..... H01R 13/629 439/352
7,396,253 B2 * 7/2008 Nakamura ..... H01R 13/641 439/188
7,465,185 B2 * 12/2008 Tyler ..... H01R 13/506 439/352
7,544,081 B2 * 6/2009 Lim ..... H01R 13/4361 439/352
7,601,019 B2 * 10/2009 Hsieh ..... H01R 13/426 439/345
7,682,181 B1 * 3/2010 Jones, Jr. ..... H01R 13/6272 439/352
7,909,638 B2 * 3/2011 Seo ..... H01R 13/6272 439/352
8,016,606 B1 * 9/2011 Kwan ..... H01R 13/641 439/352
9,017,108 B2 * 4/2015 Suemitsu ..... H01R 13/4223 439/595
9,647,378 B1 * 5/2017 Mingo ..... H01R 13/5045
2011/0104930 A1 5/2011 Seong et al.

OTHER PUBLICATIONS

International Preliminary Report on Patentability for International Application No. PCT/US2015/025666 dated Oct. 27, 2016.

* cited by examiner

CRIMP-TO-WIRE ELECTRICAL CONNECTOR ASSEMBLY

CROSS REFERENCE TO RELATED APPLICATIONS

This application is a national stage filing under 35 U.S.C. § 371 of international application PCT/US2015/025666, entitled "CRIMP-TO-WIRE ELECTRICAL CONNECTOR ASSEMBLY," filed Apr. 14, 2015, which claims the benefit under 35 U.S.C. § 119(e) of U.S. Provisional Application No. 62/027,435, entitled "CRIMP-TO-WIRE ELECTRICAL CONNECTOR ASSEMBLY," filed Jul. 22, 2014, and U.S. Provisional Application No. 61/979,215, entitled "CRIMP-TO-WIRE ELECTRICAL CONNECTOR ASSEMBLY," filed Apr. 14, 2014, the entire contents of each of which is incorporated herein by reference.

BACKGROUND

Technical Field

The exemplary and non-limiting embodiments described herein relate generally to electrical connectors and, more particularly, to a crimp-to-wire electrical connector assembly in which a latch of a first connector is continuously biased into a position to lock a second connector.

Brief Description of Prior Developments

With regard to electrical connectors, connections made between the various elements of an electrical connector assembly should be durable and reliable. Many electrical connector assemblies employ latching devices that promote durability and reliability by inhibiting the unintentional disengagement of the various elements. However, such latching devices may not, under certain circumstances (e.g., due to excessive vibrational loads), provide suitable connection integrity even when back up measures such as connection position assurance (CPA) devices are employed. Accordingly, there is a need for a latching mechanism that maintains connection integrity with or without back up connection measures to provide secure electrical connections.

SUMMARY

The following summary is merely intended to be exemplary. The summary is not intended to limit the scope of the claims.

In accordance with one aspect, an apparatus comprises a first connector and a second connector, or just a first connector configured to mate with a second connector, the first connector comprising a latch for connecting the first connector and the second connector, the latch being continuously biased only by the first connector (not by a terminal position assurance (TPA) or connector position assurance (CPA) member) into a position to lock the first connector to the second connector.

In accordance with another aspect, a connector assembly comprises a first connector and a second connector or just a first connector configured to mate with a second connector, the first connector comprising a latch and a flexible prong, the flexible prong being configured to continuously bias the latch into the second connector to lock the first connector to the second connector.

In accordance with another aspect, an electrical connector assembly comprises a first connector comprising an outer housing having an activatable latch flexibly attached thereto, the latch having a lock tab located thereon; an inner housing mounted in the outer housing, the inner housing having first and second prongs integrally formed with the inner housing and configured to continuously bias the latch; and a second connector comprising a cavity formed on a surface thereof. Continuously biasing the latch by the first and second prongs causes the engagement of the lock tab of the first connector with the cavity of the second connector to lock the first connector to the second connector.

In accordance with another aspect, a CPA comprises a contact member, the contact member further comprising a center arm and two side arms extending from the contact member, each one of the respective two side arms connected to one another distal from the contact member by a cross beam, ends of the side arms opposite the contact member each defining hooked portions, the center arm extending between the two side arms and terminating short of the cross beam, and each of the two side arms being angled relative to the center arm.

In accordance with another aspect, a CPA comprises a contact member, the contact member further comprising a center arm and two side arms extending from the contact member, each one of the respective two side arms further comprising a peripheral arm extending outward from the side arm, each one of the respective peripheral arms comprising a protrusion on a distal end thereof, each respective protrusion comprising an inward-facing dimple and an outward-facing hook opposite the dimple, and each one of the respective two side arms being connected to one another distal from the contact member by a cross beam.

BRIEF DESCRIPTION OF THE DRAWINGS

The foregoing aspects and other features are explained in the following description, taken in connection with the accompanying drawings, wherein.

DETAILED DESCRIPTION OF EMBODIMENT

Figure 1:
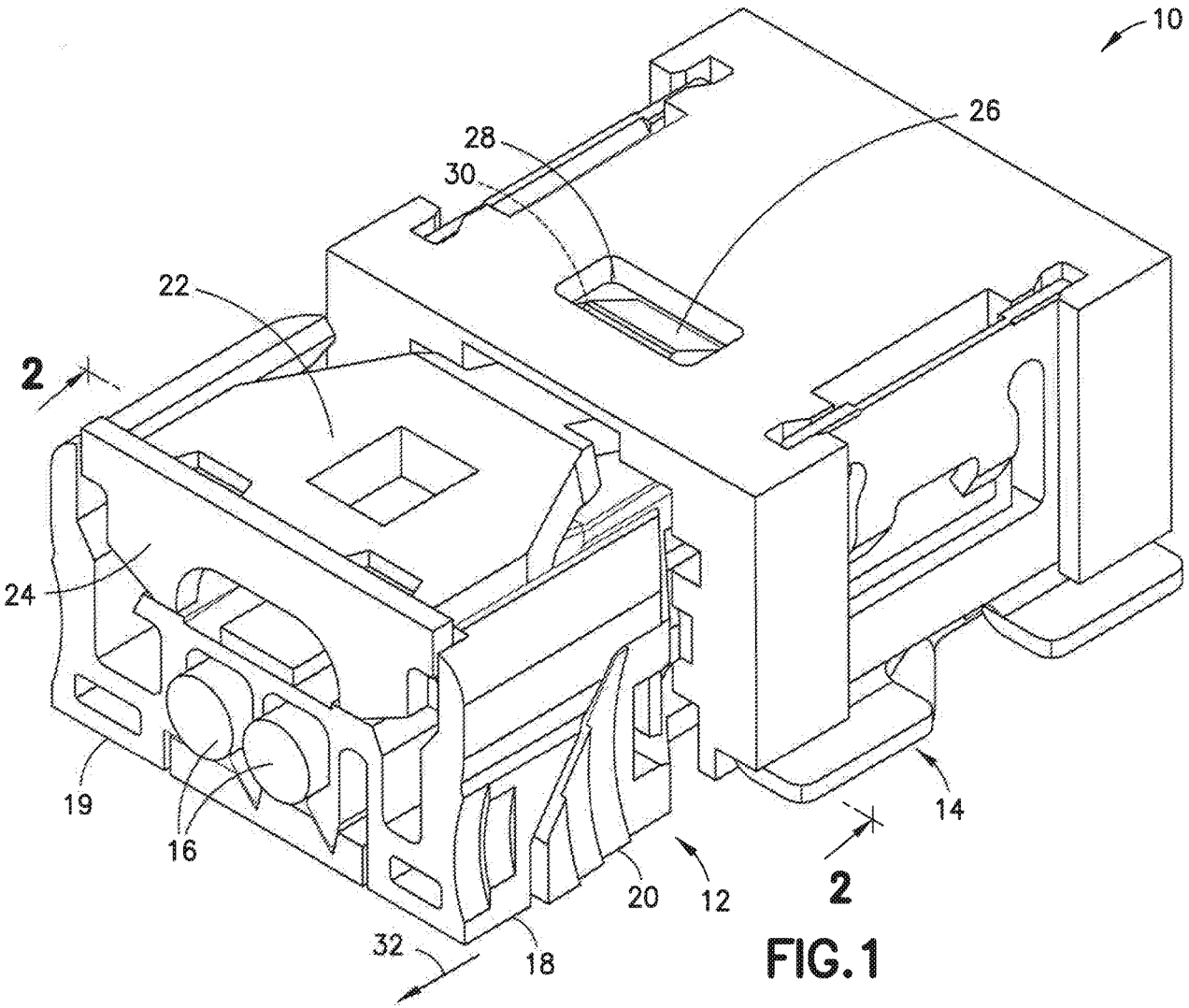
FIG. 1 is a perspective view of a connector assembly in a locked state.

Referring to FIG. 1, one exemplary embodiment of a connector assembly is designated generally by the reference number 10 and is hereinafter referred to as "connector assembly 10."

The connector assembly 10 comprises a first connector 12 and a second connector 14, the second connector 14 comprising, for example, a board connection device mounted to a printed wire board (PWB) via the engagement of contact pins (shown at 38 in FIG. 2) in receiving cavities. The connector assembly 10 provides for a connection of wires or cables 16 (which are retained in the first connector 12 in a crimp-to-wire (CTW) configuration) through the first connector 12 and the second connector 14 to the PWB. Although two cables 16 are shown, the connector assembly 10 may connect any number of cables 16 to the PWB.

The first connector 12 comprises an inner housing 18 having a cable receiving portion 19, an outer housing 20 having a latch 22 slidably mounted in the inner housing 18, and an optional CPA 24 removably positioned between the inner housing 18 and the latch 22. When the first connector 12 is inserted into the second connector 14 and placed into a locked state using the CPA 24, as shown in FIG. 1, a lock tab 26 on the latch 22 is received in a cavity 28 in the second connector 14. Positioning the CPA 24 between the inner housing 18 and the latch 22 prevents disengagement of the latch 22 to release the second connector 14. More specifically, when the CPA 24 is positioned between the inner housing 18 and the latch 22, sliding movement of the latch 22 into the inner housing 18 is prevented. If the latch 22 is prevented from sliding into the inner housing 18, a surface of the lock tab 26 is maintained in engagement with a receiving surface 30 in the second connector 14. This engagement of the surface of the lock tab 26 with the receiving surface 30 prevents withdrawal of the first connector 12 from the second connector 14 in the direction of an arrow 32.

Figure 2:
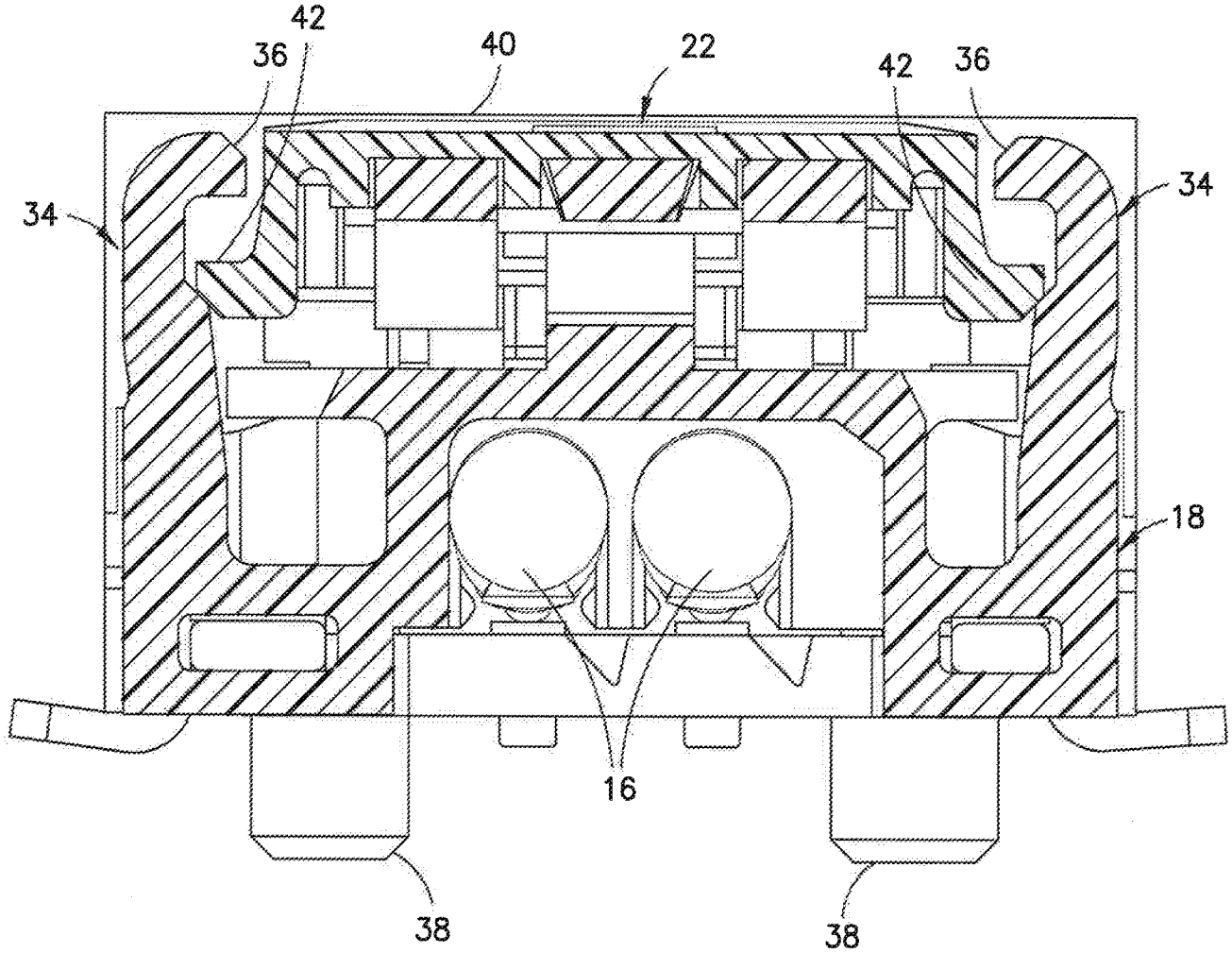
FIG. 2 is a front sectional view of the connector assembly of FIG. 1.

Referring to FIG. 2, the inner housing 18 also includes prongs 34 on opposing sides thereof, each of the prongs 34 extending from the cable receiving portion 19 and being flexible relative to the cable receiving portion 19, thereby allowing the prongs 34 to be flexed away from the inner housing 18. Hooked ends 36 of the prongs 34 are configured to curve inward.

Figure 3:
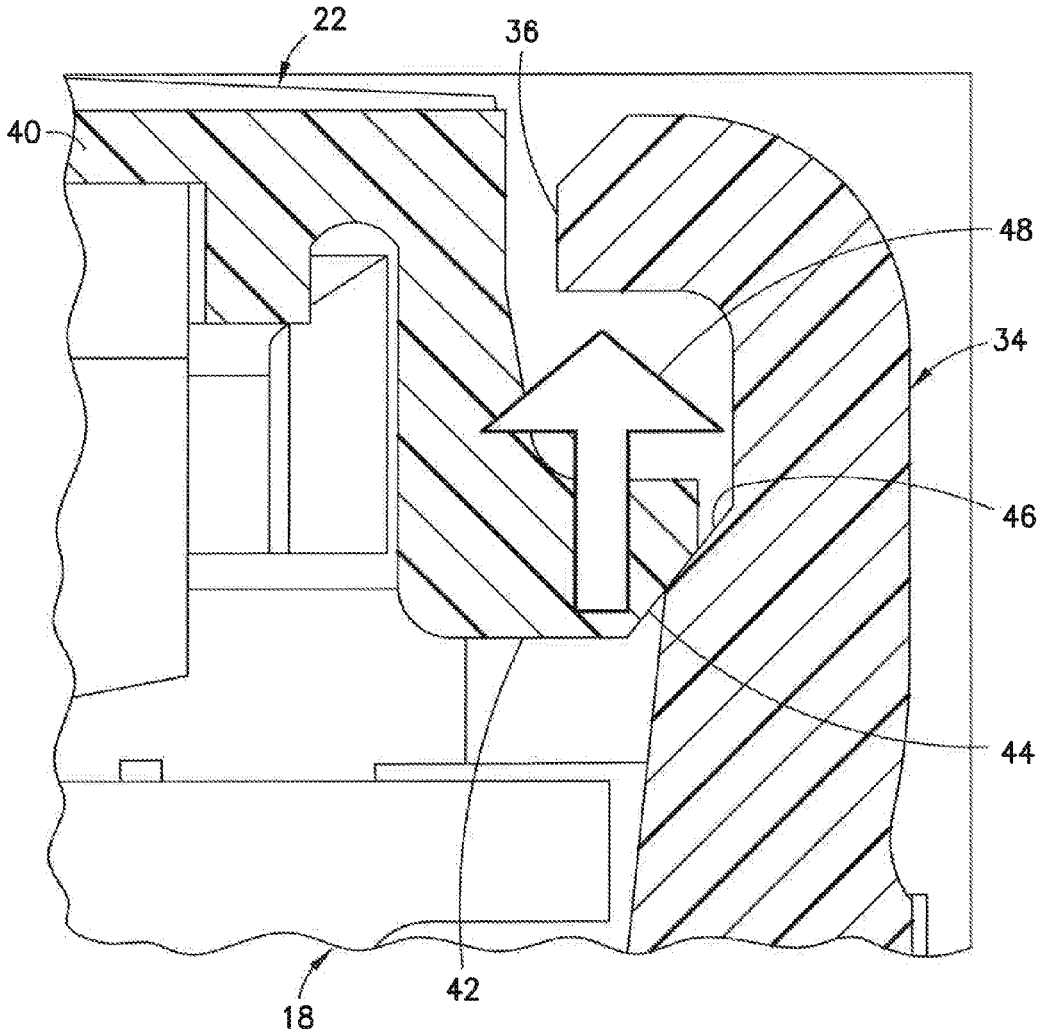
FIG. 3 is a front sectional view of an engagement of an inner housing with an outer housing of the connector assembly of FIG. 1.

Referring to both FIGS. 2 and 3, the latch 22 comprises a substantially planar member 40 having ears 42 on opposing sides thereof. As shown in FIG. 3, the ears 42 each have an angled surface 44 thereon facing in downward and outward directions, and the prongs 34 each have an angled surface 46 thereon facing in upward and inward directions. Even when no pressure is exerted on the latch 22 to slide the latch 22 in the direction of the inner housing 18, the angled surfaces 44 of the ears 42 and the angled surfaces 46 of the prongs 34 engage to cause interference therebetween. Because the prongs 34 are flexible in outward directions, the latch 22 is continuously biased upwards away from the inner housing 18 in a direction shown by an arrow 48 to maintain the latch in the locked state. Additionally, when the latch 22 is assembled with the inner housing 18, the latch 22 is prevented from being lifted out of the inner housing 18 due to engagement of the ears 42 with the hooked ends 36 of the prongs 34.

Figure 4:
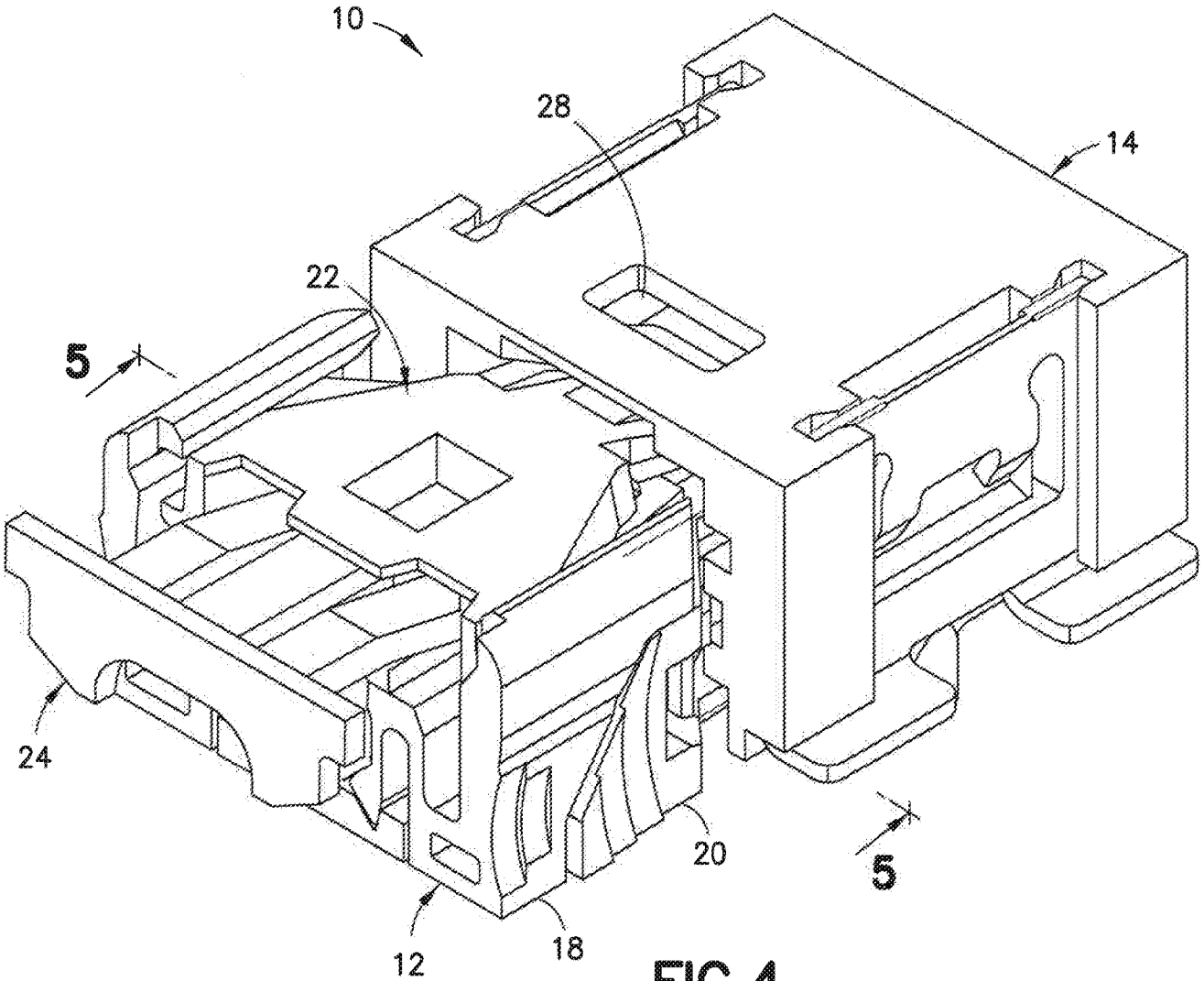
FIG. 4 is a perspective view of the connector assembly in an activation state.
Figure 5:
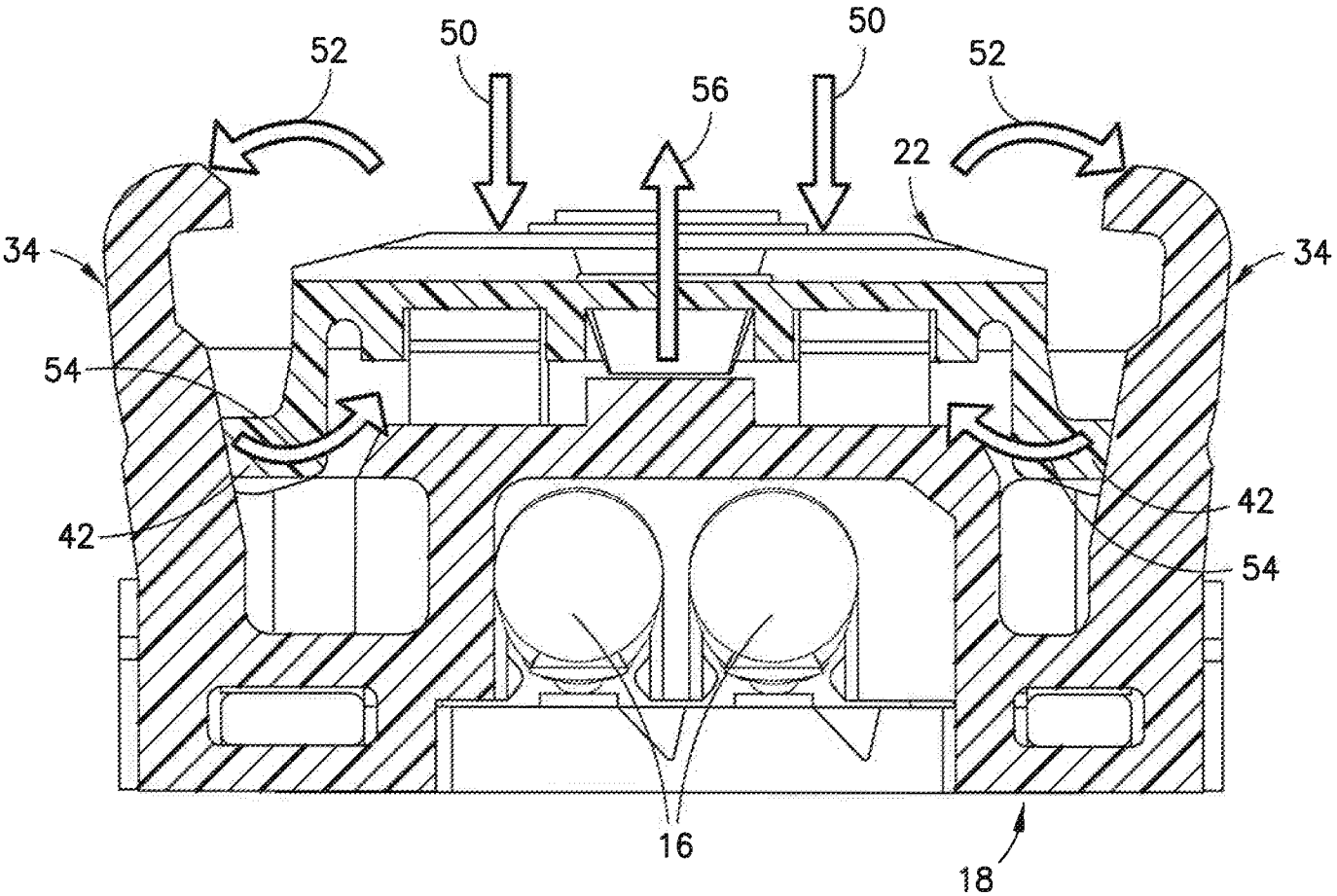
FIG. 5 is a front sectional view of the connector assembly of FIG. 4.

Referring to FIGS. 4 and 5, activation of the latch 22 is shown. In activating the latch 22 for insertion of the first connector 12 into the second connector 14 (or removal of the first connector 12 from the second connector 14), the CPA 24 (if present) is at least partially disengaged from the inner housing 18 and the latch 22. The at least partial disengagement of the CPA 24 from the inner housing 18 and the latch 22 allows the latch 22 to be slidably moved (depressed) into the inner housing 18, which (from the locked position) disengages the lock tab 26 from the cavity 28 in the second connector 14, thereby allowing a user to unlock the connector assembly 10 and withdraw the first connector 12 from the second connector 14.

As shown in FIG. 5, when the CPA 24 is at least partially disengaged from the inner housing 18 and the latch 22 is depressed in the direction of arrows 50, the latch 22 is driven into the inner housing 18 in the sliding movement. The ears 42 accordingly cause the prongs 34 to bow outwardly (indicated by arrows 52) while the prongs 34 cause the ears 42 to bow inwardly (indicated by arrows 54). Since the ears 42 and the prongs 34 naturally want to equilibrate to unbowed positions, a support force is generated to bias the latch 22 in the direction of an arrow 56 into the locked state.

Figure 6:
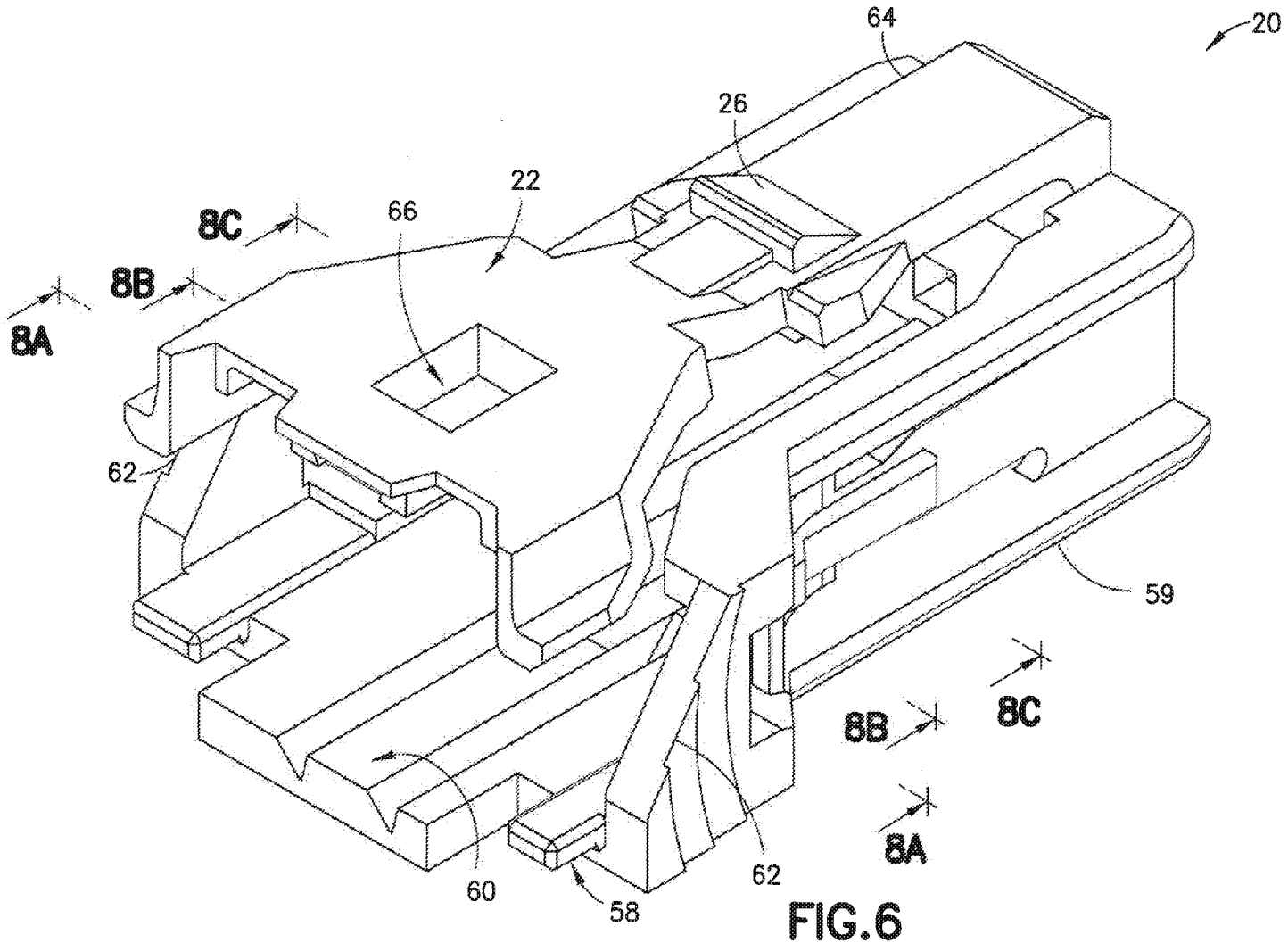
FIG. 6 is a perspective view of an outer housing of the connector assembly.
Figure 7:
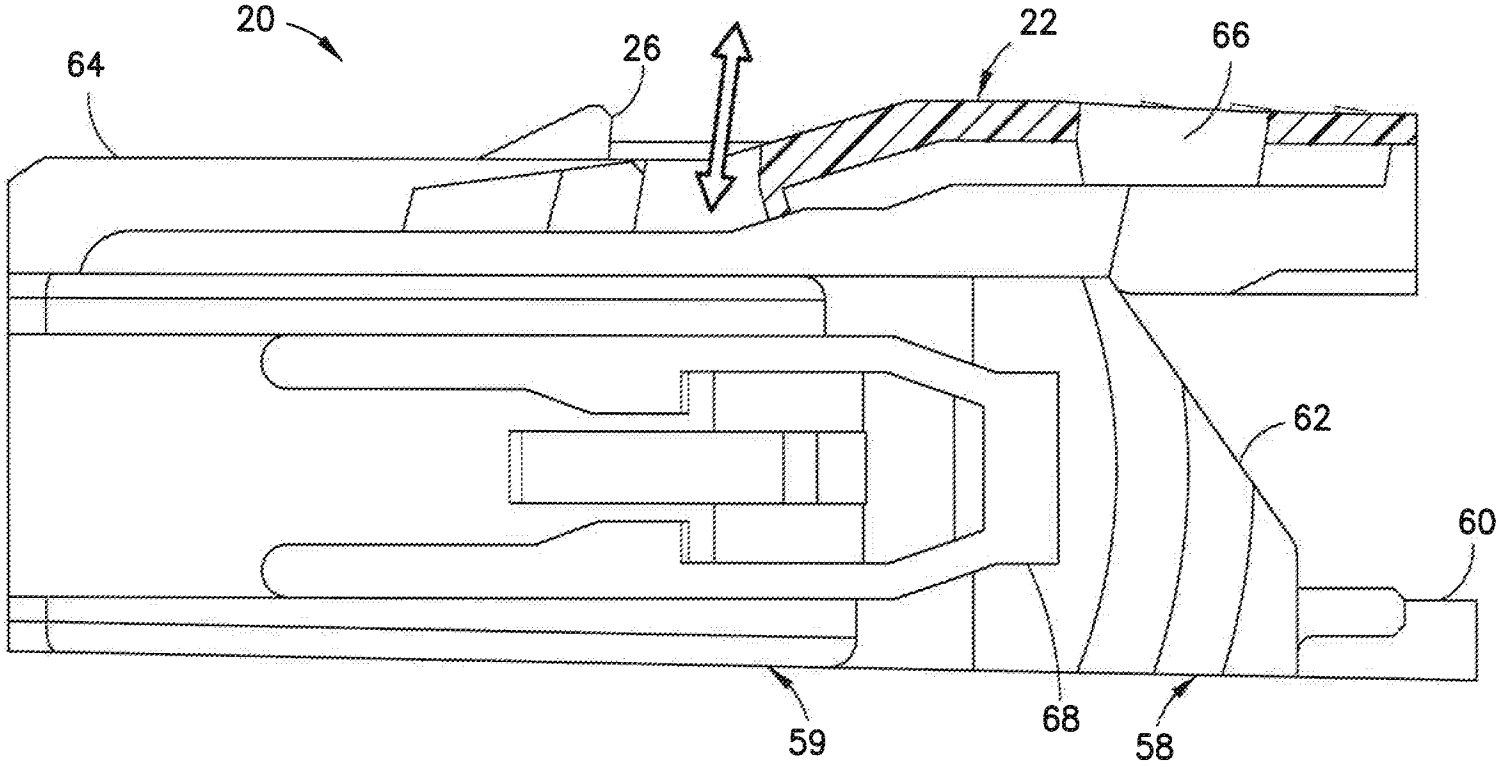
FIG. 7 is a side sectional view of the outer housing of FIG. 6.

Referring now to FIGS. 6 and 7, the outer housing 20 comprises an elongated portion having a cable receiving end 58 and a second connector insertion end 59. The cable receiving end 58 is defined by a bottom surface 60 and opposing side walls 62 between which the inner housing 18 is mounted. The latch 22 is supported by an arm 64 flexibly extending from the second connector insertion end 59 and is positioned over the elongated portion of the cable receiving end 58. The latch 22 includes the lock tab 26 and a slot 66 formed therein to guide the CPA 24. The slot 66 is located substantially in the middle of the latch 22. As shown in FIG. 7, outer fingers 68 are flexibly located on outer surfaces of the opposing side walls of the cable receiving end 58. The outer fingers 68 include through holes or recesses for receiving corresponding features on the inner housing 18.

Figure 8A:
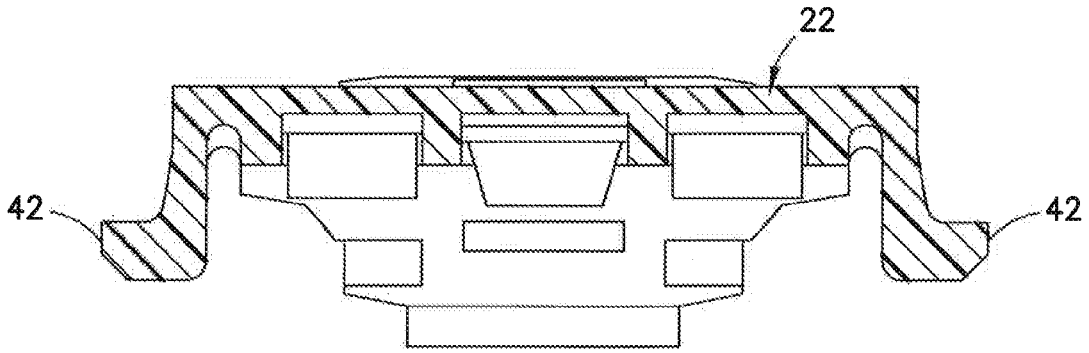
FIGS. 8A through 8C are front sectional views of a latch of the outer housing of FIG. 6.
Figure 8B:
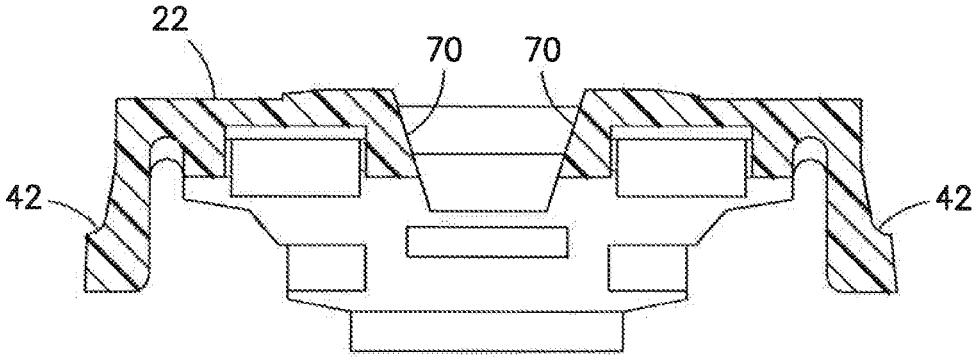
Figure 8C:
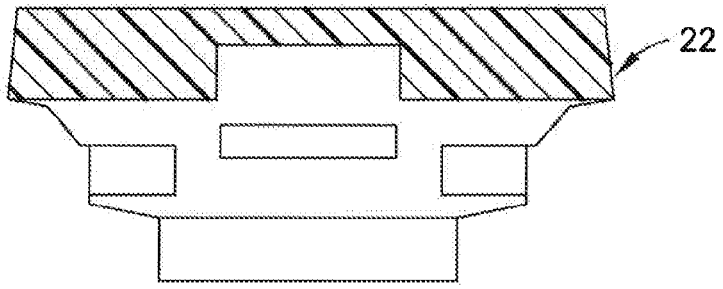

Referring to FIGS. 8A through 8C, a cross section of the outer housing 20 along the line 8A-8A of FIG. 6 illustrates that the cable receiving end 58 is substantially rectangular to support the CPA 24 from above, a cross section along the line 8B-8B of FIG. 6 illustrates that the slot 66 is defined by surfaces 70 that are angled downward and inward to support a central portion of the CPA 24 from below, and a cross section along the line 8C-8C of FIG. 6 illustrates that the second connector insertion end 59 is configured to support the central portion of the CPA 24 from above.

Figure 9A:
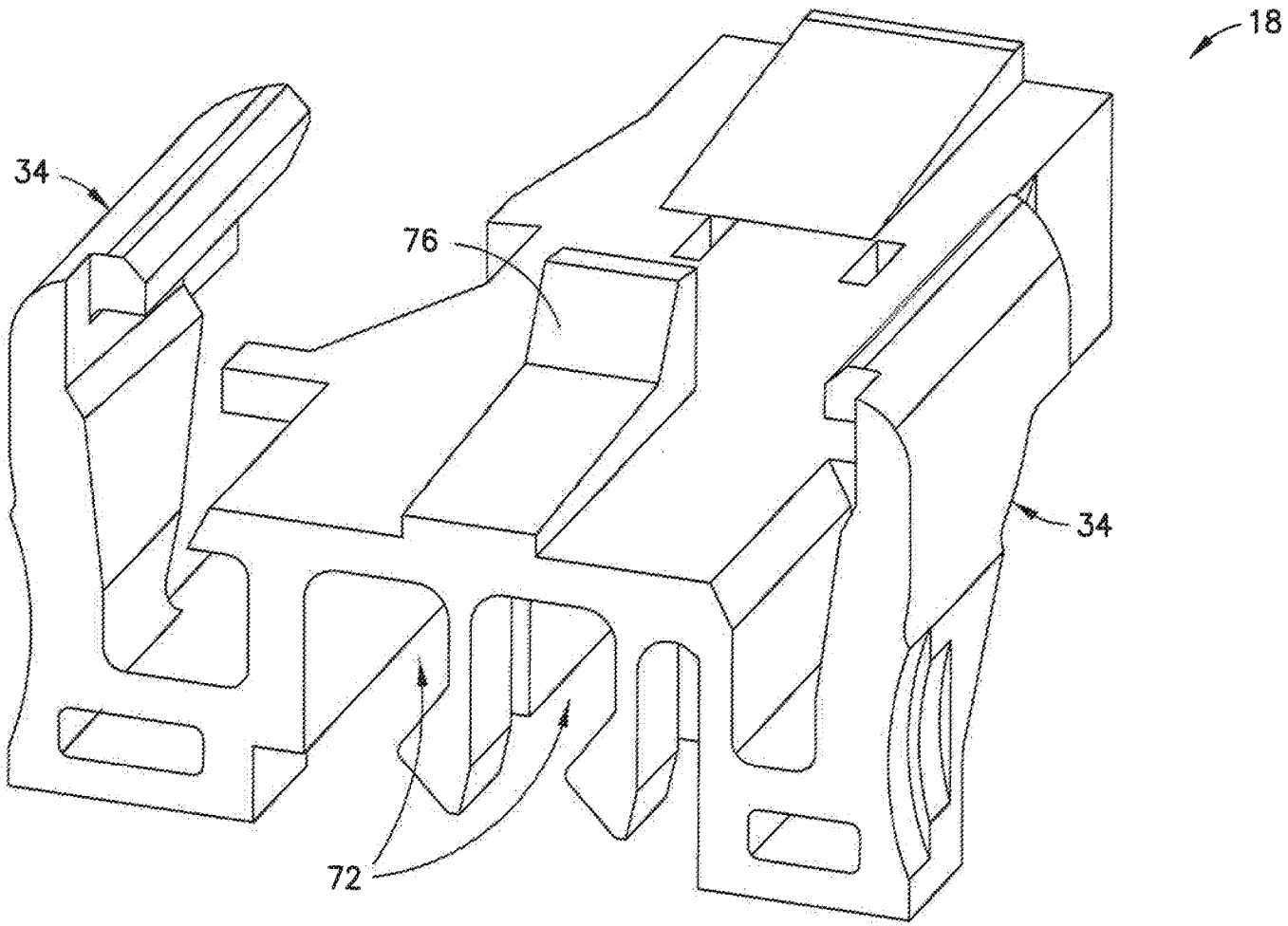
FIG. 9A is a top front perspective view of an inner housing of the connector assembly.
Figure 9B:
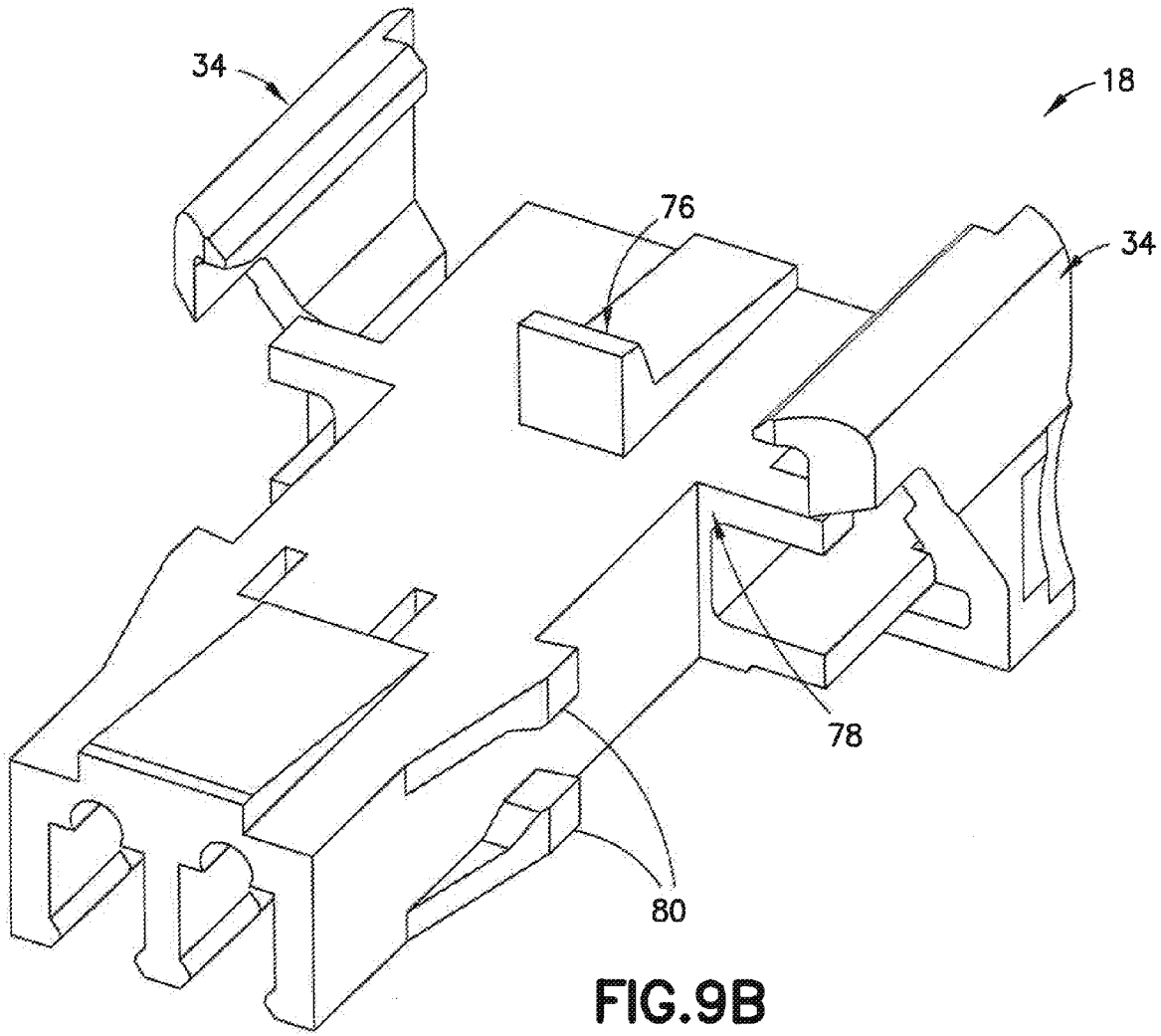
FIG. 9B is a top rear perspective view of the inner housing of the connector assembly.

Referring to FIGS. 9A and 9B, the inner housing 18 comprises cable openings 72 in which the cables 16 are received. The prongs 34 include ramped surfaces 74 along which the ears 42 slide to assist in the generation of the support force that biases the latch 22 into the locked state. A stopper 76 is formed on an upper surface of the inner housing 18 to receive the CPA 24 during assembly and disassembly of the first connector 12 from the second connector 14. As shown in FIG. 9B, material 78 may be added to portions of the inner housing 18 to strengthen features of the inner housing 18 that facilitate alignment of the inner housing 18 within the outer housing 20. Tabs 80 are located on opposing sides of outer side surfaces of the inner housing 18 to be received by the through holes or recesses of the outer fingers 68 on the outer housing 20.

Figure 10A:
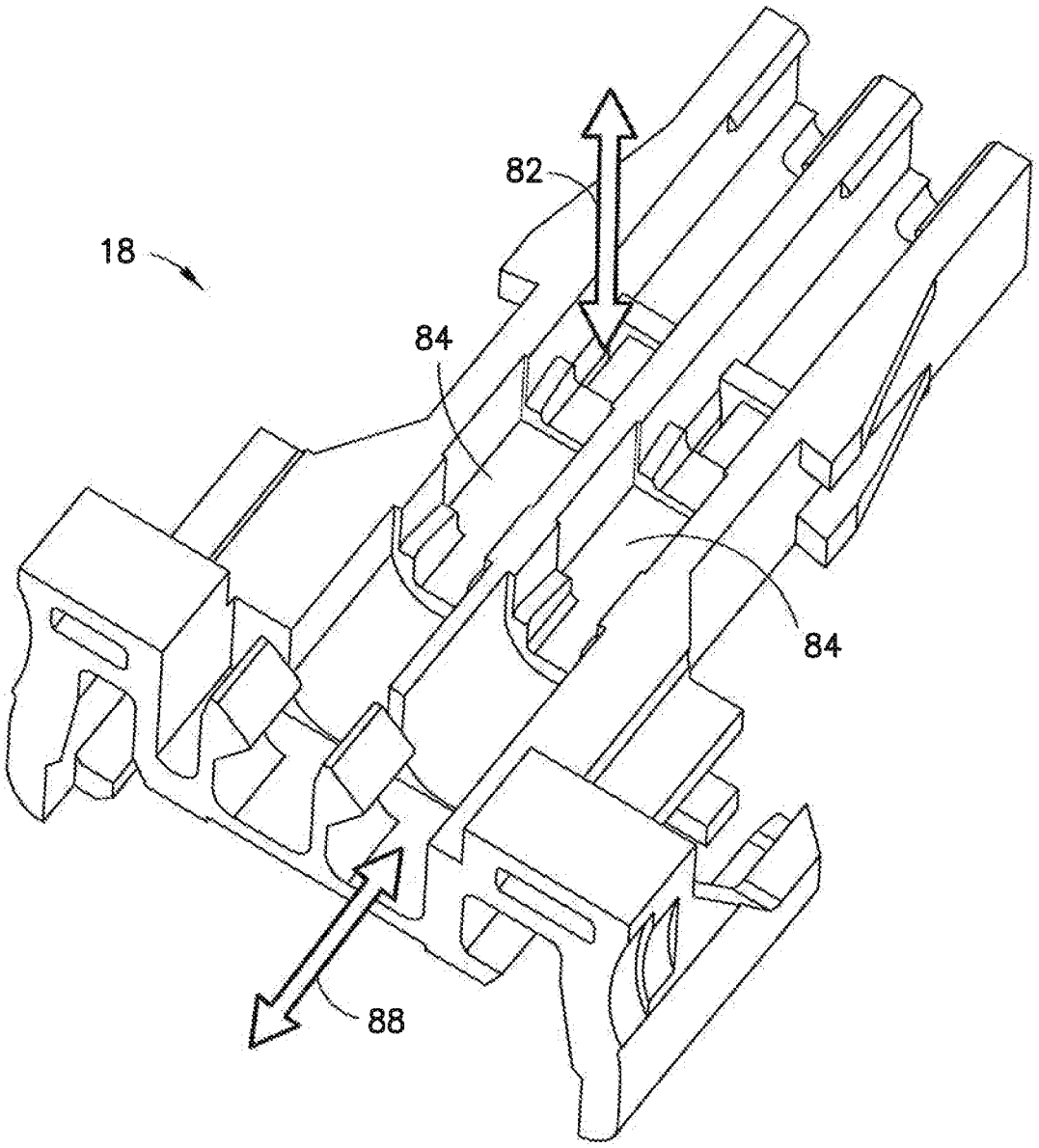
FIG. 10A is a bottom front perspective view of the inner housing of the connector assembly.
Figure 10B:
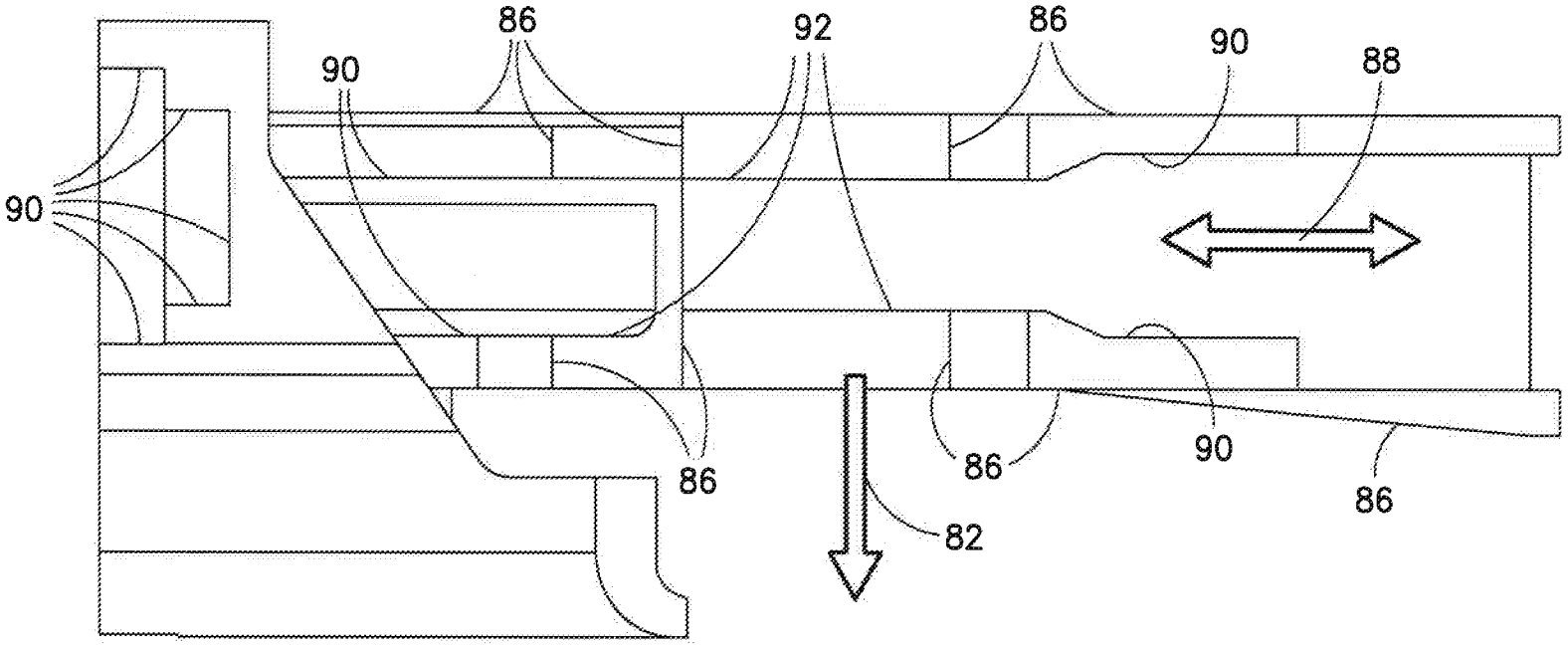
FIG. 10B is a side sectional view of the inner housing of the connector assembly.

Referring to FIGS. 10A and 10B, in one exemplary method of forming the inner housing 18, an arrow 82 indicates directions in which tooling is directed to form cavities 84 in which the cables 16 are received, cable clamp features, and surfaces 86. An arrow 88 indicates directions in which tooling is directed to open/close a mold that creates the cable clamp features, alignment features, hooks, and the prongs 34 (surfaces 90). Surfaces 92 illustrate where the tooling indicated by the arrow 82 and the arrow 88 merge.

Figure 11A:
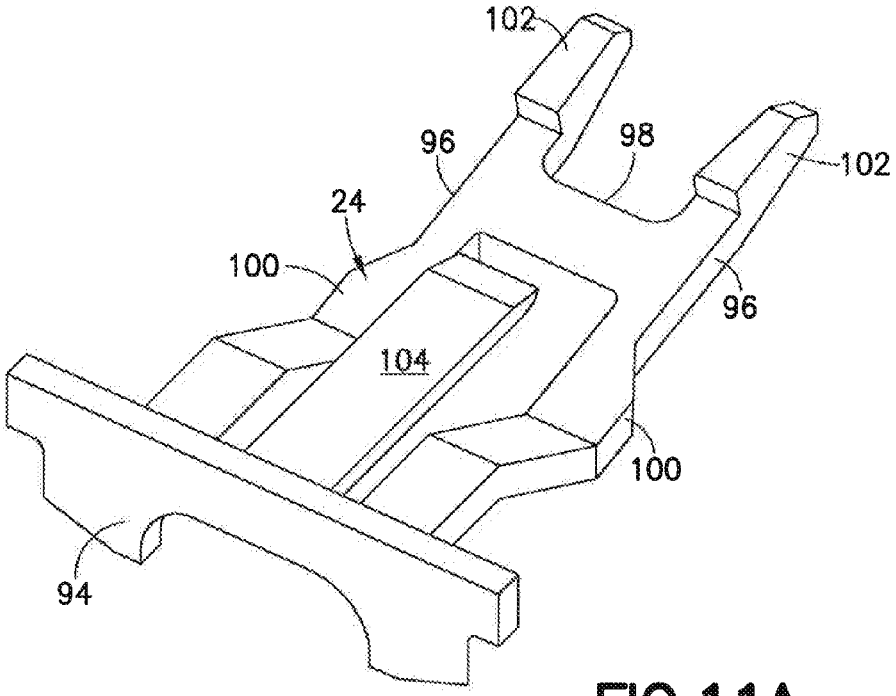
FIG. 11A is a perspective view of one exemplary embodiment of a CPA of the connector assembly.
Figure 11B:
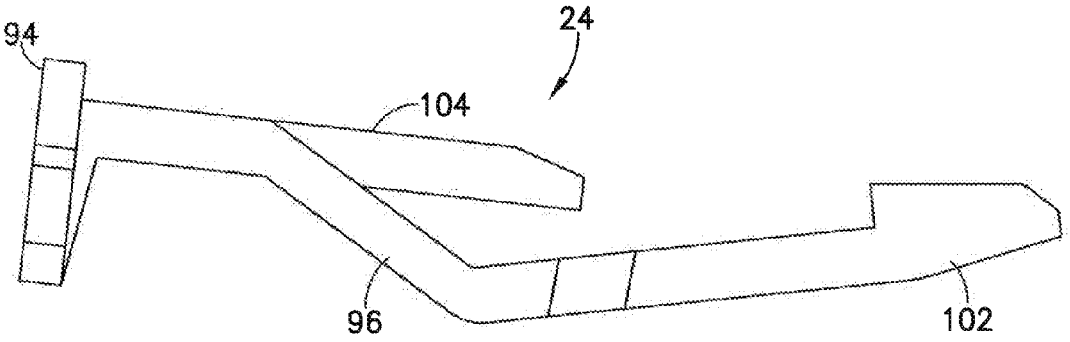
FIG. 11B is a side elevational view of the CPA of FIG. 11A.

Referring to FIGS. 11A and 11B, in one exemplary embodiment the CPA 24 is preferably a one-piece member comprised of molded polymer or plastic. In other embodiments, however, the CPA 24 may be defined by individually-assembled members and/or different materials. The CPA 24 comprises a finger contact member or contact member 94 having two side arms 96 extending therefrom, the side arms 96 being connected distal from the finger contact member 94 by a cross beam 98. The side arms 96 may be wider in central portions 100 than at the ends in order to provide rigidity to the CPA 24 in the stressed region. The ends of the side arms 96 opposite the finger contact member 94 may include hooked portions 102. A center arm 104 also extends from the finger contact member 94 between the side arms 96 and terminates short of the cross beam 98. As shown in FIG. 11B, the side arms 96 are angled relative to the center arm 104 to form an angle a of about 10 degrees to about 14 degrees plus or minus three degrees, preferably about 12 degrees. The CPA 24 is made compact by minimizing the angle a.

Figure 12A:
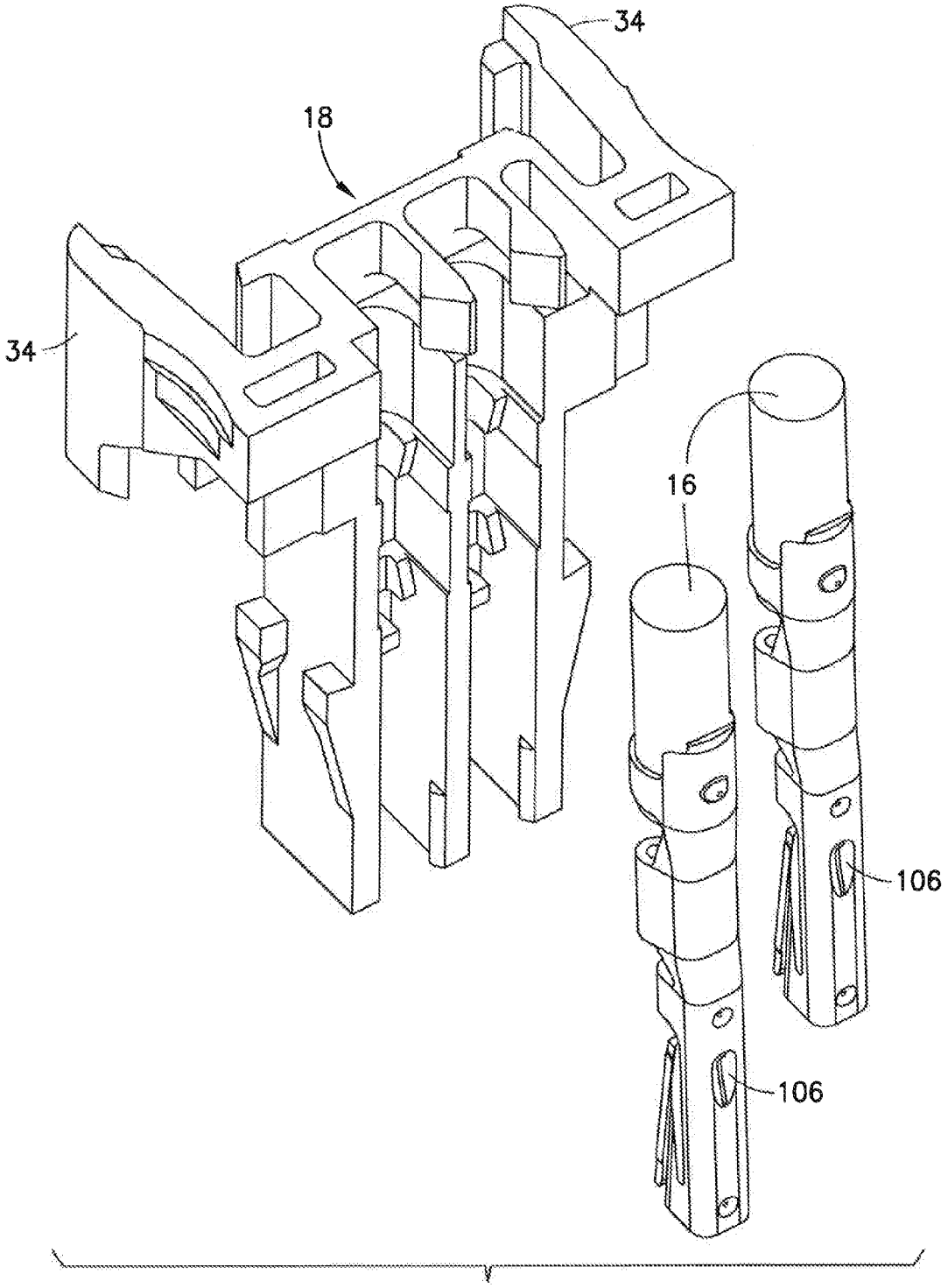
FIG. 12A is a perspective view of a process flow of CTW contact loading.
Figure 12B:
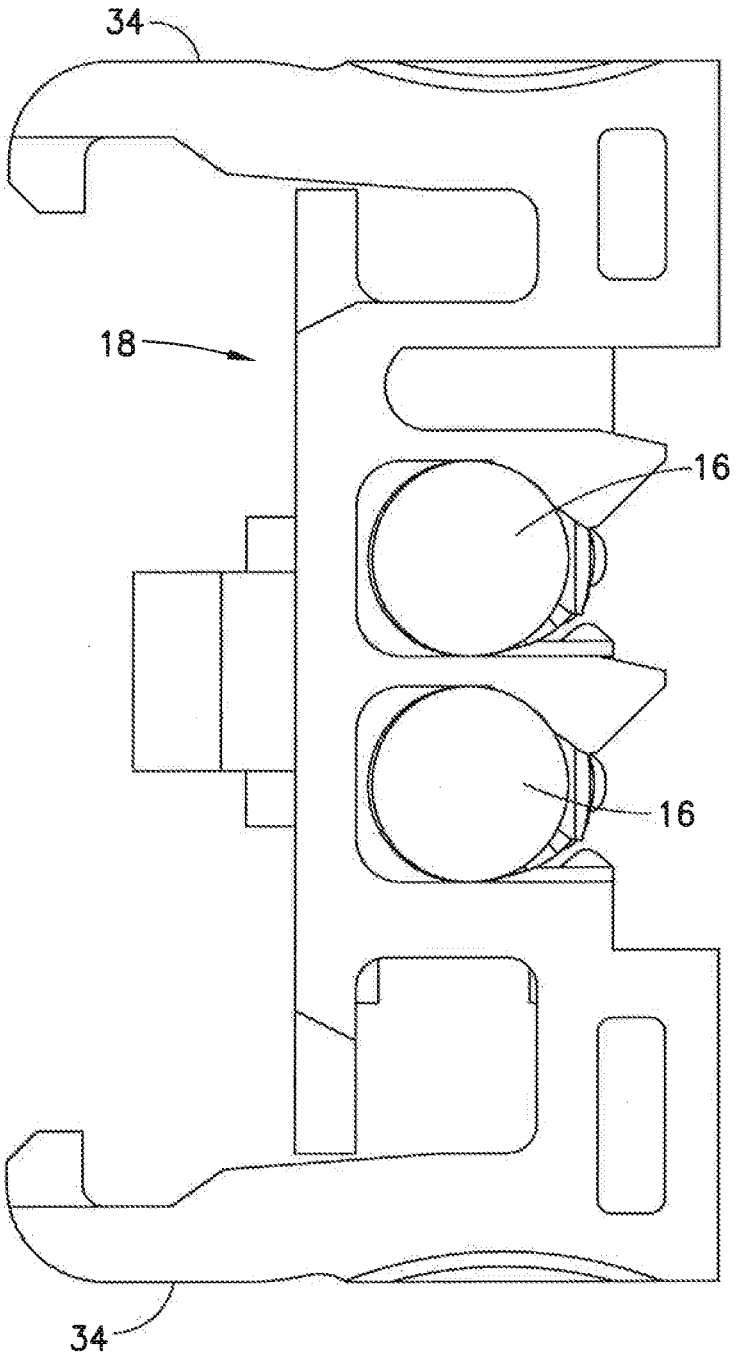
FIG. 12B is a front sectional view of the CTW contact loading of FIG. 12A.
Figure 12D:
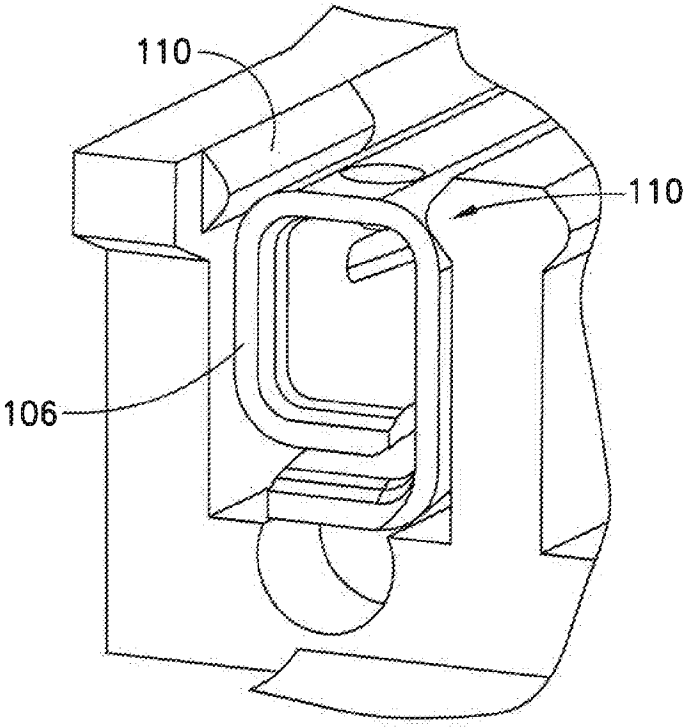
FIG. 12D is a rear perspective view of a terminal contact in the inner housing.
Figure 12C:
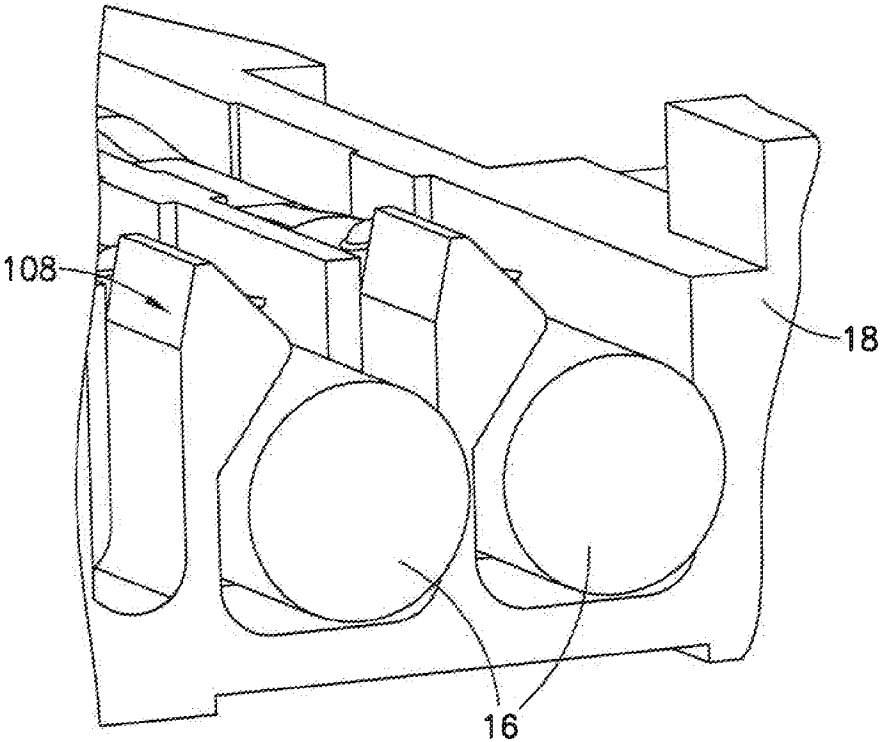
FIG. 12C is a front perspective view of cables in the inner housing.

Referring to FIGS. 12A through 12D, one exemplary embodiment of a process flow directed to CTW contact loading is shown. FIGS. 12A and 12B show the cables 16 in the CTW configuration loaded into the inner housing 18. Terminal contacts 106 are crimped to the cables 16 to form crimped connections, and the terminal contacts 106 are mounted into the cable openings 72 such that the front portions as well as the rear portions of the terminal contacts 106 are retained in the inner housing 18. As shown in FIG. 12C, the cables 16 are retained in the inner housing 18 via hooked members 108 formed on the inner housing 18. As shown in FIG. 12D, the terminal contacts 106 are retained in the cable openings 72 of the inner housing 18 via lips 110 formed along at least portions of surfaces of the cable openings 72.

Figure 13A:
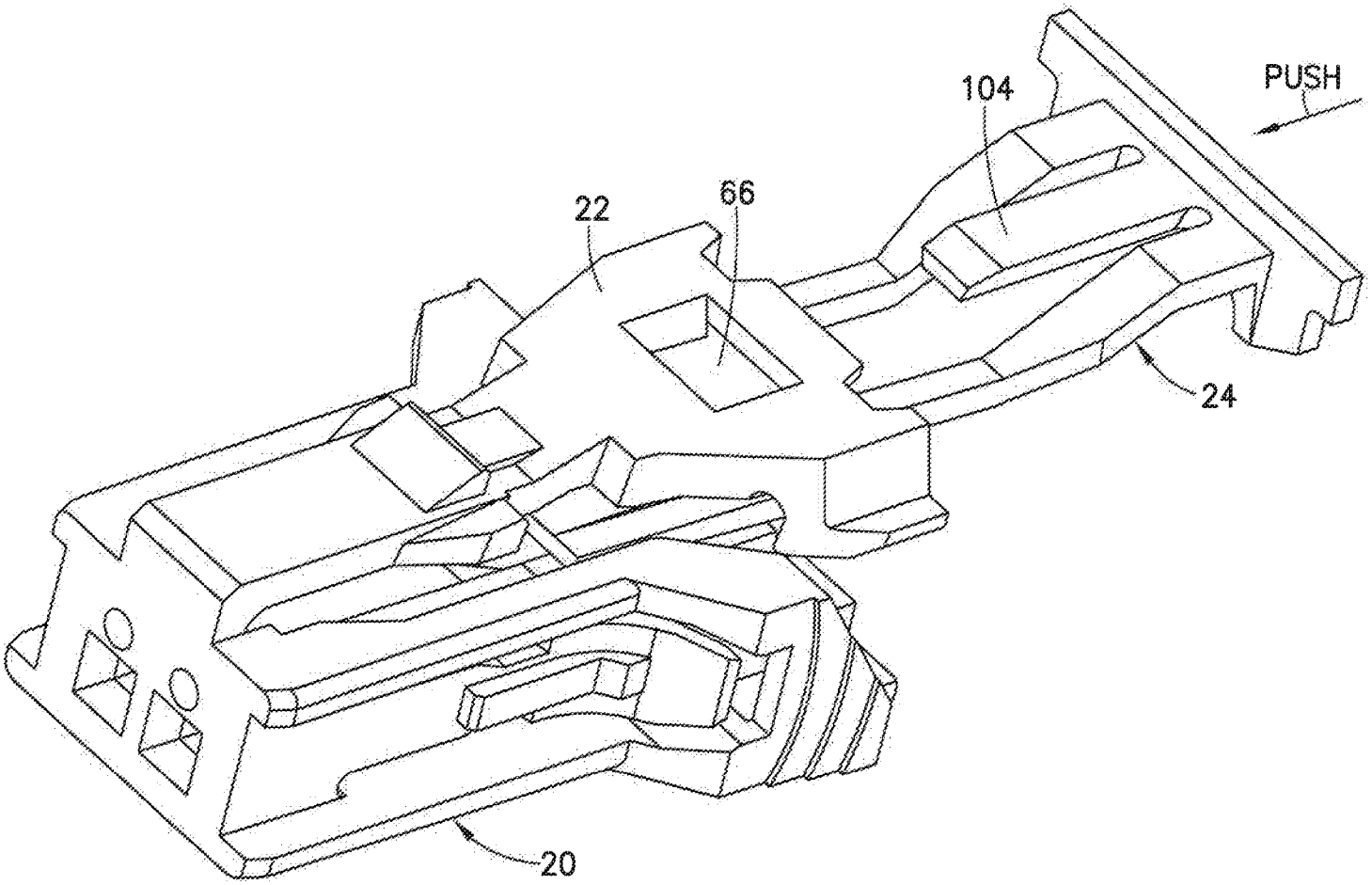
FIG. 13A is a perspective view of a process flow of the CPA insertion into the outer housing.
Figure 13B:
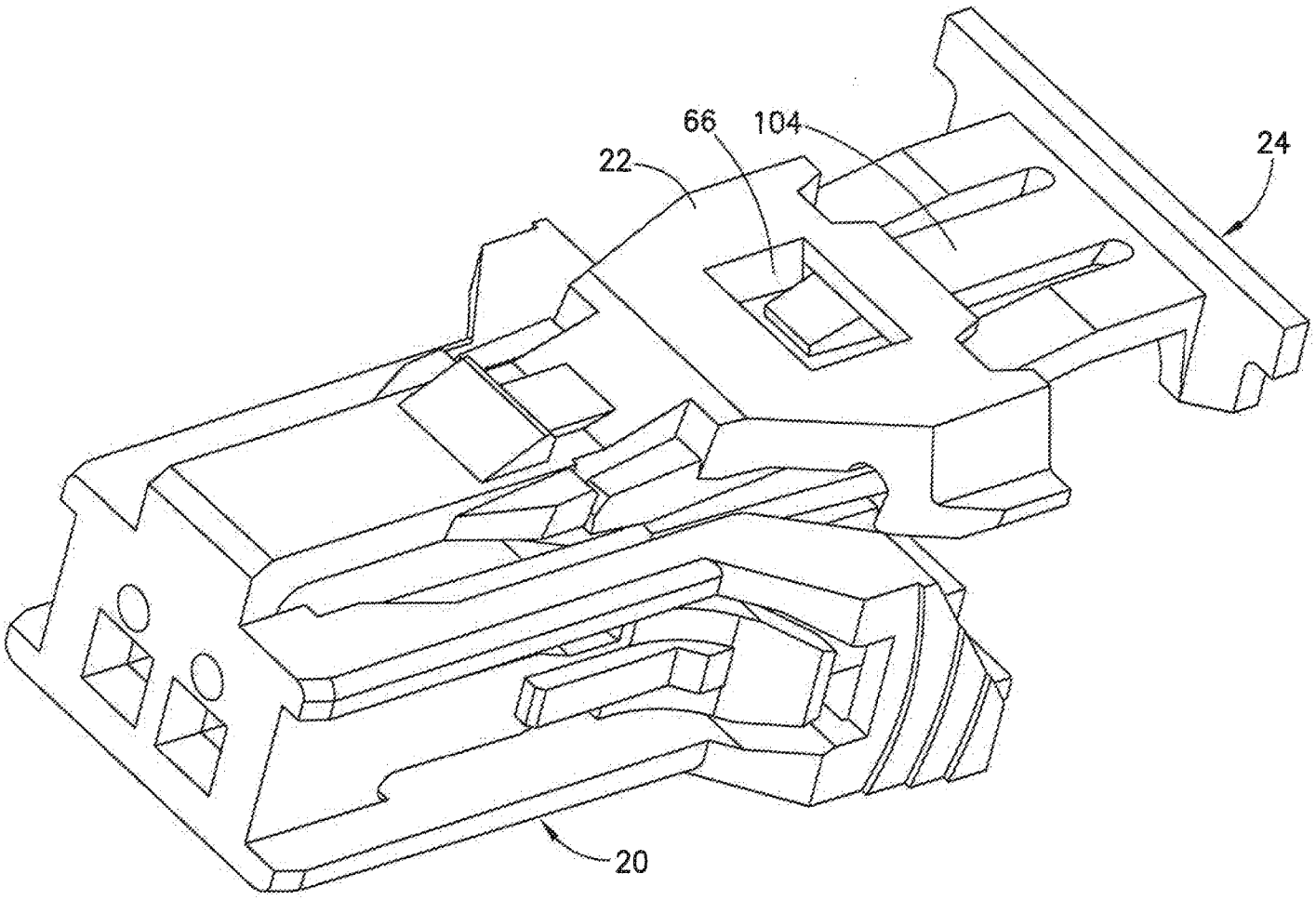
FIG. 13B is a perspective view of a pre-assembly of the CPA in the outer housing.
Figure 13C:
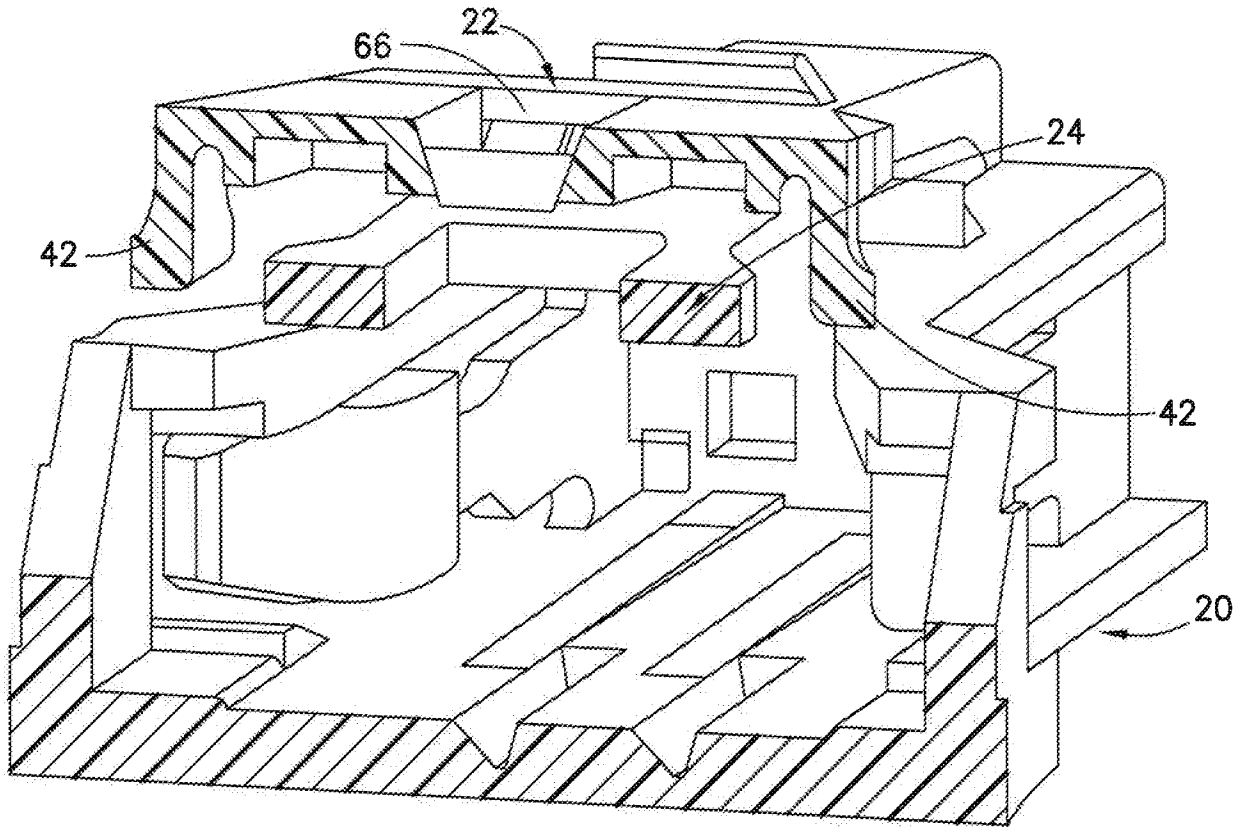
FIG. 13C is a perspective sectional view of the CPA in the outer housing.
Figure 14A:
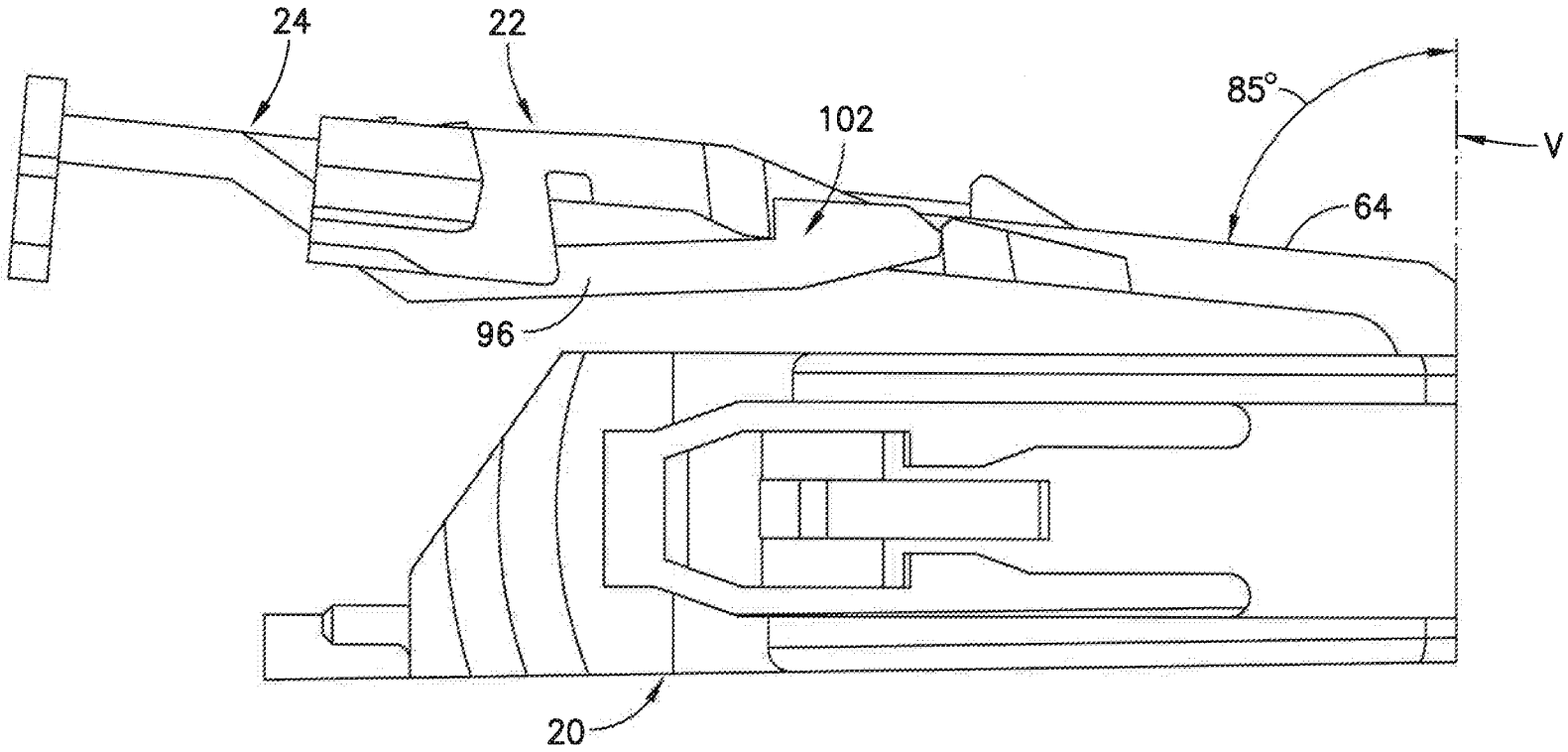
FIGS. 14A and 14B are side sectional views of the pre-assembly of the CPA in the outer housing.
Figure 14B:
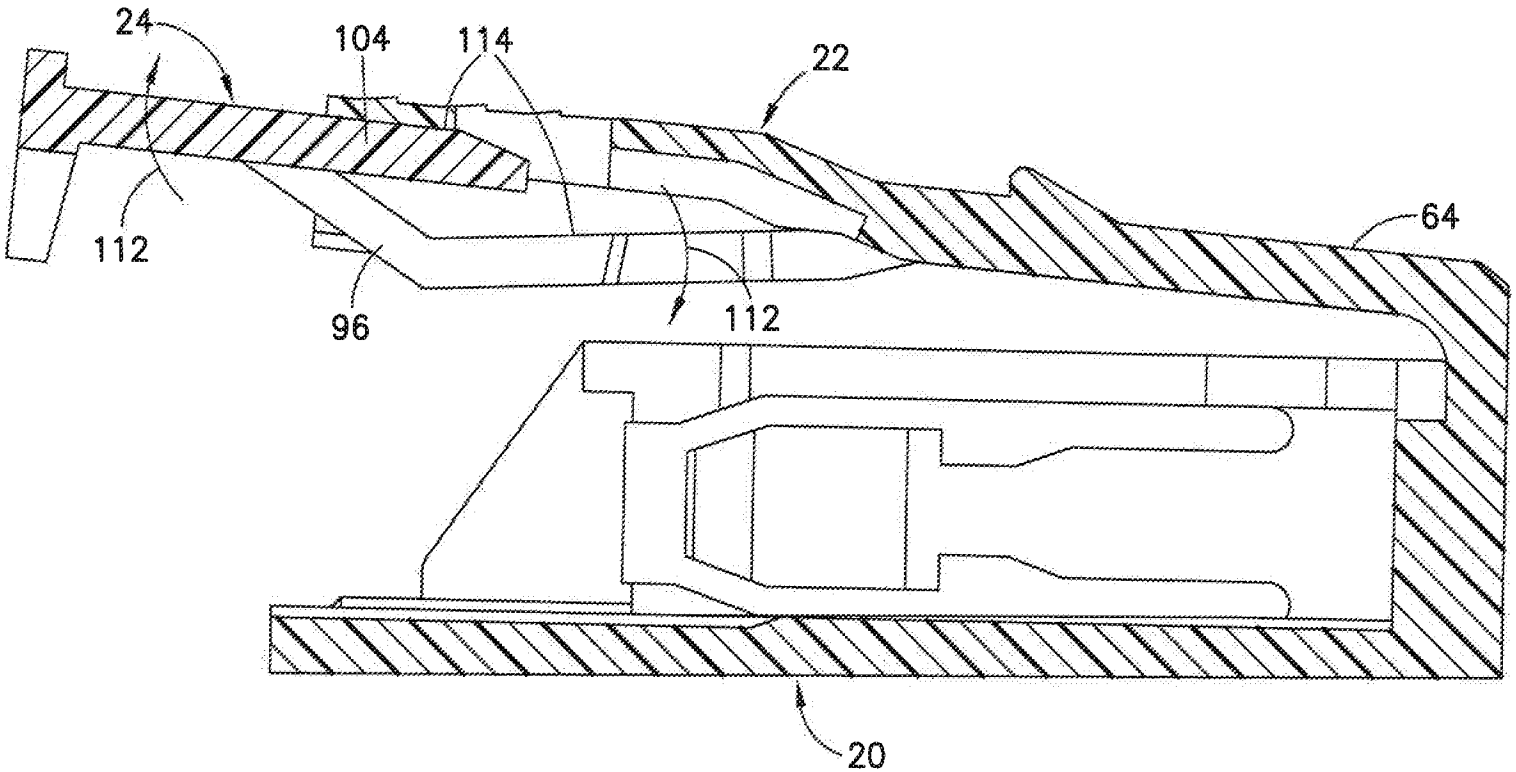

Referring to FIGS. 13A through 14B, one exemplary embodiment of pre-assembling the CPA 24 into the outer housing 20 is shown. In FIG. 13A, the CPA 24 is mounted onto the outer housing 20 under the latch 22. As shown in FIG. 13B, the center arm 104 is accessible through the slot 66 in the latch 22. As shown in FIG. 13C, the CPA 24 (without the finger contact member 94) is shown hooked onto the latch 22. In FIG. 14A, the CPA 24 is shown locked into the latch 22 via the hooked portions 102. In FIG. 14B, the center arm 104 is urged upward against an underside of the latch 22. When pre-assembled, the center arm 104 is bent relative to the side arms 96, and the angle a of the CPA 24 is thereby reduced from about 12 degrees to about 7.5 degrees. In order to remove the CPA 24 (to put the CPA 24 into a stress-free condition), the CPA 24 may be rotated in the directions of arrows 112, thereby increasing the angle a. However, surfaces 114 in the latch 22 will cause the CPA 24 to remain in place in the outer housing 20. The arm 64 is offset from a vertical axis V through the outer housing 20 by about 85 degrees.

Figure 15A:
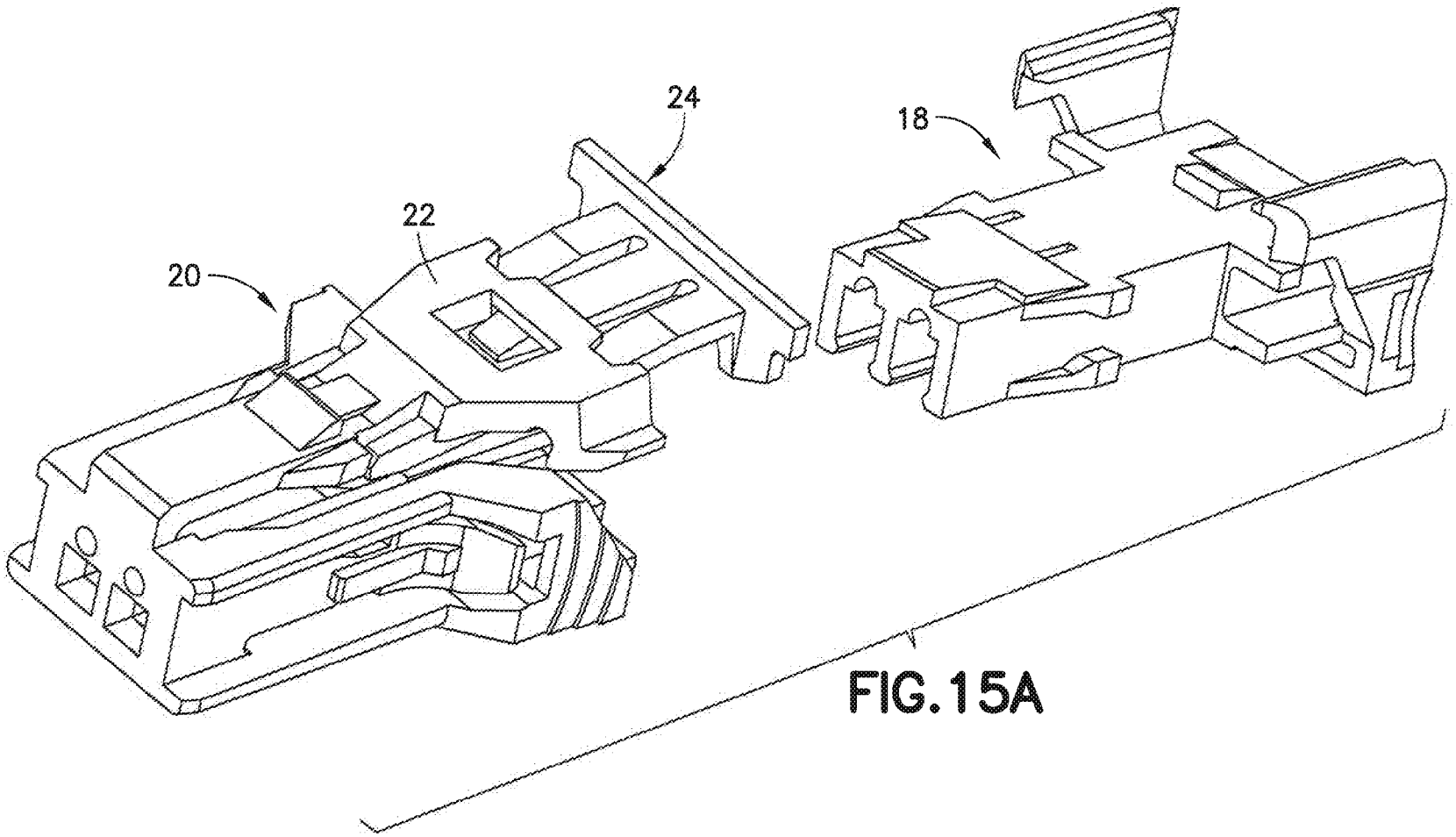
FIG. 15A is a perspective view of a process flow of insertion of the inner housing into the pre-assembly of the CPA in the outer housing.
Figure 15B:
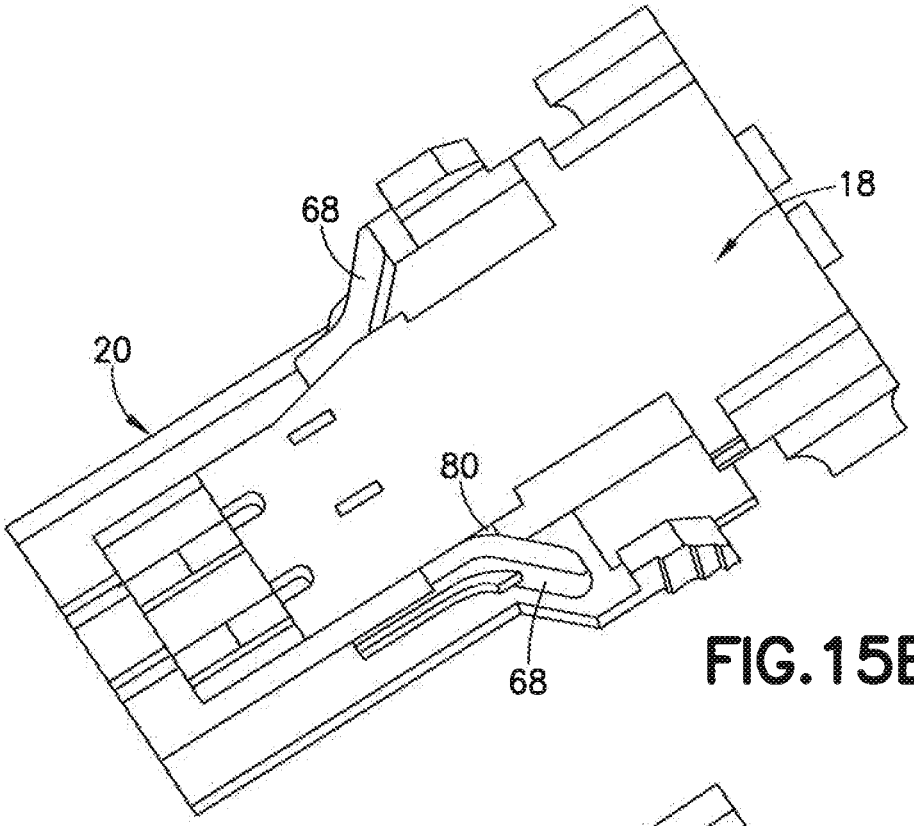
FIG. 15B is a bottom perspective view of the process flow of FIG. 15A showing flexing of outer fingers on the outer housing.
Figure 15C:
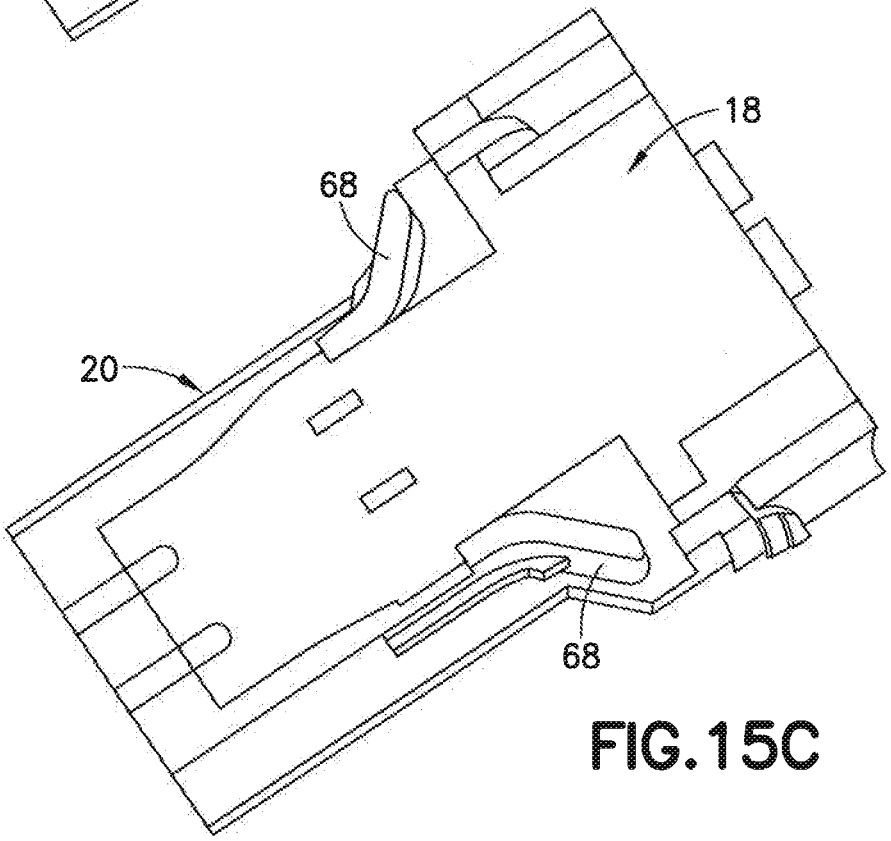
FIG. 15C is a bottom perspective view of the assembled inner housing and pre-assembly of the CPA and outer housing.

Referring to FIGS. 15A to 15C, the inner housing 18 is inserted into the pre-assembly of the CPA 24 and the outer housing 20. As shown in FIG. 15A, the latch 22 is slightly activated (depressed) before inserting the inner housing 18 into the outer housing 20. As such, the latch 22 is pre-loaded to generate additional connector locking force. As shown in FIG. 15B, as the inner housing 18 is inserted, the flexible outer fingers 68 on the outer housing 20 are urged outward over the tabs 80 on the inner housing 18. As shown in FIG. 15C, as the inner housing 38 is fully inserted, an audible click noise may be heard due to the outer fingers 68 fully receiving the tabs 80 on the outer sides of the inner housing 18.

Figure 16A:
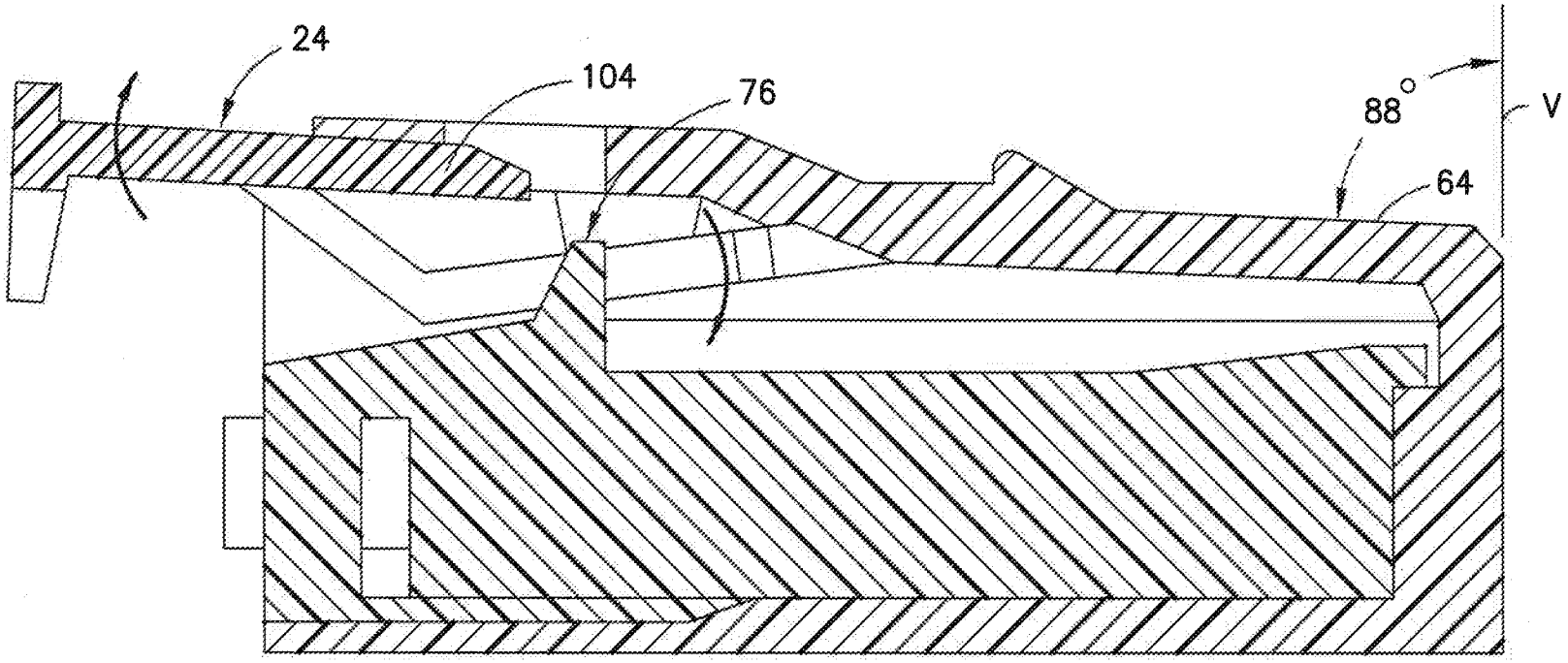
FIGS. 16A and 16B are side sectional views of the assembled inner housing and pre-assembly of the CPA and outer housing in a locked state.
Figure 16B:
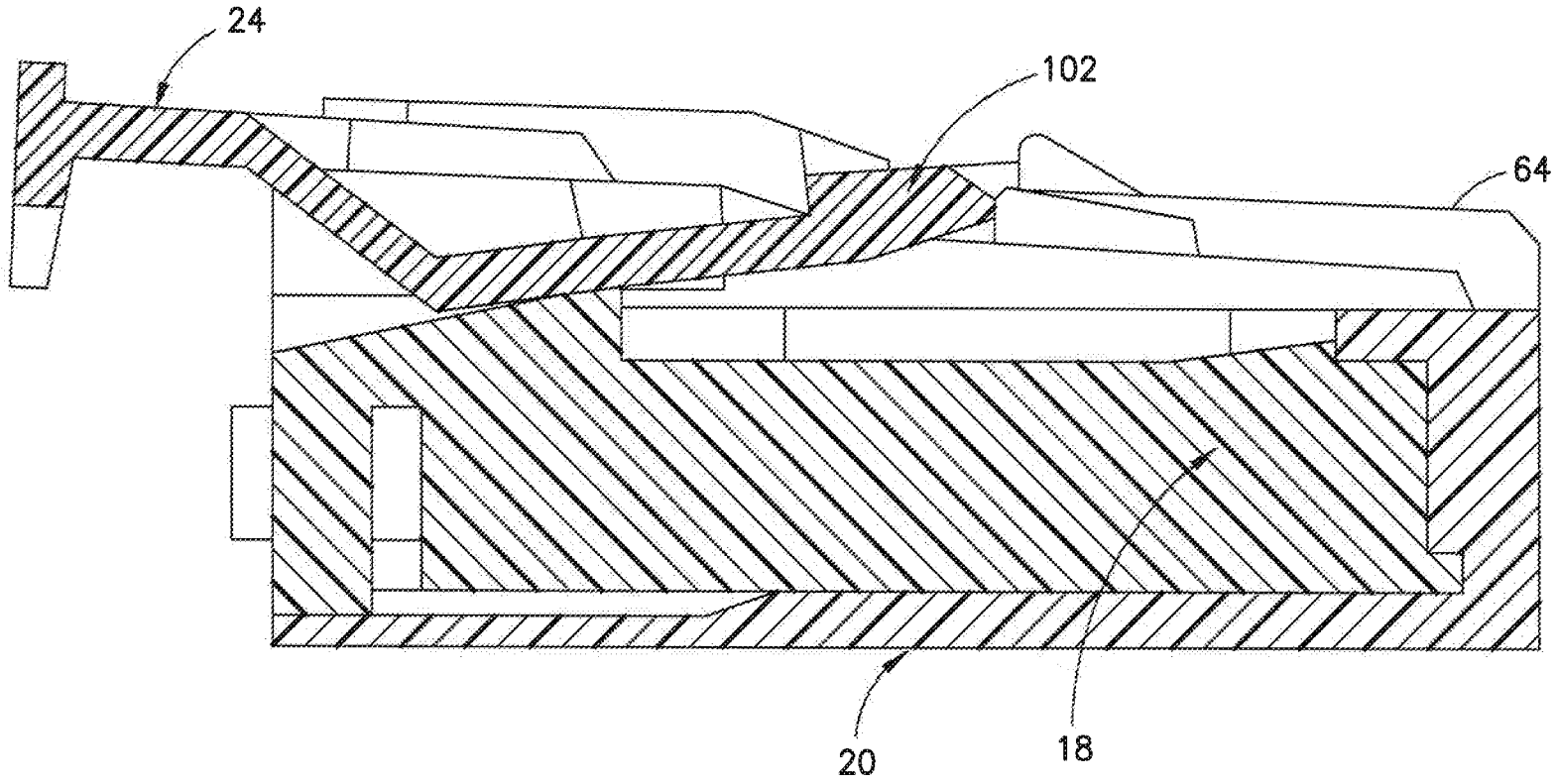

Referring now to FIGS. 16A and 16B, the CPA 24 is locked in the outer housing 20 with the inner housing 18.

The CPA 24 is retained by the hooked portions 102 and the stopper 76. The arm 64 is offset from the vertical axis V by about 88 degrees.

Figure 17A:
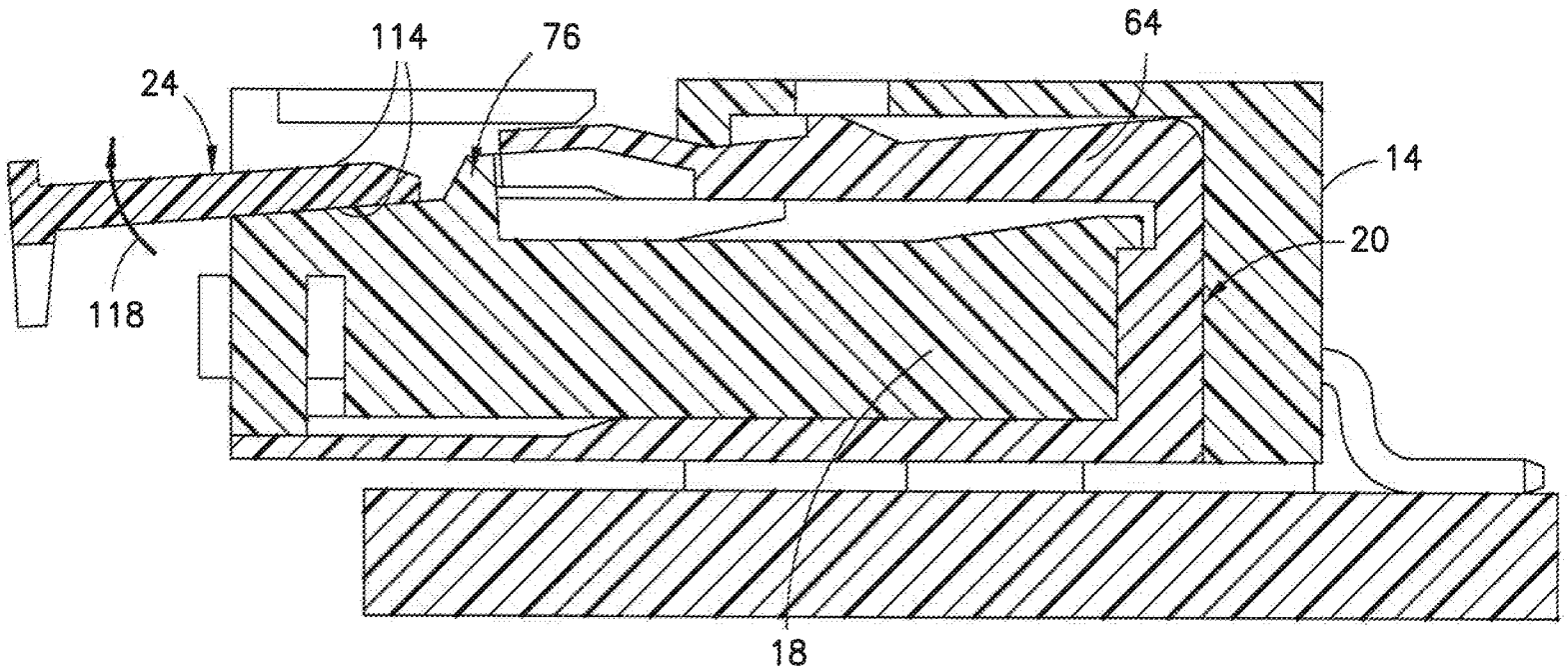
FIGS. 17A and 17B are side sectional views of the assembled inner housing and pre-assembly of the CPA and outer housing in a locked state with activation of the latch.
Figure 17B:
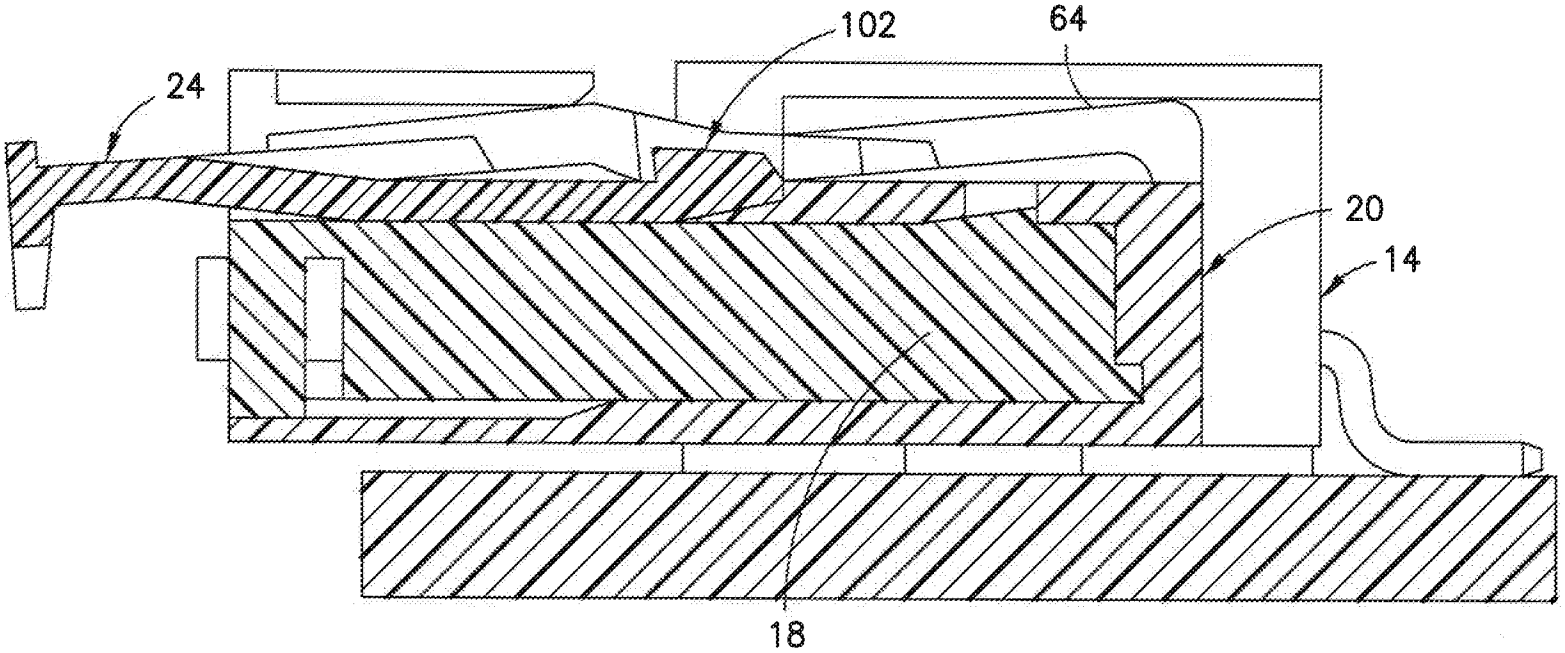

Referring now to FIGS. 17A and 17B, the CPA 24 is retained between the inner housing 18 and the outer housing 20 by the hooked portions 102 and the stopper 76. The CPA 24 tends to rotate in the direction indicated by the arrow 118. However, such rotation is prevented due to the CPA 24 being trapped between the surfaces 114 of the latch 22 and the inner housing 18. As shown in FIG. 17A, the CPA 24 is retained by engagement with the stopper 76 on the inner housing 18. As shown in FIG. 17B, the CPA 24 is also retained by engagement of the hooked portions 102 with the underside of the latch 22.

Figure 18A:
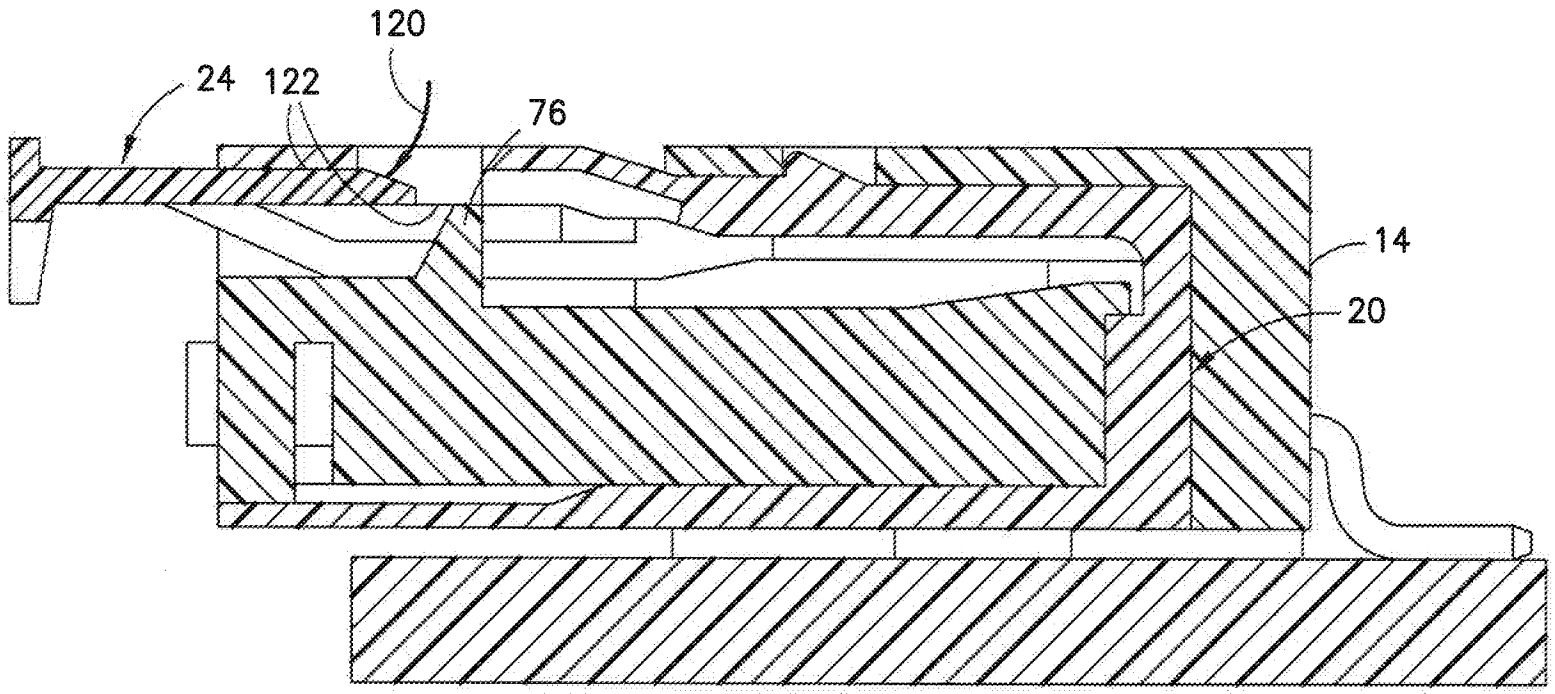
FIGS. 18A and 18B are side sectional views of the assembled inner housing and pre-assembly of the CPA and outer housing in a locked state and not secured.
Figure 18B:
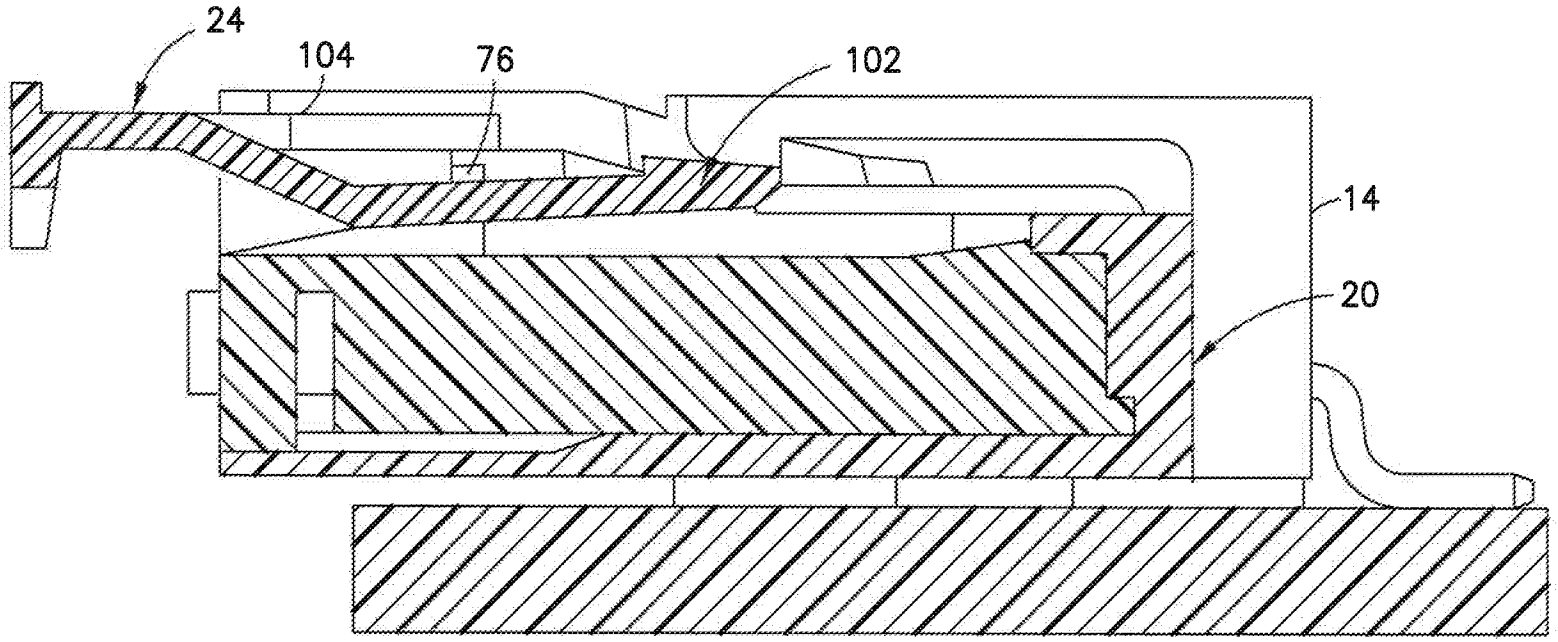

Referring now to FIGS. 18A and 18B, the CPA 24 (still retained by the hooked portions 102 and the stopper 76) is further prevented from rotation in the direction indicated by the arrow 120 due to engagement of surfaces 122 of the center arm 104 with the latch 22 (FIG. 18A).

Figure 19A:
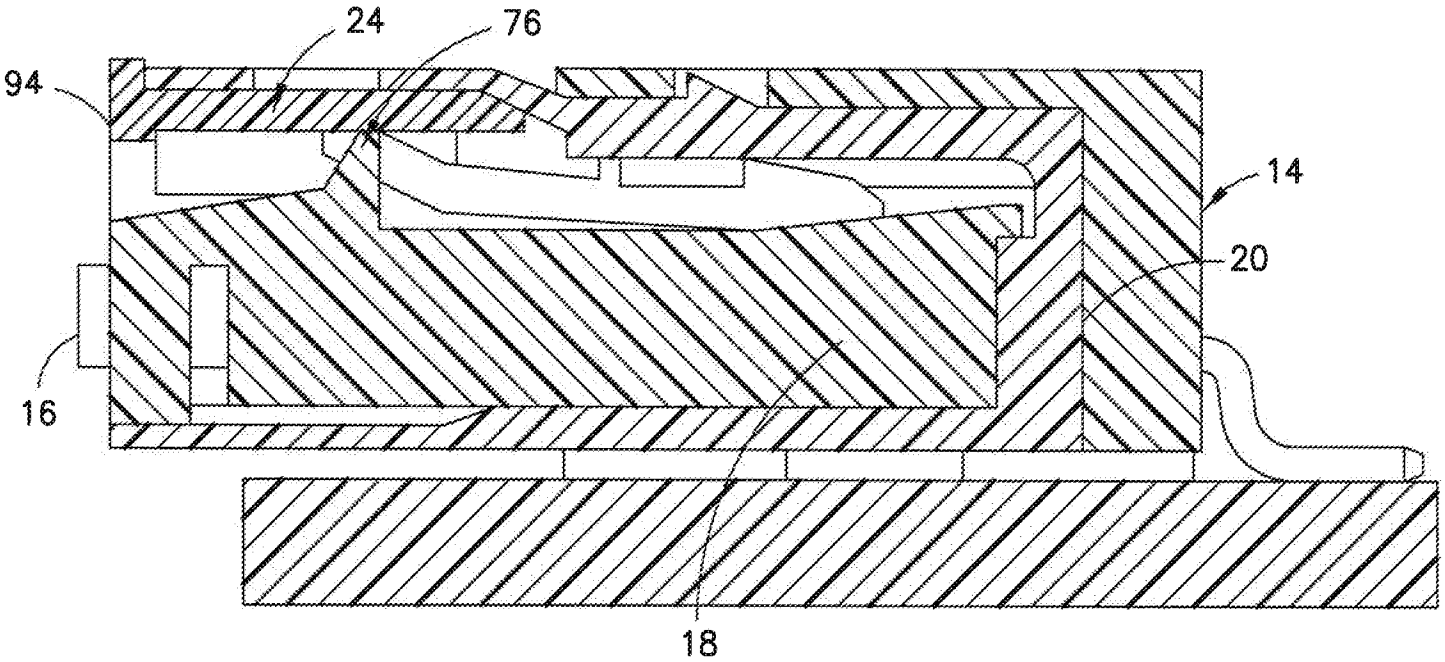
FIGS. 19A and 19B are side sectional views of the assembled inner housing and pre-assembly of the CPA and outer housing in a locked state and secured.
Figure 19B:
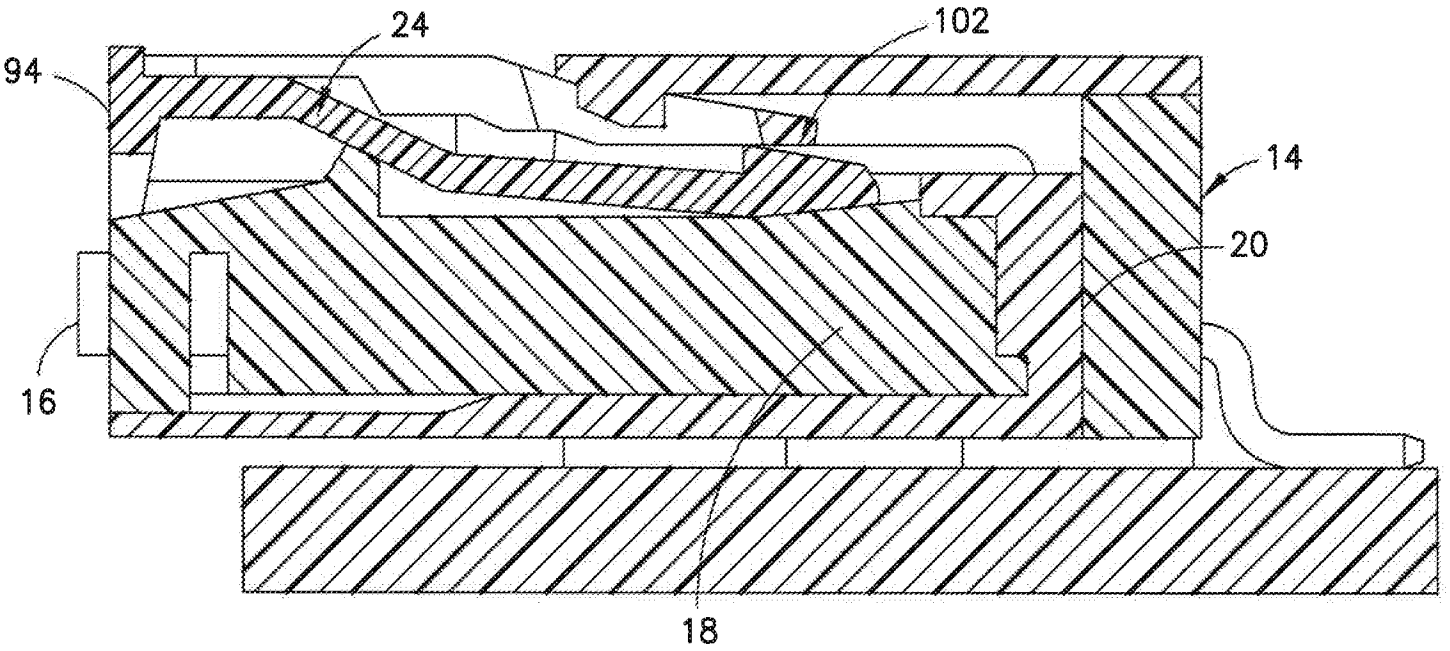

Referring now to FIGS. 19A and 19B, upon full insertion of the CPA 24 into the outer housing 20, the cross beam 98 on the CPA 24 becomes positioned forward of the stopper 76 on the inner housing 18, thereby preventing the removal of the CPA 24 from the outer housing 20 in the event of an accelerated pullback. Additionally, rotation of the latch 22 is prevented by the finger contact member 94, thereby securing the CPA 24 in the outer housing 20. Furthermore, rotation of the latch 22 is further prevented by the hooked portions 102 on the side arms 96 of the CPA 24.

Figure 20A:
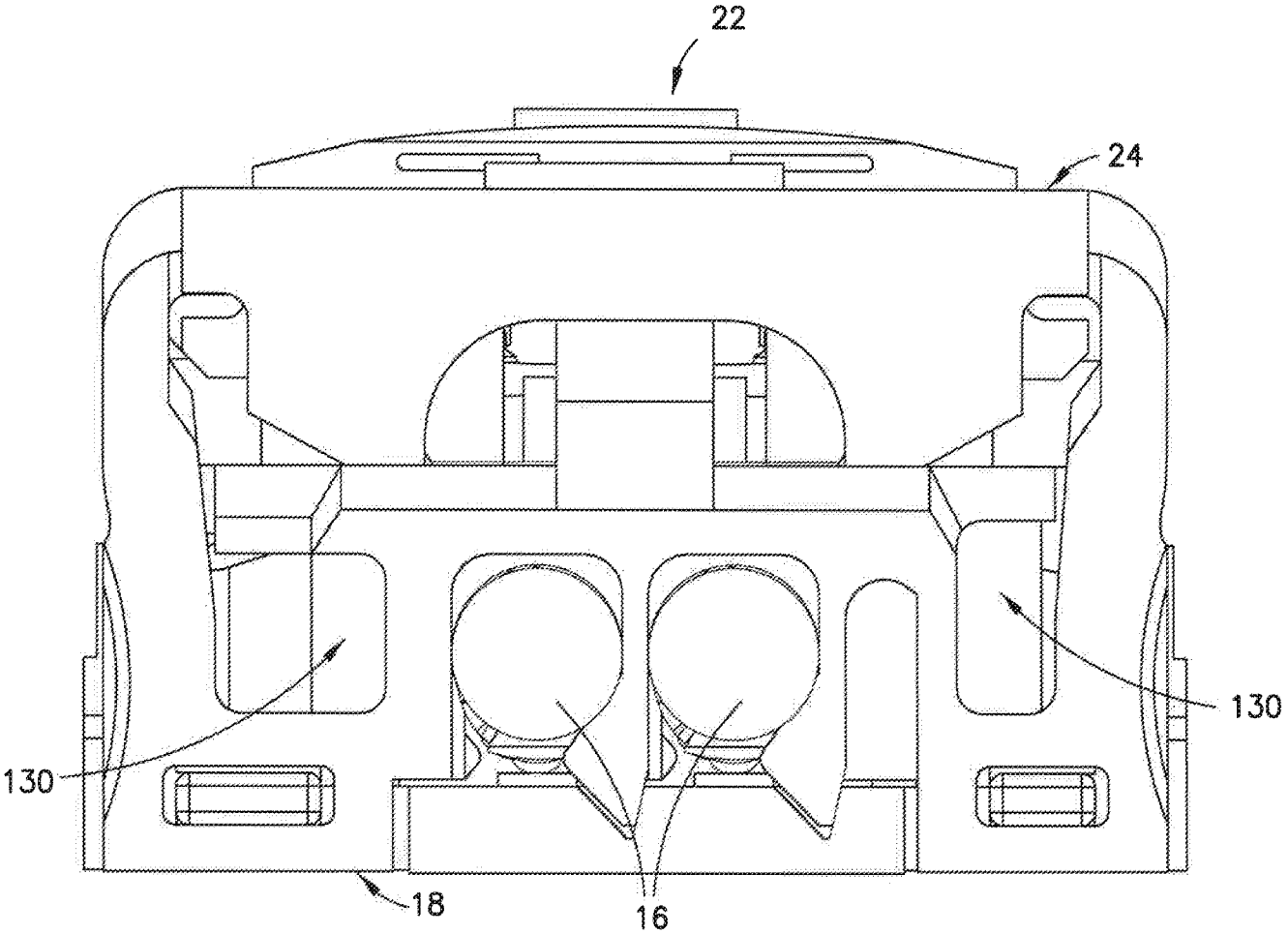
FIG. 20A is a front elevational view of the connector assembly showing channels for repair of the CTW contacts.
Figure 20B:
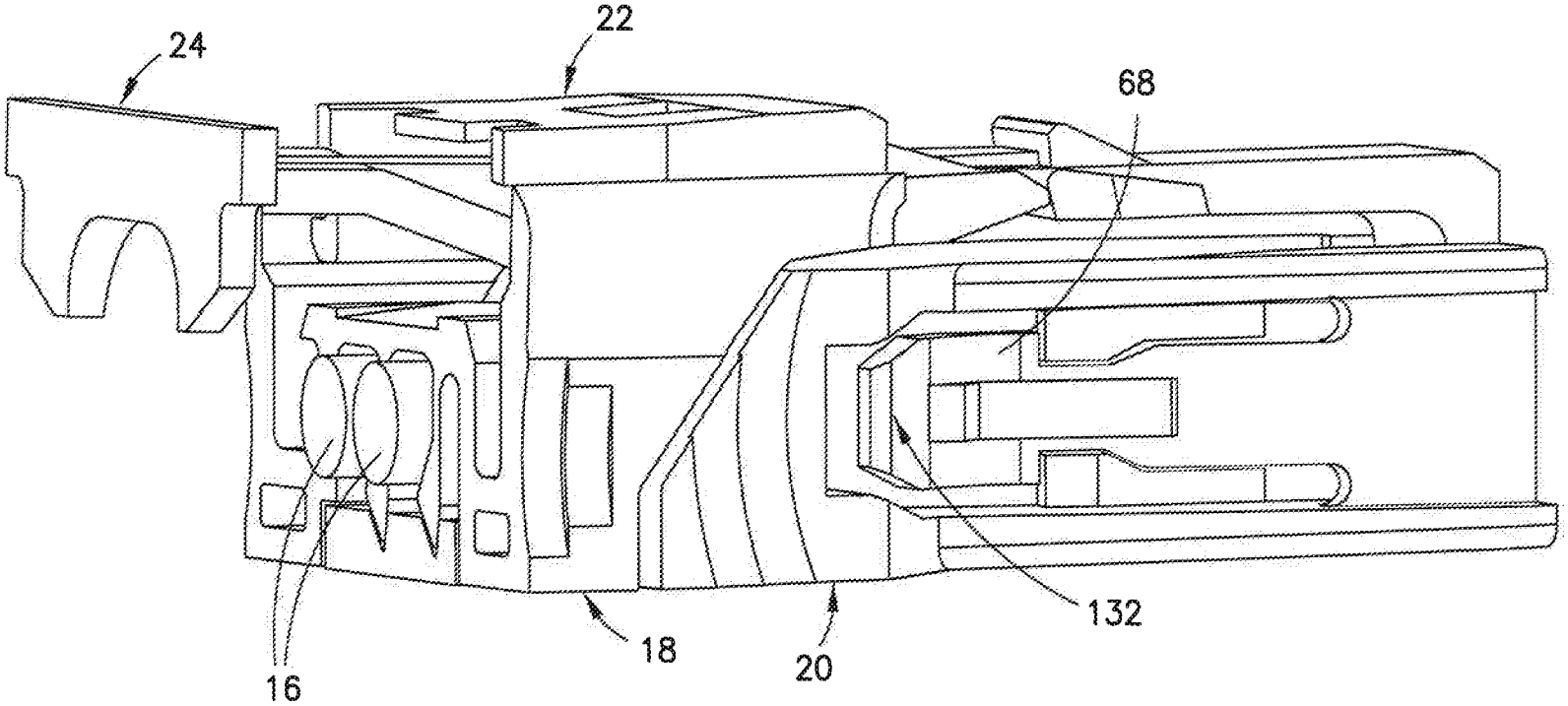
FIG. 20B is a perspective view of the connector assembly of FIG. 20A showing ramps at the ends of the outer fingers on the outer housing.

Referring now to FIGS. 20A and 20B, reparability of the terminal contacts 106 may be effected via channels 130 in the inner housing 18. More specifically, the channels 130 facilitate insertion of a tool into the inner housing 18 to deflect the outer fingers 68 of the outer housing 20 outward, thereby allowing the outer housing 20 to be removed from the inner housing 18 for repair of the terminal contact 106. Ramps 132 at the ends of each outer finger 68 of the outer housing 20 provide a suitable access point for the tool to unlock the outer housing 20 without causing damage to the outer fingers 68. Terminal contacts 106 of the first connector 12 are repaired when the first connector and second connector are not mated to one another.

Figure 21A:
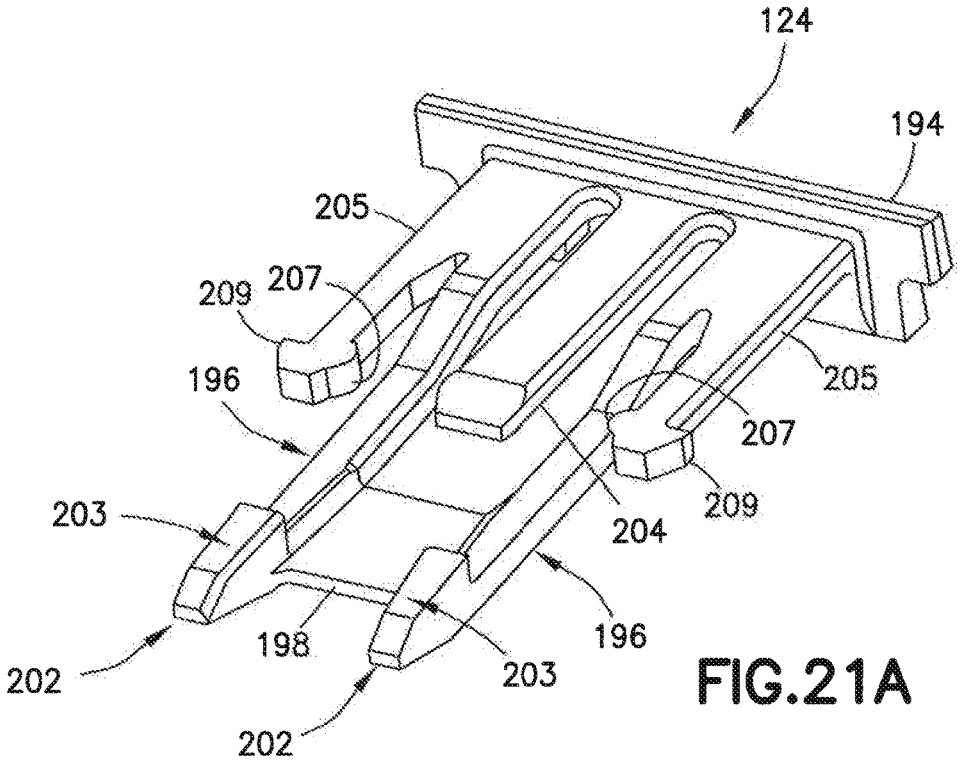
FIGS. 21A and 21B are perspective views of another exemplary embodiment of a CPA of the connector assembly.
Figure 21B:
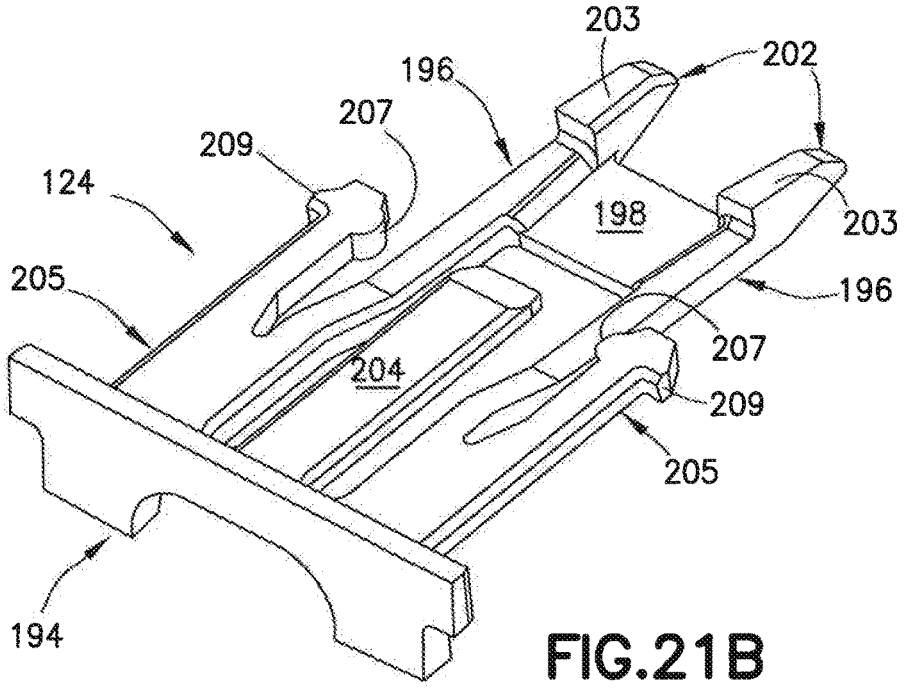

Referring now to FIGS. 21A and 21B, another exemplary embodiment of the CPA is designated generally by the reference number 124. The CPA 124 is fabricated using a polymer or plastic injection molding process. However, other methods of fabricating the CPA 124 may be employed (e.g., stamping, individual assembly of elements, or the like).

The CPA 124 comprises a finger contact member or contact member 194 having two side arms 196 extending therefrom, the side arms 196 being connected distal from the finger contact member 194 by a cross beam 198. The ends of the side arms 196 opposite the finger contact member 194 may include hooked portions 202 each of which have an upward facing chamfered surface 203. A center arm 204 also extends from the finger contact member 194 between the side arms 196 and terminates short of the cross beam 198, the center arm 204 being configured for the central positioning of the CPA 124 within an outer housing.

Whereas the side arms 96 of the CPA 24 are wider in central portions than at the ends, the side arms 196 of the CPA 124 each split to define peripheral arms 205 extending from the outer sides of the side arms 196. Each of the peripheral arms 205 extends substantially parallel to the center arm 204 and terminates short of the cross beam 198. Each of the peripheral arms 205 is also flexible in directions toward and away from the side arms 196. The ends of each peripheral arm 205 are knobbed or otherwise include protrusions. As shown, the ends of each peripheral arm 205 include an inward-facing dimple 207 to provide a tactile effect (as well as an audible "click") when the CPA 124 is secured in the outer housing or second connector as well as outward-facing hooks 209 to facilitate retention of the CPA 124 in the outer housing.

Figure 22A:
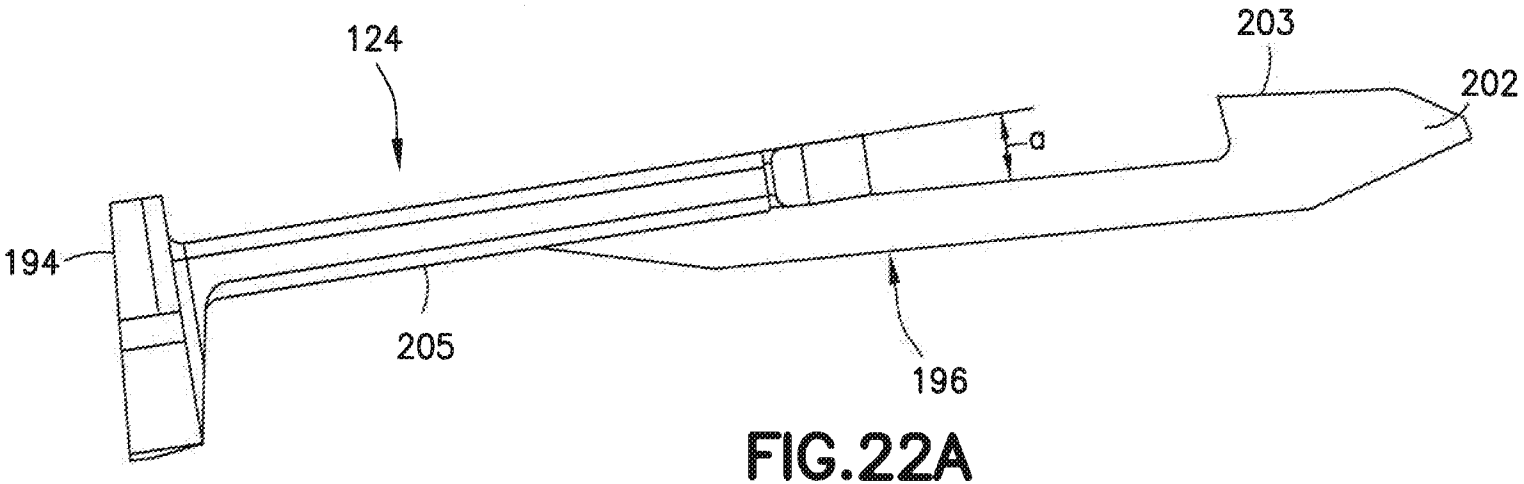
FIGS. 22A and 22B are side sectional views of the CPA of FIGS. 21A and 21B.
Figure 22B:
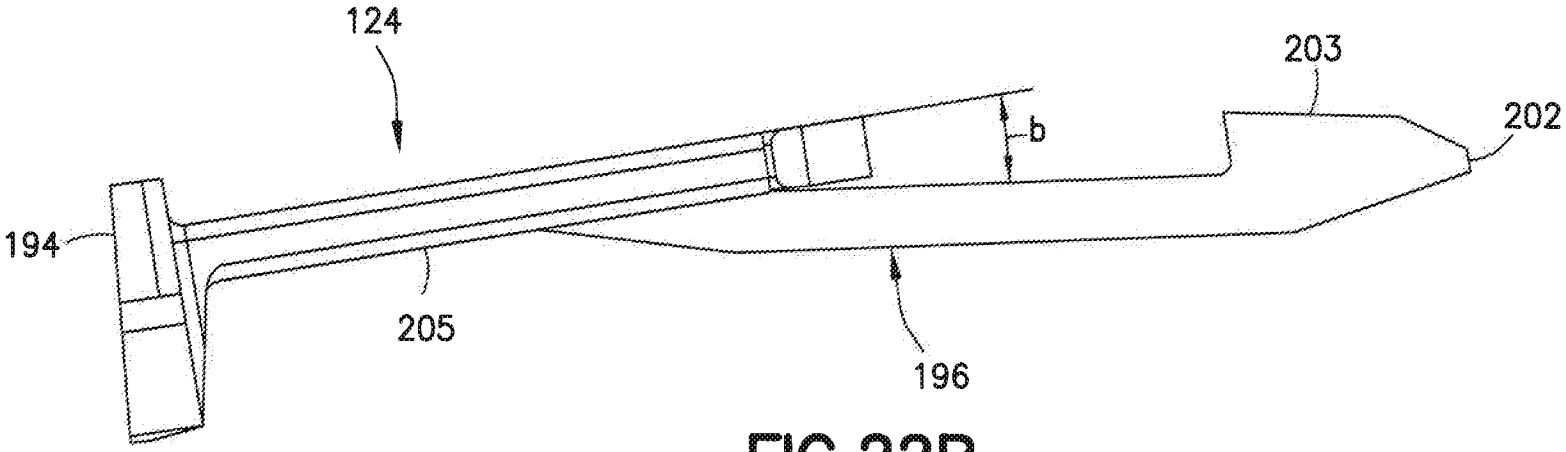

Referring now to FIG. 22A, when the CPA 124 is molded, the peripheral arms 205 are angled relative to the side arms 196 to form an angle a of about 3 degrees between the peripheral arms 205 and a central portion of the side arms 196. When the CPA 124 is assembled to the outer housing or second connector in a pre-assembly process, the peripheral arms 205 are angled relative to the side arms 196 to form an angle b of about 7 degrees.

Figure 23A:
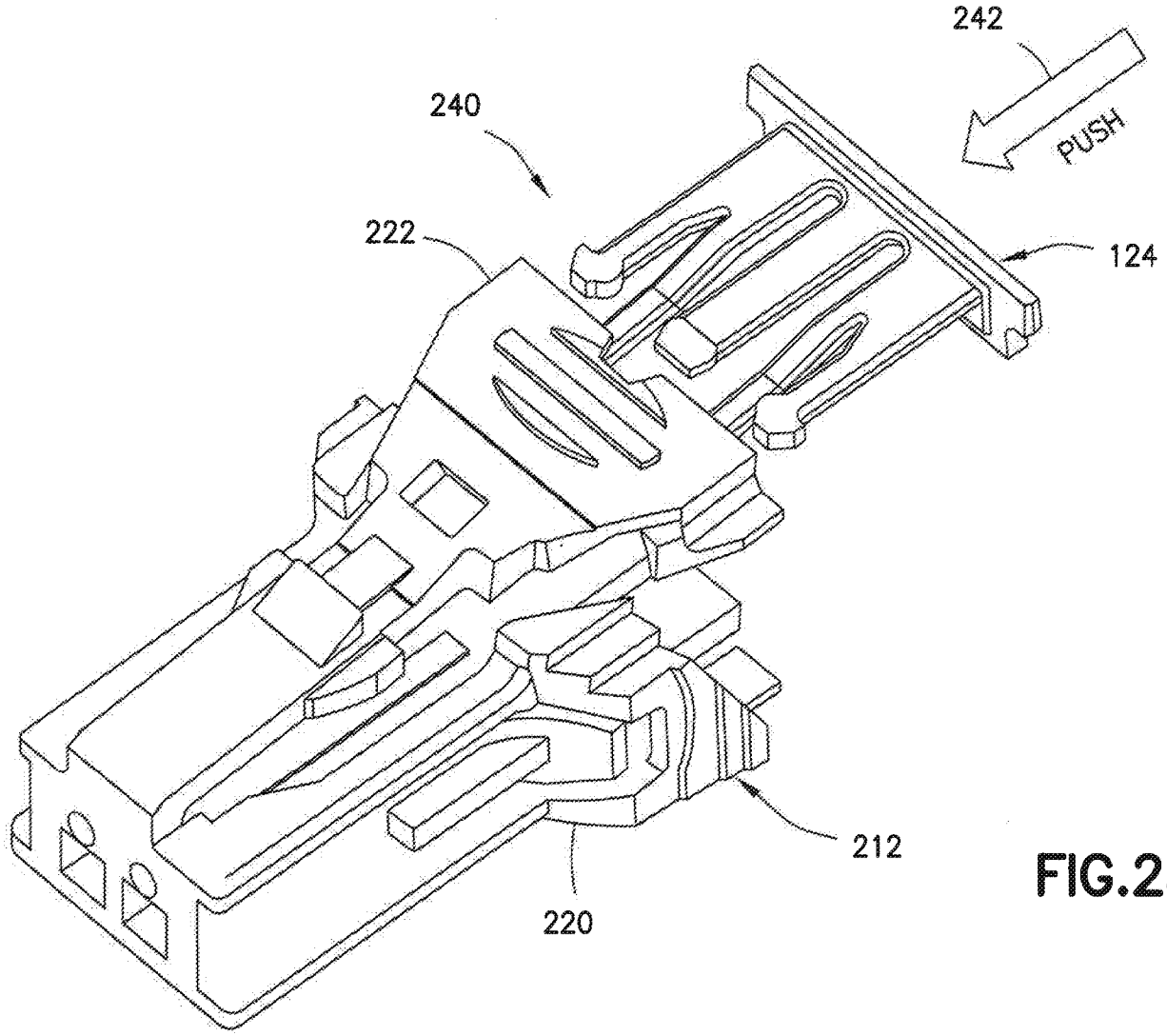
FIGS. 23A, 23B, 23C, and 23D are perspective views of a process of pre-assembling the CPA in a second connector.
Figure 23B:
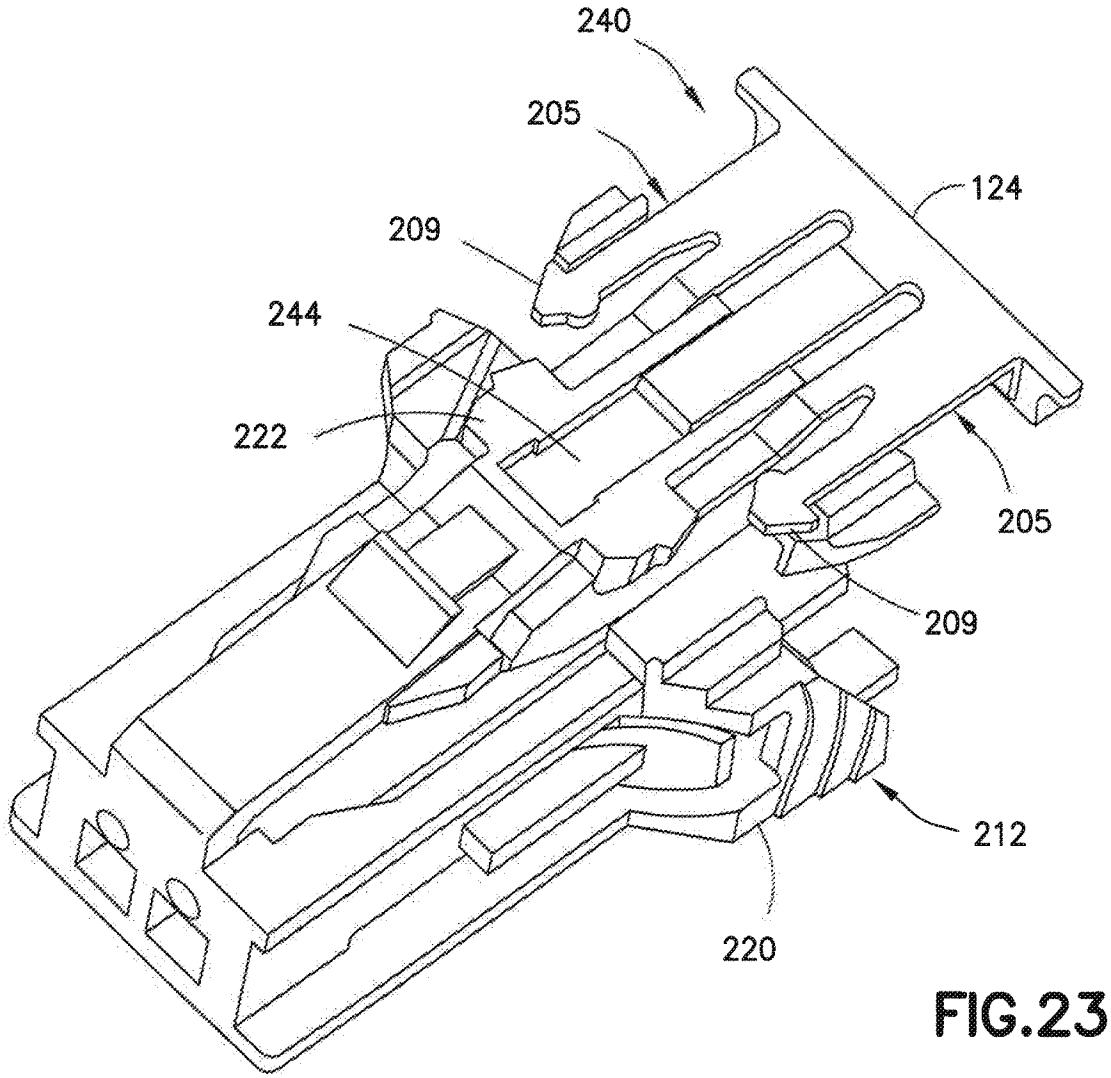
Figure 23C:
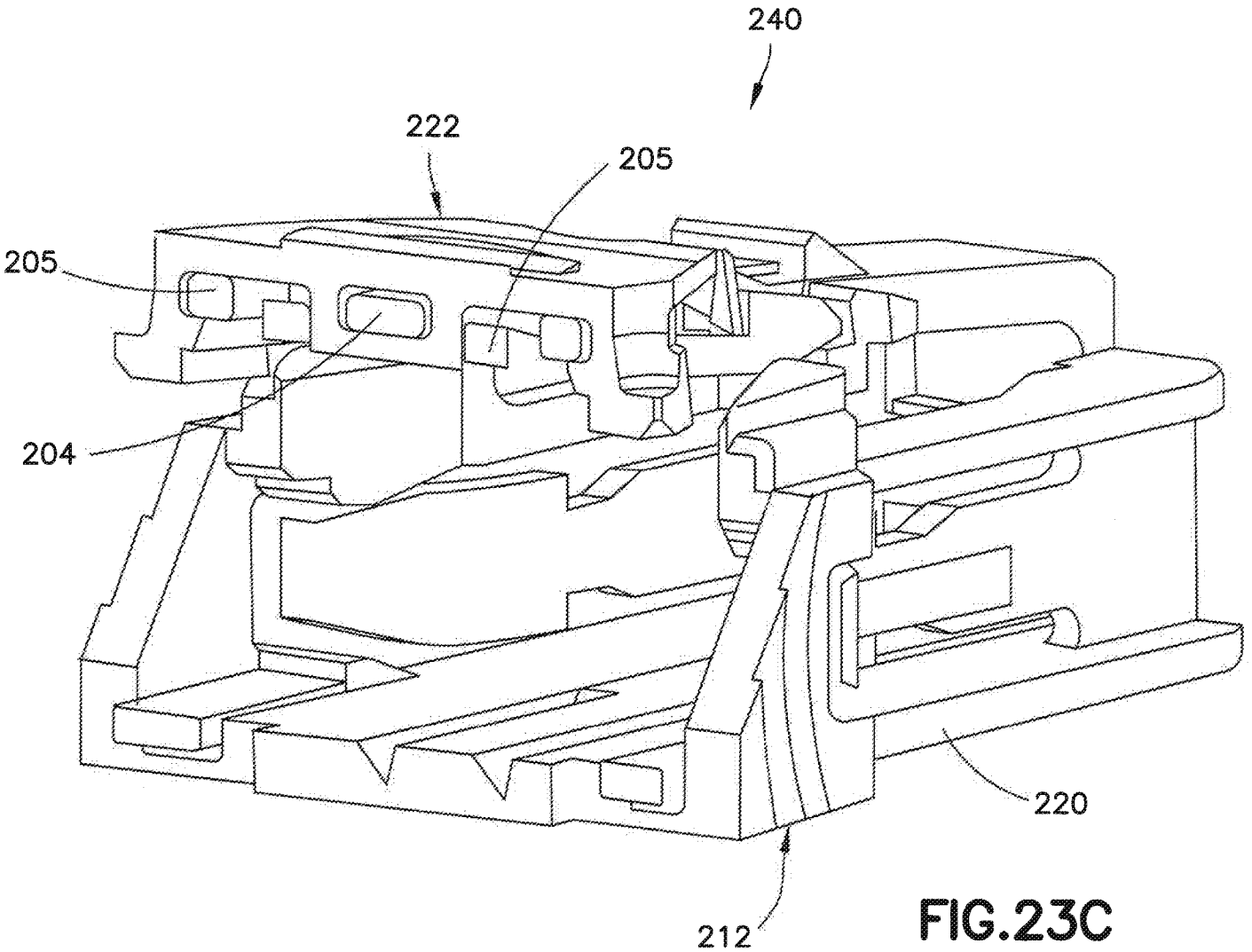
Figure 23D:
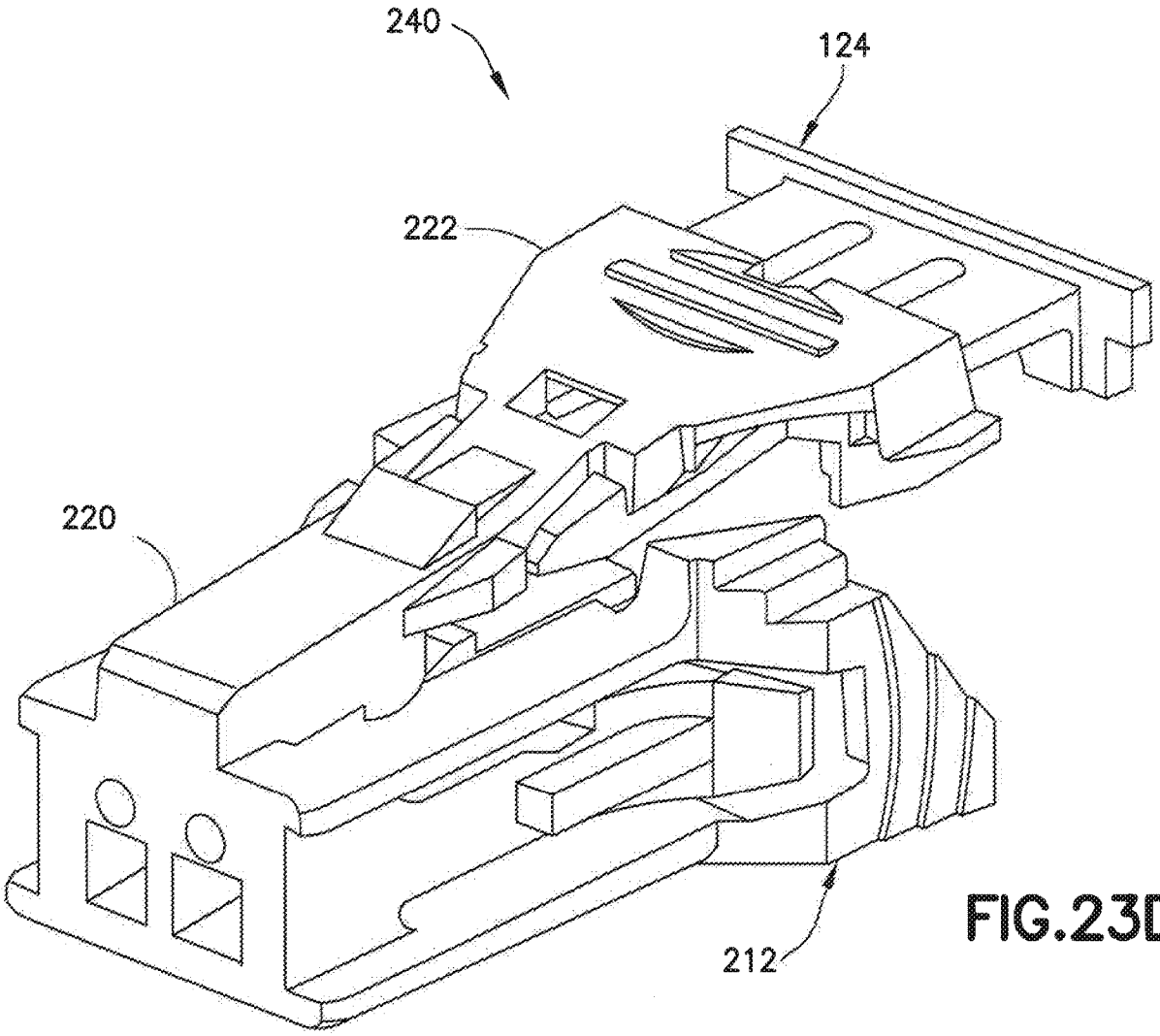

Referring now to FIGS. 23A through 27D, another exemplary embodiment of pre-assembling the CPA in an outer housing is designated generally by the reference number 240 and is hereinafter referred to as "CPA pre-assembly 240." In the CPA pre-assembly 240 (as shown in FIG. 23A), the CPA 124 is mounted in the first connector, which is shown generally at 212, by being partially inserted in the direction of an arrow 242 into an outer housing 220 having a latch 222. As shown in FIG. 23B, once inserted, the center arm 204 is received into a central channel 244 in the latch 222, and the outward-facing hooks 209 of the peripheral arms 205 are engaged with surfaces on the latch 222 to hook the CPA 124 into the outer housing 220. As shown in FIG. 23C, the portions of the CPA 124 at the surface of the latch 222 are shown to indicate the central arm 204 being guided through and located in the central channel 244 and the peripheral arms 205 received along respective surfaces on the latch 222, thereby pre-loading and locking the CPA 124 onto the latch 222. In FIG. 23D, the full CPA pre-assembly 240 (an outer housing 220 with pre-assembled CPA 124 ready for receiving an inner housing 218) is shown.

Figure 24A:
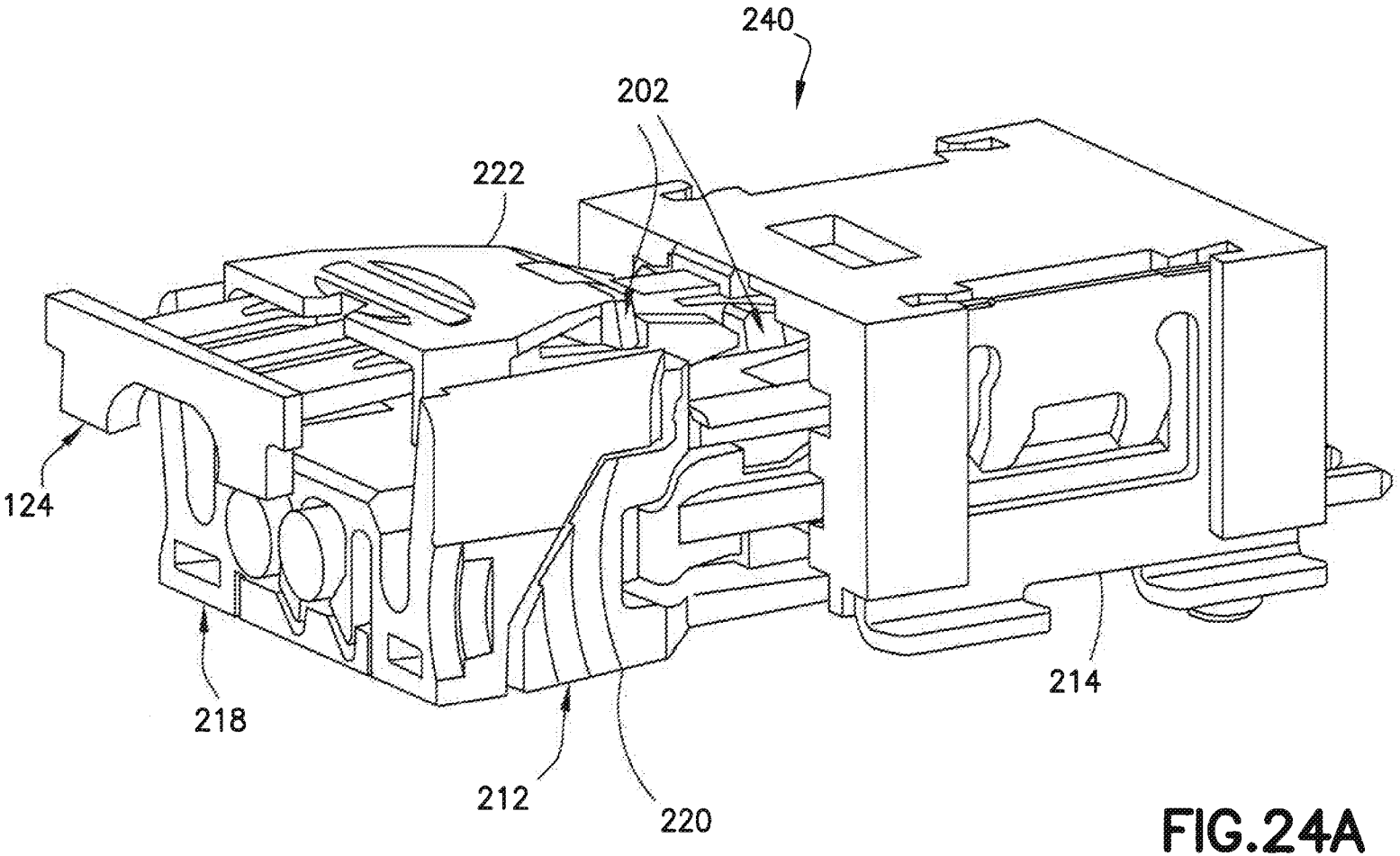
FIG. 24A is a perspective view of the pre-assembled CPA inserted into the second connector.
Figure 24B:
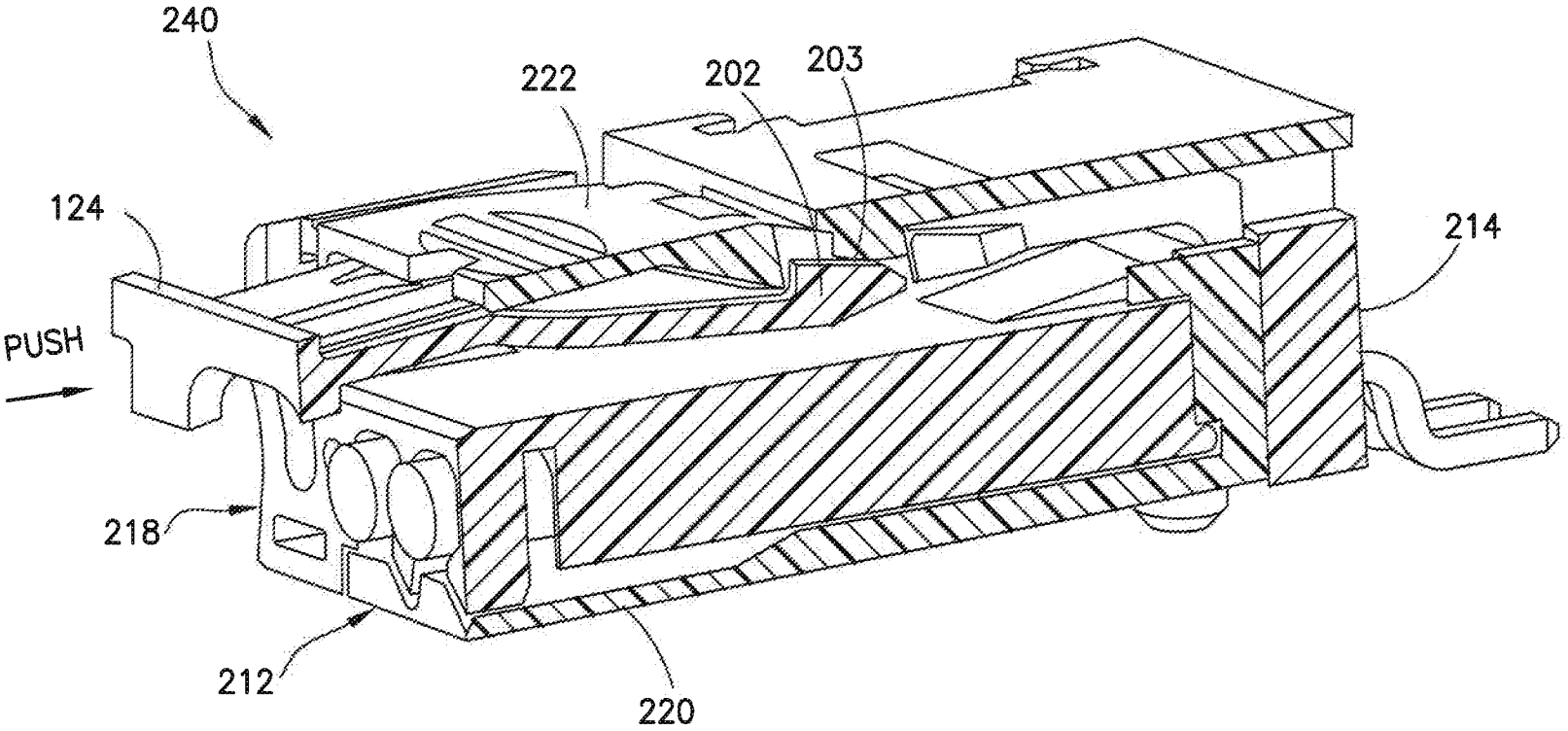
FIG. 24B is a perspective sectional view of the assembly of FIG. 24A.

Referring to FIGS. 24A and 24B, the pre-assembled CPA with the outer housing 220 having an inner housing 218 located therein is shown being inserted into the second connector 214. In inserting the pre-assembled CPA with the outer housing 220 (in which cables 16 are received in the inner housing 218) into the second connector 214, movement of the CPA 124 is blocked by the hooked portions 202 when the first connector 212 and the second connector 214 are not mated. When the first connector 212 (with the pre-assembly of the outer housing 20, the CPA 124, and the inner housing 218) is pushed into the second housing 214, the hooked portions 202 are urged downward, and the CPA 124 is freely receivable in the second connector 214.

Figure 25A:
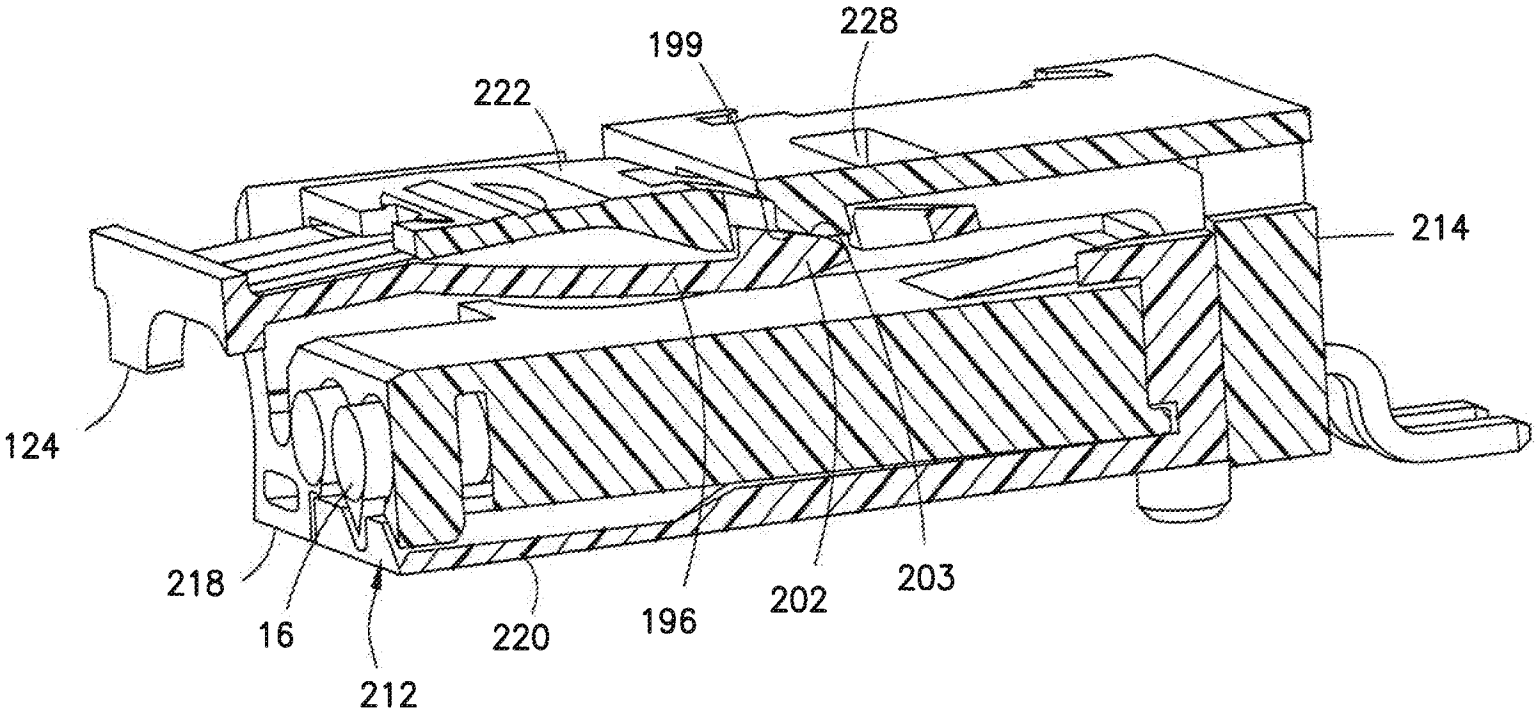
FIGS. 25A and 25B are perspective sectional views of the assembly of FIGS. 24A and 24B with the CPA partially inserted.
Figure 25B:
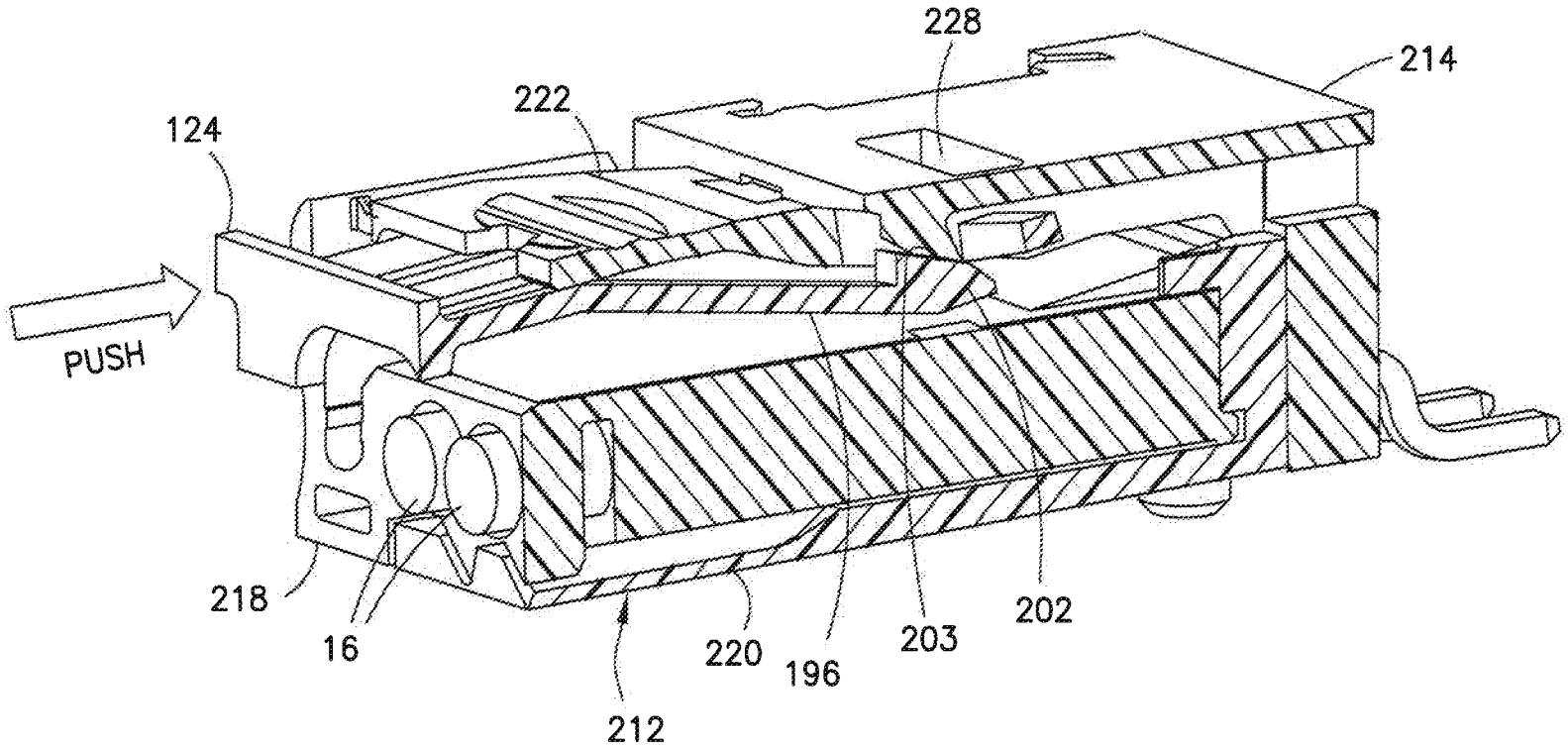
Figure 25C:
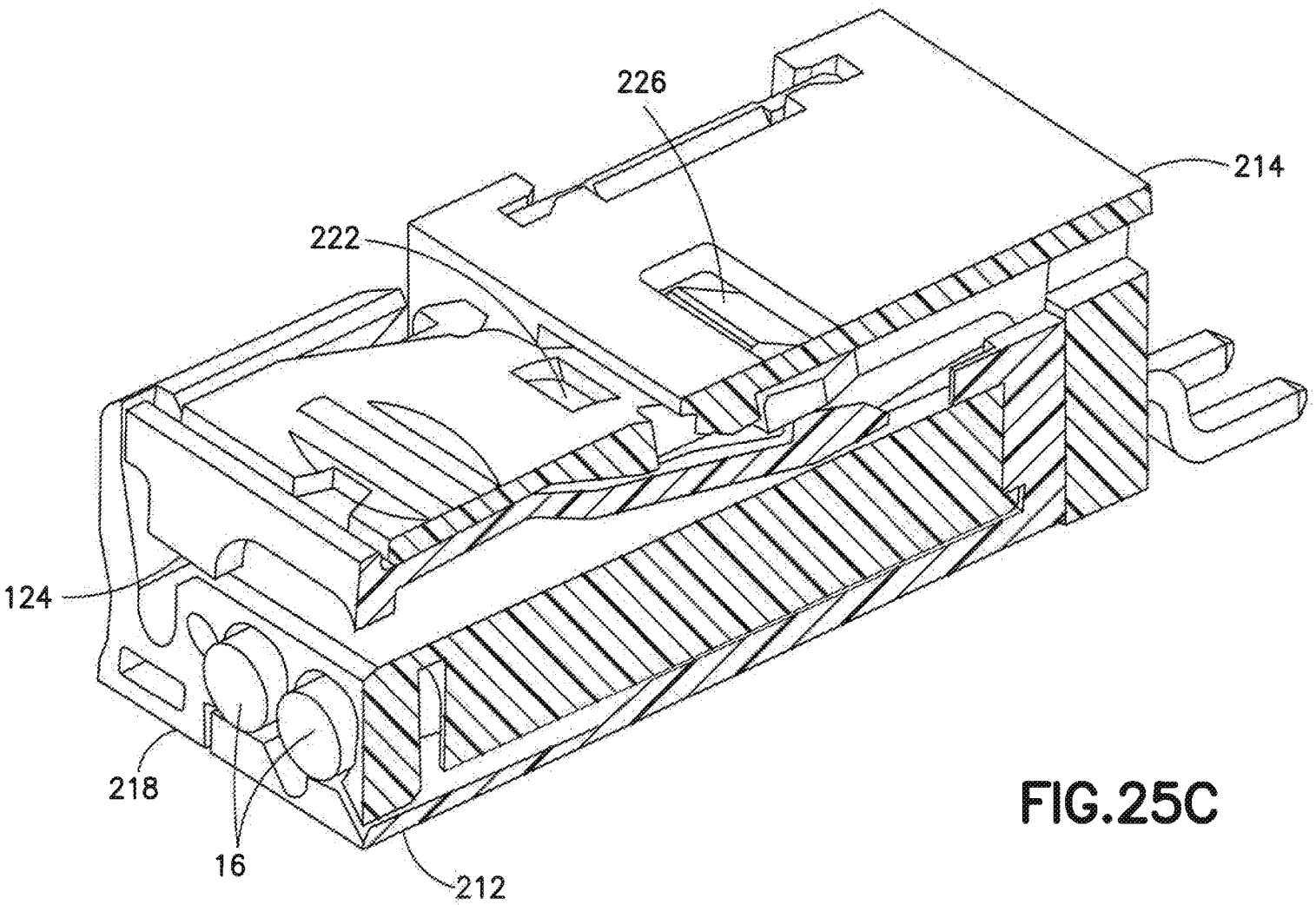
FIG. 25C is a perspective sectional view of the assembly of FIGS. 25A and 25B with the CPA fully inserted.

Referring now to FIGS. 25A through 25C, when the first connector 212 is pushed into the second connector 214 (as shown in FIG. 25A) without the CPA 124 fully inserted, the hooked portions 202 are urged downward in the direction of the inner housing 218 by surfaces 199 in the second connector 214, thereby causing the hooked portions 202 to be disengaged from the latch 222. As shown in FIG. 25B, the chamfered surfaces 203 allow the hooked portions 202 on the side arms 196 to slide downward under surfaces on the latch 222 when the CPA 124 is pushed between the outer housing 220 and the inner housing 218. As shown in FIG. 25C, when the CPA 124 is fully inserted, clearance under the latch 222 is eliminated by features of the CPA 124 (the hooked portions 202 hook into the latch 222). Also, a lock tab 226 on the latch 222 is received in a cavity 228 in the second connector 214. As such, the latch 222 is not removable from the second connector 214, and the first connector 212 (the outer housing 220 with the inner housing 218 carrying the cables 16) is locked into the second connector 214.

Figure 26A:
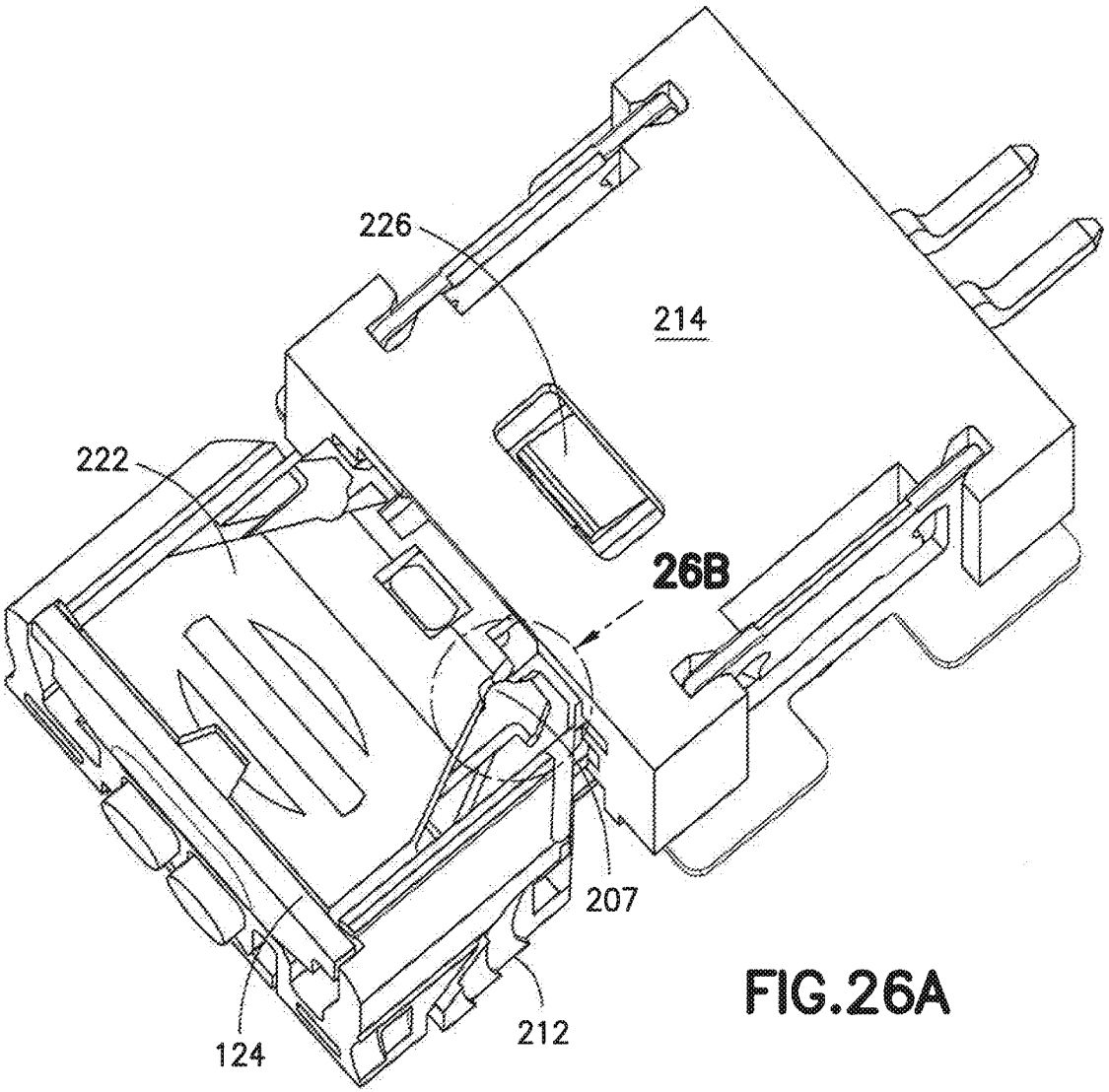
FIGS. 26A and 26B are perspective views of the inserted CPA showing the CPA locked in place.
Figure 26B:
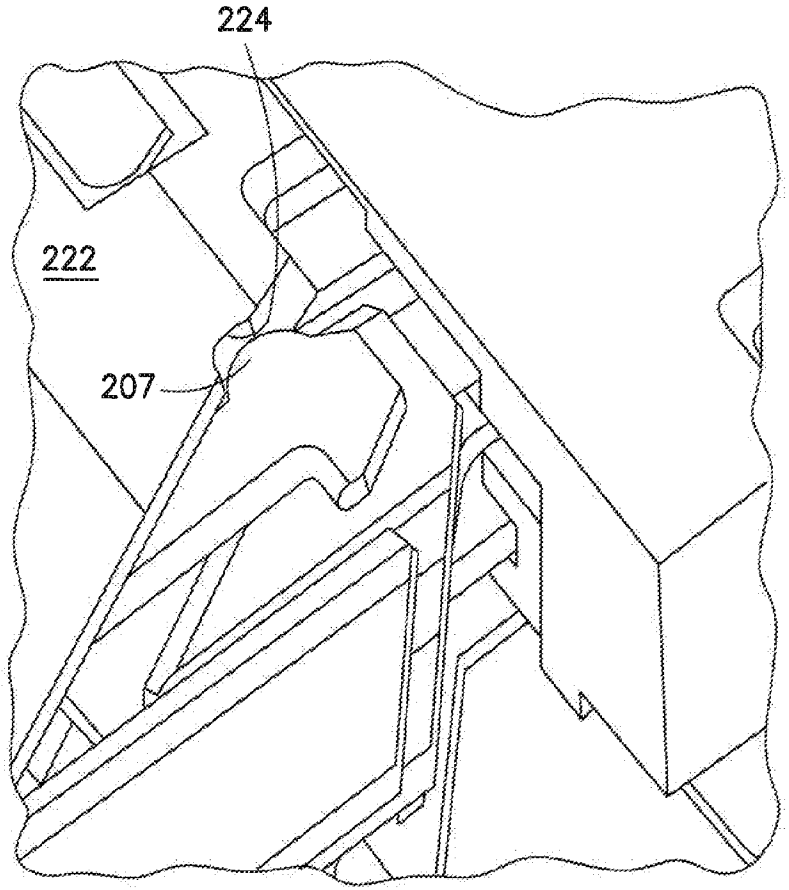

Referring now to FIGS. 26A and 26B, the inward-facing dimples 207 engage cutouts or recesses 224 in the latch 222 to secure the CPA 124 in the latch 222.

Figure 27A:
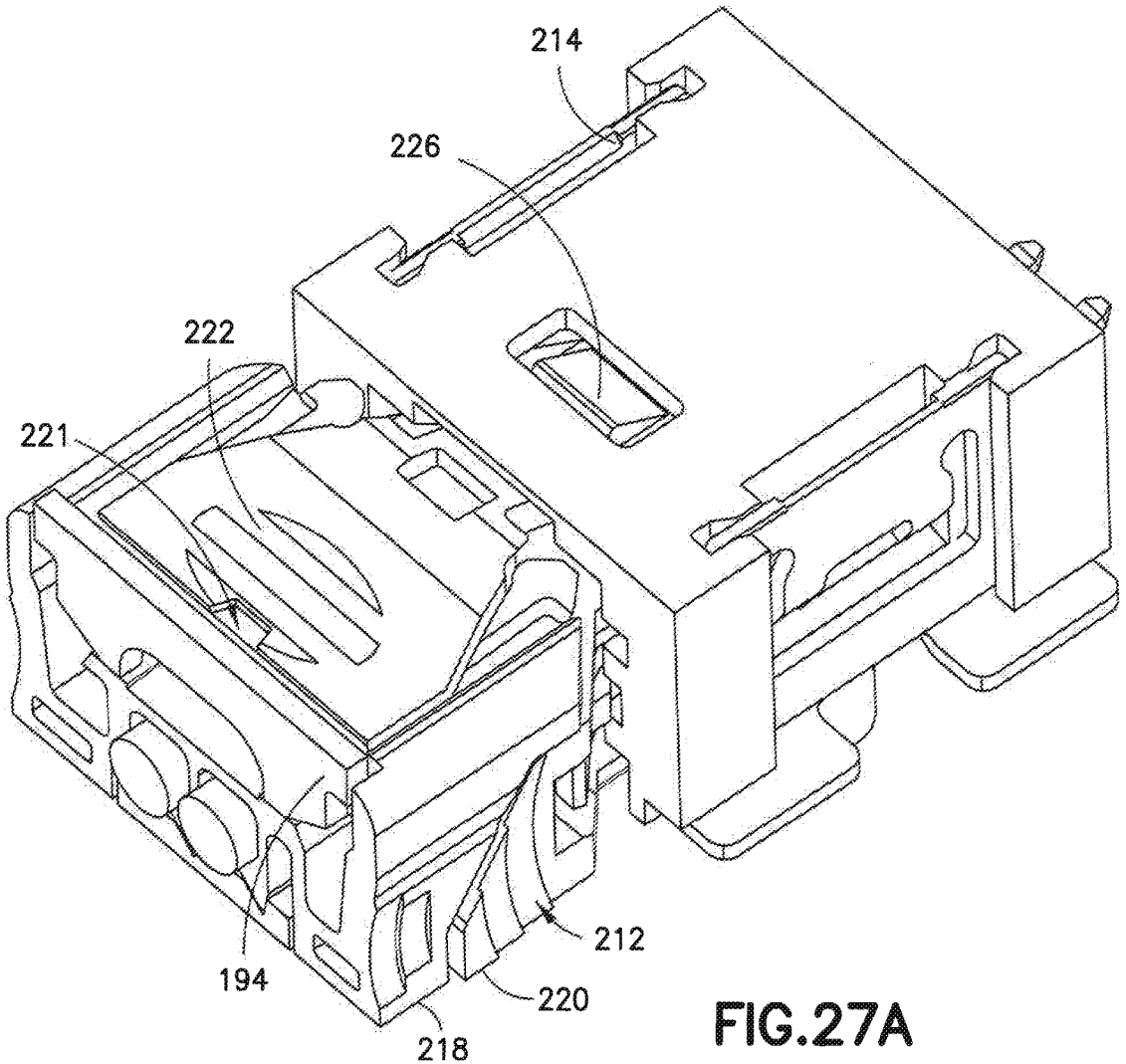
FIGS. 27A, 27B, 27C, and 27D are perspective and perspective sectional views of the disassembly of the CPA from the second connector.
Figure 27B:
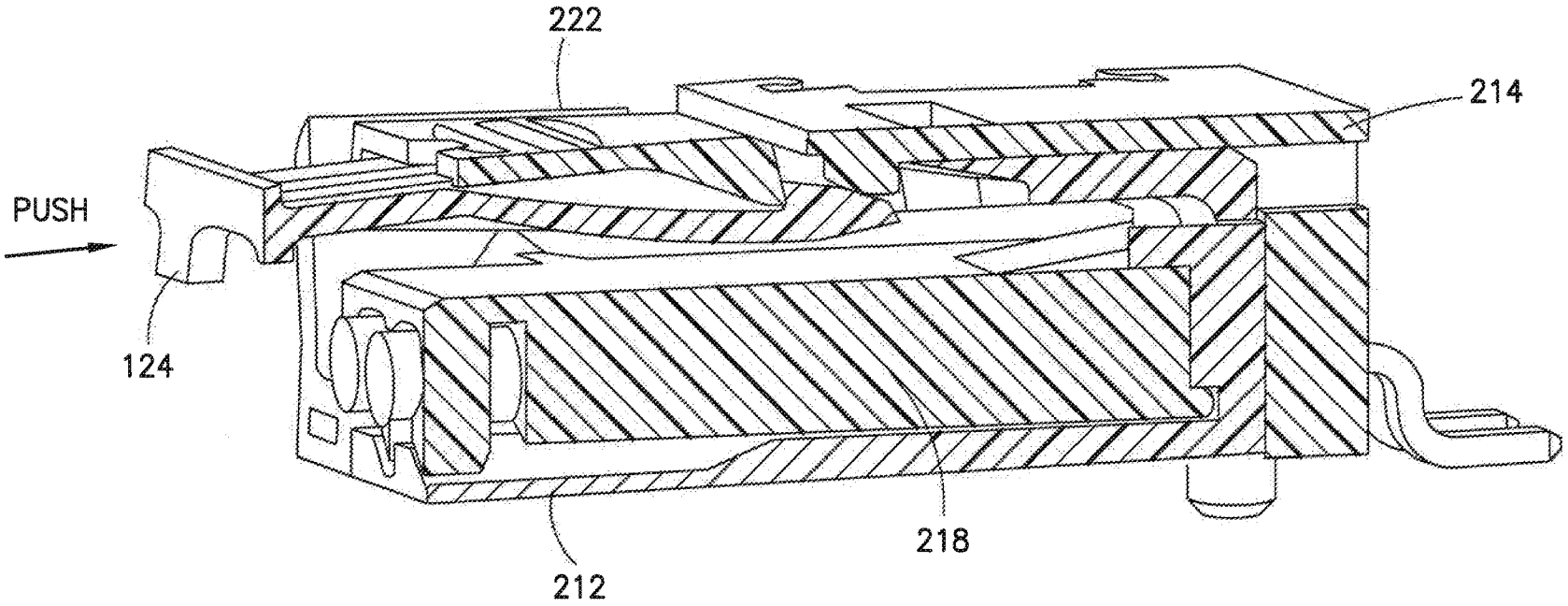
Figure 27C:
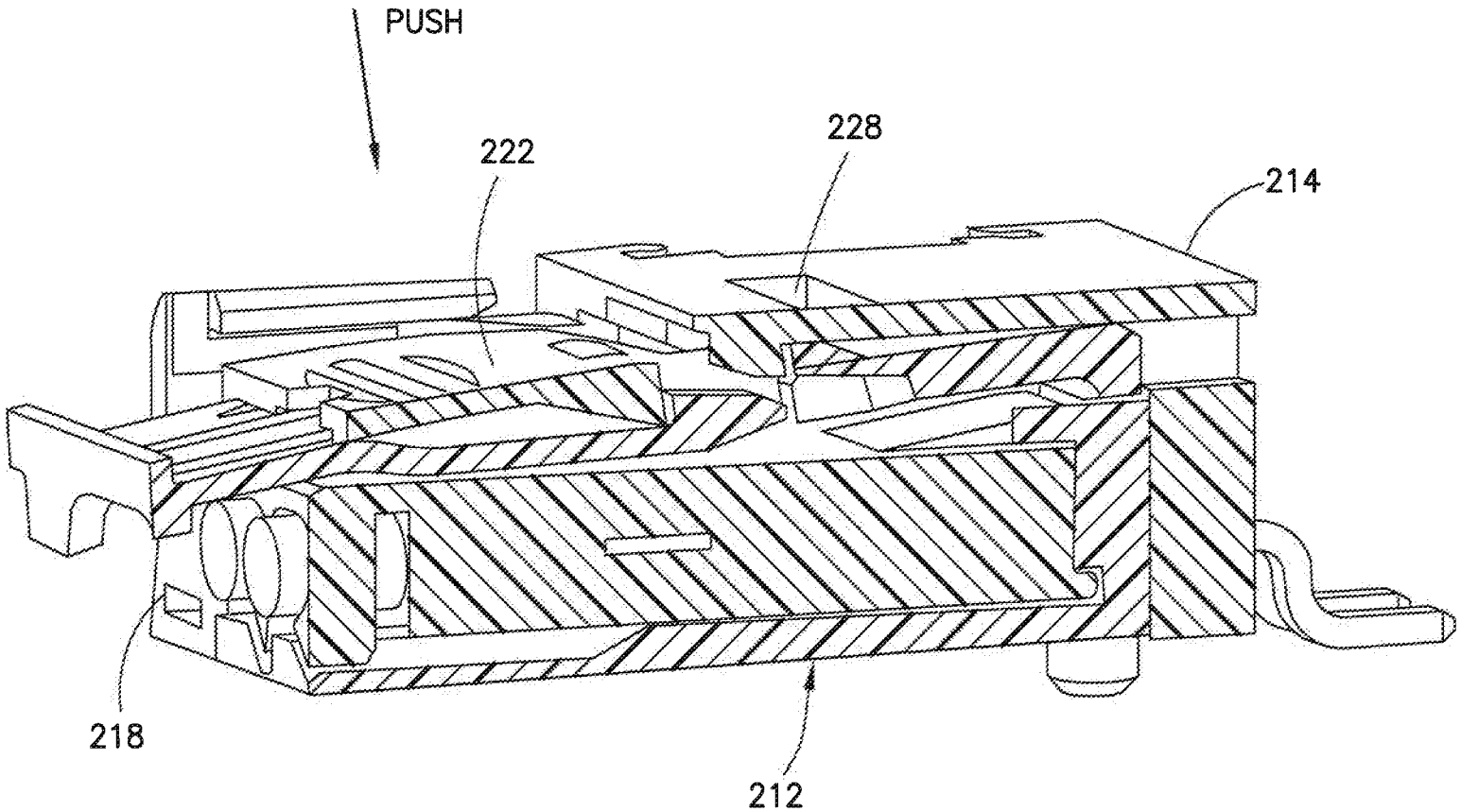
Figure 27D:
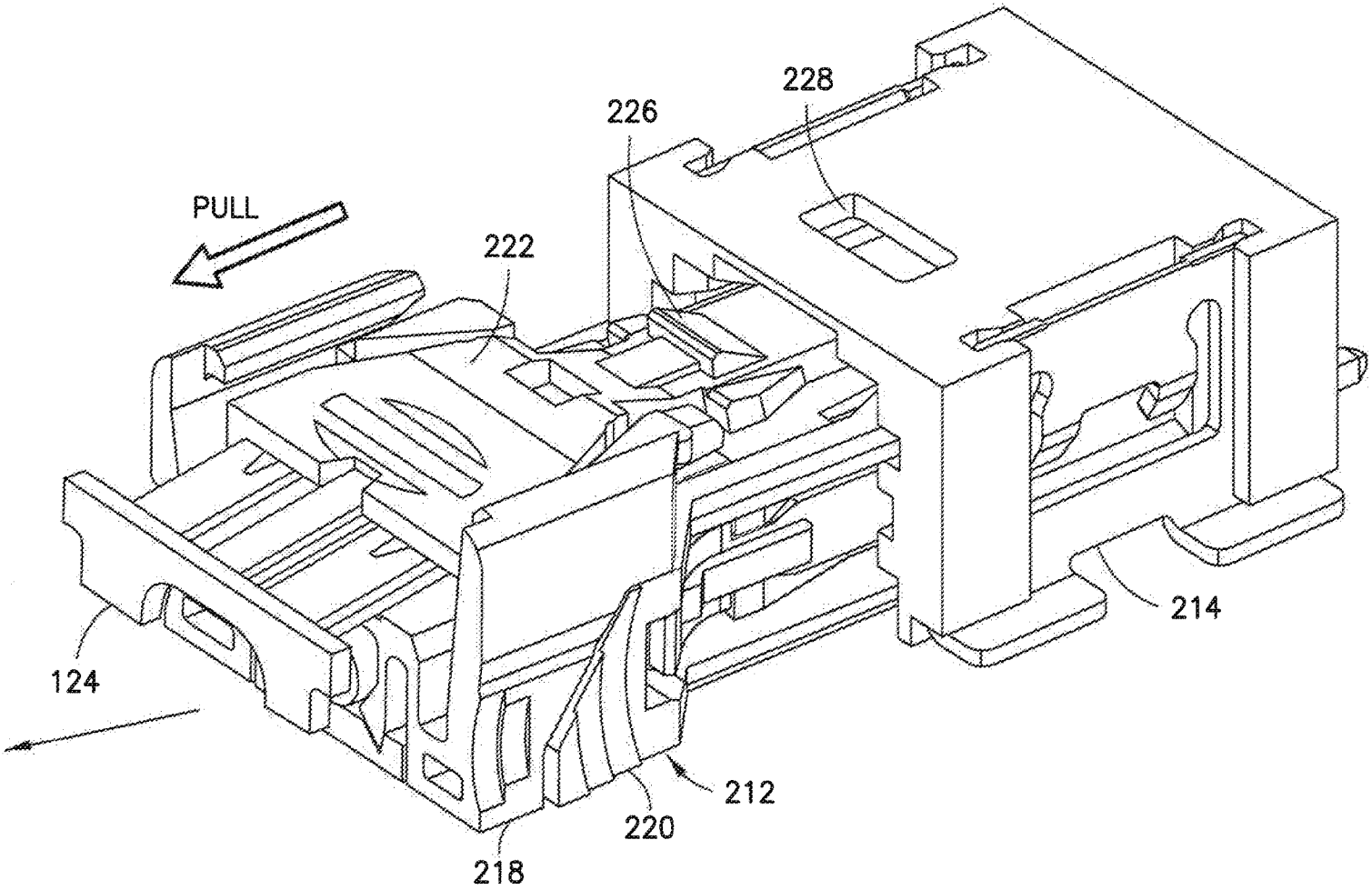

Referring now to FIGS. 27A through 27D, disassembly of the first connector 212 from the second connector 214 is shown. As shown in FIG. 27A, a flat tool (not shown) such as a screwdriver with a flat blade is inserted at a point 221 between a rearward edge of the latch 222 and the top edge of the finger contact member 194 to pry the latch 222 upward. As shown in FIG. 278, the CPA 124 is pulled away from the outer housing 220. As shown in FIG. 27C, the latch 222 is pressed downward to disengage the lock tab 226 from the cavity 228 in the second connector 214. As shown in FIG. 27D, the cable assembly (first connector 212 with the inner housing 218 carrying the cables 16) can be pulled out from the second connector 214.

Figure 28A:
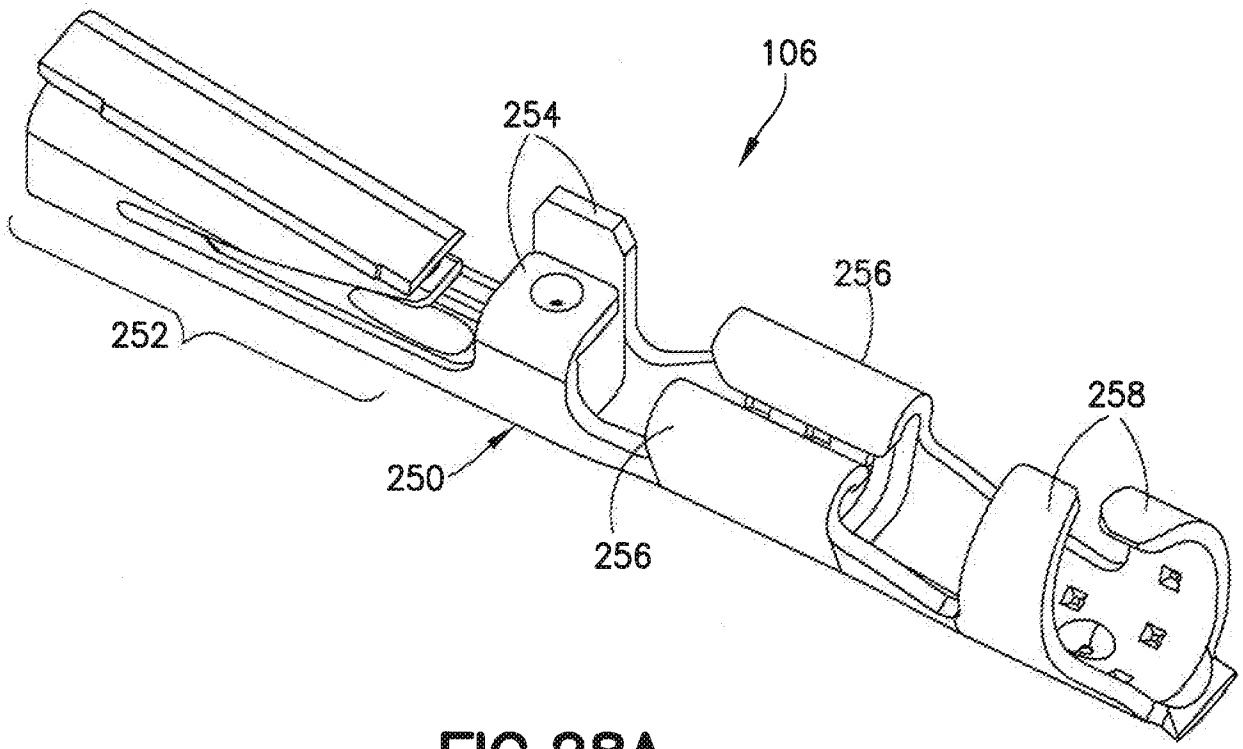
FIGS. 28A and 28B are perspective views of a terminal contact for CTW loading.
Figure 28B:
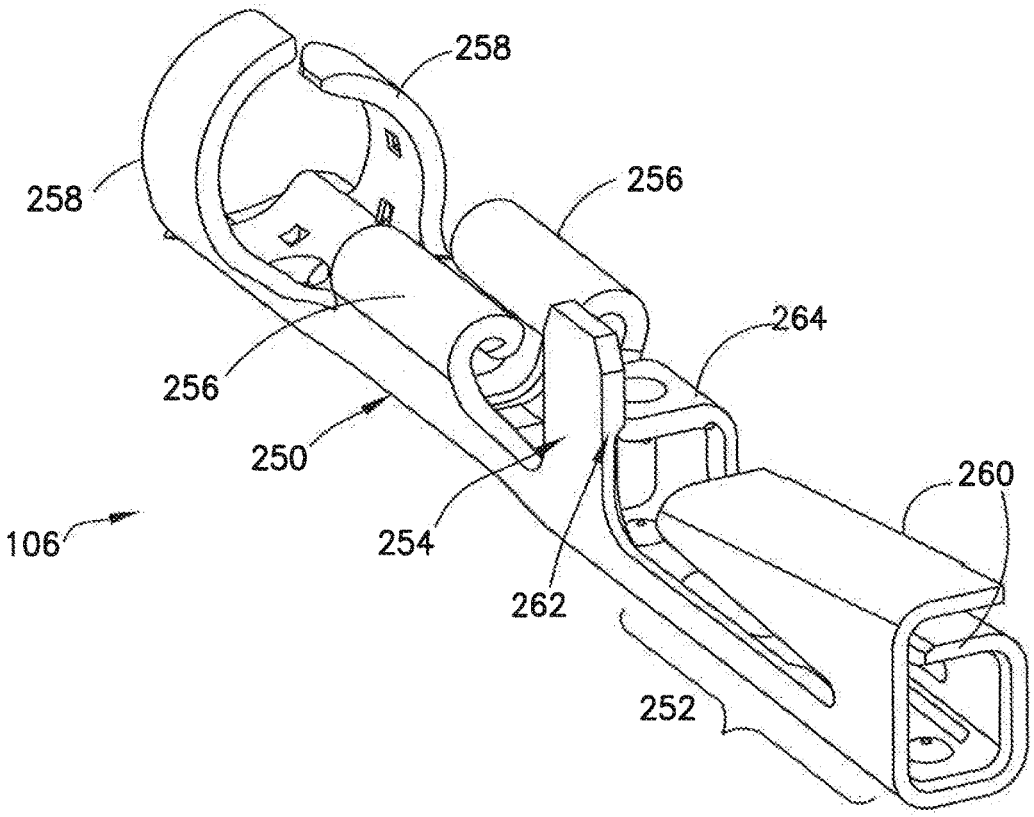

Referring now to FIGS. 28A and 28B, one exemplary embodiment of the terminal contact 106 for the CTW contact loading is shown. The terminal contact 106 comprises an elongated member 250 having a substantially closed tubular portion 252 at one end and mounting ears 254, crimping ears 256, and wire retaining ears 258 along the elongated member 250. The substantially closed tubular portion 252 comprises a rectangular cross-section with one side defined by overlapping side members 260 such that the substantially closed tubular portion 252 can flex to be retained in the inner housing 18, thereby maintaining electrical contact between the terminal contact 106 and the wire.

The mounting ears 254 include a substantially straight portion 262 and an angular portion 264, the angular portion 264 being configured to be bent over the wire inserted into the terminal contact 106.

The crimping ears 256 are planar members that extend from the elongated member 250 and are curled inward and over a centerline of the elongated member 250. When the wire is inserted into the elongated member 250, the crimping ears 256 are squeezed into the wire using a tool to crimp the wire into the elongated member 250.

The wire retaining ears 258 are curved members that extend around outer sides of the wire to grasp the wire substantially uniformly about the circumference of the wire. The wire retaining ears 258 may be offset from each other along the length of the elongated member 250.

In one exemplary aspect, an apparatus comprises a first connector configured to be mated to a second connector, the first connector comprising a latch for connecting the first connector and the second connector, the latch being continuously biased into a position to lock the first connector to the second connector.

The first connector may comprise an inner housing having a cable receiving portion, an outer housing having the latch and being slidably relative to the inner housing, and a CPA removably positioned between the inner housing and the latch. The CPA may comprise a contact member having a center arm and two side arms extending from the contact member, each of the two side arms further comprising a peripheral arm extending outward from the side arm, each of the respective peripheral arms comprising a protrusion on a distal end thereof, each respective protrusion comprising an inward-facing dimple and an outward-facing hook opposite the inward-facing dimple, and each of the respective two side arms being connected to one another by a cross beam. The center arm may extend between the two side arms and terminate short of the cross beam, each of the two side arms being angled relative to the center arm. The center arm may be perpendicular to the contact member. The inward-facing dimples and the outward-facing hooks may be located in a first plane that is parallel to and spaced from a second plane in which the center arm lies. The two side arms and the center arm each may attach to the contact member along a common line that extends across the contact member.

In another exemplary aspect, a connector assembly comprises a first connector configured to be mated to a second connector, the first connector comprising a latch and a flexible prong, the flexible prong being configured to continuously bias the latch into the second connector to lock the first connector to the second connector.

The connector assembly may comprise a CPA removably positioned between the latch and the flexible prong. The CPA may comprise a contact member having a center arm and two side arms extending from the contact member, each of the two side arms further comprising a peripheral arm extending outward from the side arm, each of the respective peripheral arms comprising a protrusion on a distal end thereof, each respective protrusion comprising an inward-facing dimple and an outward-facing hook opposite the inward-facing dimple, and each of the respective two side arms being connected to one another by a cross beam. The center arm may extend between the two side arms and terminate short of the cross beam, each of the two side arms may be angled relative to the center arm, and the center arm may be perpendicular to the contact member. The inward-facing dimples and the outward-facing hooks may be located in a first plane that is parallel to and spaced from a second plane in which the center arm lies. The two side arms and the center arm each may attach to the contact member along a common line that extends across the contact member.

In another exemplary aspect, an electrical connector assembly comprises a first connector comprising an outer housing having an activatable latch flexibly attached thereto, the latch having a lock tab located thereon; an inner housing mounted in the outer housing, the inner housing having first and second prongs integrally formed with the inner housing and configured to continuously bias the latch; and a second connector comprising a cavity formed on a surface thereof. Continuously biasing the latch by the first and second prongs causes the engagement of the lock tab of the first connector with the cavity of the second connector to lock the first connector to the second connector.

The electrical connector assembly may further comprise a CPA removably positioned between the latch and the inner housing. The CPA may comprise a contact member having a center arm and two side arms extending from the contact member, each of the two side arms further comprising a peripheral arm extending outward from the side arm, each of the respective peripheral arms comprising a protrusion on a distal end thereof, each respective protrusion comprising an inward-facing dimple and an outward-facing hook opposite the inward-facing dimple, and each of the respective two side arms being connected to one another by a cross beam. The center arm may extend between the two side arms and terminate short of the cross beam, and each of the two side arms may be angled relative to the center arm, and the center arm may be perpendicular to the contact member. The inward-facing dimples and the outward-facing hooks may be located in a first plane that is parallel to and spaced from a second plane in which the center arm lies.

In another exemplary aspect, a CPA comprises a contact member, the contact member further comprising a center arm and two side arms extending from the contact member, each one of the respective two side arms being connected to one another distal from the contact member by a cross beam, ends of the side arms opposite the contact member each defining hooked portions, the center arm extending between the two side arms and terminating short of the cross beam, and each of the two side arms being angled relative to the center arm.

The center arm may be perpendicular to the contact member. The hooked portions each may lie in a first plane that is parallel to and spaced from a second plane that the center arm lies in. Each of the two side arms may be angled in a direction away from the center arm, and the hooked portions may be angled in a direction toward the center arm. The two side arms and the center arm each may attach to the contact member along a common line that extends across the contact member.

In another exemplary aspect, a CPA comprises a contact member, the contact member further comprising a center arm and two side arms extending from the contact member, each one of the respective two side arms further comprising a peripheral arm extending outward from the side arm, each one of the respective peripheral arms comprising a protrusion on a distal end thereof, each respective protrusion comprising an inward-facing dimple and an outward-facing hook opposite the dimple, and each one of the respective two side arms being connected to one another distal from the contact member by a cross beam.

The center arm may extend between the two side arms and terminate short of the cross beam, and each of the two side arms may be angled relative to the center arm. The center arm may be perpendicular to the contact member. The inward-facing dimples and the outward-facing hooks each may lie in a first plane that is parallel to and spaced from a second plane in which the center arm lies. The two side arms and the center arm each may attach to the contact member along a common line that extends across the contact member.

The foregoing is presented for purposes of illustration and description, but is not intended to be exhaustive or limited to the invention in the form disclosed. Many modifications and variations will be apparent to those of ordinary skill in the art without departing from the scope of the invention. The embodiments were chosen and described in order to best explain the principles of the invention and the practical applications and to enable others of ordinary skill in the art to understand the invention for various embodiments with various modifications as are suited to the particular uses contemplated.

What is claimed is:

1. An apparatus, comprising:

a first connector configured to be mated to a second connector, and a CPA configured to be movably positioned within the first connector, the first connector comprising a latch for connecting the first connector and the second connector, the latch being continuously biased into a position to lock the first connector to the second connector, wherein the CPA is further configured to maintain the engagement between the first and second connectors when the CPA is moved into a first position, the CPA comprising a contact member having a center arm and two side arms extending from the contact member, each of the two side arms further comprising a peripheral arm extending outward from the side arm, each of the respective peripheral arms comprising a protrusion on a distal end thereof, each respective protrusion comprising an inward-facing dimple and an outward-facing hook opposite the inward-facing dimple, and each of the respective two side arms being connected to one another by a cross beam.

2. The apparatus as claimed in claim 1, wherein the first connector comprises an inner housing having a cable receiving portion, an outer housing having the latch and being slidably relative to the inner housing, and a CPA removably positioned between the inner housing and the latch.

3. The apparatus as claimed in claim 2, the center arm extending between the two side arms and terminating short of the cross beam, and each of the two side arms being angled relative to the center arm.

4. The apparatus as claimed in claim 2, wherein the center arm is perpendicular to the contact member.

5. The apparatus claimed in claim 2, wherein the inward-facing dimples and the outward-facing hooks are located in a first plane that is parallel to and spaced from a second plane in which the center arm lies.

6. The apparatus as claimed in claim 2, wherein the two side arms and the center arm each attach to the contact member along a common line that extends across the contact member.

7. A connector assembly, comprising:

a first connector configured to be mated to a second connector, the first connector comprising a latch and a flexible prong, the flexible prong being configured to continuously bias the latch into the second connector to lock the first connector to the second connector by applying a force to the latch in a direction transverse to a direction of latch movement, further comprising a CPA removably positioned between the latch and a housing of the first connector, wherein the CPA comprises one or more arms that extend from a central member and terminate in a hooked end, configured to hook onto a complimentary feature on the first connector and prevent the latch from disengaging the second connector when the CPA is inserted into the first connector.

8. A connector assembly, comprising:

a first connector configured to be mated to a second connector, and a CPA configured to be movably positioned within the first connector, the first connector comprising a latch for connecting the first connector and the second connector, the latch being continuously biased into a position to lock the first connector to the second connector, wherein the CPA comprises a contact member having a center arm, wherein two side arms extend from the contact member, each of the two side arms further comprising a peripheral arm extending outward from the side arm, each of the respective peripheral arms comprising a protrusion on a distal end thereof, each respective protrusion comprising an inward-facing dimple and an outward-facing hook opposite the inward-facing dimple, and each of the respective two side arms being connected to one another by a cross beam.

9. The connector assembly as claimed in claim 8, wherein the center arm extends between the two side arms and terminates short of the cross beam, wherein each of the two side arms is angled relative to the center arm, and wherein the center arm is perpendicular to the contact member.

10. The connector assembly as claimed in claim 8, wherein the inward-facing dimples and the outward-facing hooks are located in a first plane that is parallel to and spaced from a second plane in which the center arm lies.

11. The connector assembly as claimed in claim 8, wherein the two side arms and the center arm each attach to the contact member along a common line that extends across the contact member.

12. An electrical connector assembly, comprising:

a first connector comprising:

an outer housing having an activatable latch flexibly attached thereto, the latch having a lock tab located thereon;

an inner housing mounted in the outer housing, the inner housing having first and second prongs integrally formed with the inner housing and configured to continuously bias the latch; and a second connector comprising a cavity formed on a surface thereof;

wherein continuously biasing the latch by the first and second prongs causes the engagement of the lock tab of the first connector with the cavity of the second connector to lock the first connector to the second connector.

13. The electrical connector assembly as claimed in claim 12, further comprising a CPA removably positioned between the latch and the inner housing.

14. The electrical connector assembly as claimed in claim 13, wherein the CPA comprises a contact member having a center arm and two side arms extending from the contact member, each of the two side arms further comprising a peripheral arm extending outward from the side arm, each of the respective peripheral arms comprising a protrusion on a distal end thereof, each respective protrusion comprising an inward-facing dimple and an outward-facing hook opposite the inward-facing dimple, and each of the respective two side arms being connected to one another by a cross beam.

15. The electrical connector assembly as claimed in claim 14, wherein the center arm extends between the two side arms and terminates short of the cross beam, wherein each of the two side arms is angled relative to the center arm, and wherein the center arm is perpendicular to the contact member.

16. The electrical connector assembly as claimed in claim 14, wherein the inward-facing dimples and the outward-facing hooks are located in a first plane that is parallel to and spaced from a second plane in which the center arm lies.

17. The electrical connector assembly as claimed in 15, wherein the CPA comprises a contact member, the contact member further comprising a center arm and two side arms extending from the contact member, each one of the respective two side arms is connected to one another distal from the contact member by a cross beam, ends of the side arms opposite the contact member each defining hooked portions, the center arm extends between the two side arms and terminates short of the cross beam, and each of the two side arms are angled relative to the center arm.

18. The electrical connector assembly as claimed in claim 17, wherein the center arm of the CPA is perpendicular to the contact member.

19. The electrical connector assembly as claimed in claim 17, wherein the hooked portions of the CPA each lie in a first plane that is parallel to and spaced from a second plane that the center arm lies in.

20. The electrical connector assembly as claimed in claim 19, wherein each of the two side arms of the CPA are angled in a direction away from the center arm and the hooked portions are angled in a direction toward the center arm.

21. The electrical connector assembly as claimed in claim 17 wherein the two side arms of the CPA and the center arm each attach to the contact member along a common line that extends across the contact member.

* * * * *